US007921480B2

(12) United States Patent
Parsons et al.

(10) Patent No.: US 7,921,480 B2
(45) Date of Patent: Apr. 12, 2011

(54) PASSIVE SENSORS AND CONTROL ALGORITHMS FOR FAUCETS AND BATHROOM FLUSHERS

(76) Inventors: Natan E. Parsons, Brookline, MA (US); Fatih Guler, Winchester, MA (US); Yue Zhang, Nashua, NH (US); Xiaoxiong Mo, Lexington, MA (US); Kay Herbert, Winthrop, MA (US); Haiou Wu, West Roxbury, MA (US)

( * ) Notice: Subject to any disclaimer, the term of this patent is extended or adjusted under 35 U.S.C. 154(b) by 990 days.

(21) Appl. No.: 11/446,506

(22) Filed: Jun. 2, 2006

(65) Prior Publication Data

US 2007/0057215 A1 Mar. 15, 2007

Related U.S. Application Data

(63) Continuation of application No. PCT/US2004/040887, filed on Dec. 6, 2004, which is a continuation-in-part of application No. PCT/US03/38730, filed on Dec. 4, 2003, and a continuation-in-part of application No. PCT/US03/41303, filed on Dec. 26, 2003, and a continuation-in-part of application No. 10/860,938, filed on Jun. 3, 2004, now Pat. No. 7,069,941, which is a continuation of application No. PCT/US02/38757, filed on Dec. 4, 2002, and a continuation-in-part of application No. 10/859,750, filed on Jun. 3, 2004, now Pat. No. 7,437,778, which is a continuation of application No. PCT/US02/38758, filed on Dec. 4, 2002, application No. 11/446,506, which is a continuation-in-part of application No. 11/098,574, filed on Apr. 4, 2005, now abandoned, which is a continuation of application No. 10/440,997, filed on May 19, 2003, now Pat. No. 6,874,535, which is a continuation of application No. PCT/US01/43277, filed on Nov. 20, 2001.

(51) Int. Cl.
*F16K 31/06* (2006.01)

(52) U.S. Cl. ..... 4/313; 4/623; 137/624.11; 250/221; 251/129.04

(58) Field of Classification Search ..... 251/129.04; 137/624.11; 4/623, 313; 250/221
See application file for complete search history.

(56) References Cited

U.S. PATENT DOCUMENTS 207,482 A 8/1878 Blessing ..... 137/188
1,501,331 A 7/1924 Gulick ..... 137/245
(Continued)

FOREIGN PATENT DOCUMENTS

DE 29717352 1/1998
(Continued)

OTHER PUBLICATIONS

International Search Report issued in PCT Application PCT/US 03/41303 on May 4, 2004 (5 pages).
(Continued)

*Primary Examiner* — John Bastianelli
(74) *Attorney, Agent, or Firm* — Ivan David Zitkovsky

(57) ABSTRACT

An optical system includes one or several passive optical detectors sensitive to ambient (room) light for controlling, for example, the operation of automatic faucets or automatic bathroom flushers. The passive optical sensors provide signals to flow controllers, including control electronics and flow valves and require only very small amounts of electrical power for sensing users of bathroom facilities, and thus enable battery operation for many years. To control the operation of automatic faucets or automatic bathroom flushers based on ambient light, the controller executes novel algorithms.

32 Claims, 69 Drawing Sheets

U.S. PATENT DOCUMENTS

| | | | | | |
|---|---|---|---|---|---|
| 2,619,122 | A | | 11/1952 | Hunter | 251/120 |
| 2,619,986 | A | | 12/1952 | Goepfrich et al. | 251/129.17 |
| 2,685,301 | A | | 8/1954 | Dreier | 137/386 |
| 2,827,073 | A | | 3/1958 | Owens | 137/426 |
| 2,842,400 | A | | 7/1958 | Booth et al. | 239/569 |
| 2,877,791 | A | | 3/1959 | Rich | 137/487 |
| 2,923,314 | A | | 2/1960 | Badger, Jr. et al. | 137/414 |
| 2,986,155 | A | | 5/1961 | Doyle | 137/218 |
| 2,999,191 | A | | 9/1961 | Muradian et al. | 361/195 |
| 3,019,453 | A | | 2/1962 | Radcliffe | 4/249 |
| 3,034,151 | A | | 5/1962 | Filliung | 4/249 |
| 3,056,143 | A | | 10/1962 | Foster | 4/249 |
| 3,058,485 | A | | 10/1962 | McQueen | 137/403 |
| 3,098,635 | A | | 7/1963 | Delaporte et al. | 251/54 |
| 3,166,291 | A | | 1/1965 | Specht | 251/285 |
| 3,242,940 | A | | 3/1966 | Sirotek | 137/218 |
| 3,254,664 | A | | 6/1966 | Delaney et al. | 137/244 |
| 3,318,565 | A | | 5/1967 | Cutler | 251/45 |
| 3,369,205 | A | | 2/1968 | Hamrick | 335/177 |
| 3,373,449 | A | | 3/1968 | Rusnok | 4/305 |
| 3,386,462 | A | | 6/1968 | Walters | 137/244 |
| 3,400,731 | A | | 9/1968 | McCormack | 137/245 |
| 3,495,803 | A | | 2/1970 | Schoepe et al. | 251/25 |
| 3,495,804 | A | | 2/1970 | Muller et al. | 251/36 |
| 3,559,675 | A | | 2/1971 | Schoepe et al. | 137/436 |
| 3,606,241 | A | | 9/1971 | Bornholdt | 251/52 |
| 3,693,649 | A | | 9/1972 | Gordon et al. | 137/414 |
| 3,740,019 | A | | 6/1973 | Kessell et al. | 251/129.17 |
| 3,763,881 | A | | 10/1973 | Jones | 137/414 |
| 3,778,023 | A | | 12/1973 | Billeter | 251/30.01 |
| 3,791,619 | A | | 2/1974 | Pett | 251/45 |
| 3,802,462 | A | | 4/1974 | Trösch | 137/556 |
| 3,812,398 | A | | 5/1974 | Kozel et al. | 251/331 |
| 3,821,967 | A | | 7/1974 | Sturman | 137/624.15 |
| 3,842,857 | A | | 10/1974 | McCornack | 137/242 |
| 3,864,567 | A | | 2/1975 | Bez | 250/338.1 |
| 3,895,645 | A | | 7/1975 | Johnson | 137/403 |
| 4,010,769 | A | | 3/1977 | De Lorenzo et al. | 137/312 |
| 4,011,553 | A | | 3/1977 | Delgado | |
| 4,065,095 | A | | 12/1977 | Johnson | 251/118 |
| 4,097,786 | A | | 6/1978 | Lund | 318/282 |
| 4,105,186 | A | | 8/1978 | Eby | 251/35 |
| 4,114,647 | A | | 9/1978 | Sturman et al. | 137/624.2 |
| 4,135,696 | A | | 1/1979 | Saarem et al. | 251/30.02 |
| 4,141,091 | A | | 2/1979 | Pulvari | 4/313 |
| 4,206,901 | A | | 6/1980 | Williams | 251/35 |
| 4,231,287 | A | | 11/1980 | Smiley | 92/94 |
| 4,257,437 | A | * | 3/1981 | Pearson | 137/8 |
| 4,272,052 | A | | 6/1981 | Gidner | 251/39 |
| 4,280,680 | A | | 7/1981 | Payne | 251/175 |
| 4,295,485 | A | | 10/1981 | Waterfield | 137/74 |
| 4,295,631 | A | | 10/1981 | Allen | 251/30.03 |
| 4,295,653 | A | | 10/1981 | Coles | 277/320 |
| 4,304,391 | A | | 12/1981 | Yamaguchi | 251/129.05 |
| 4,309,781 | A | | 1/1982 | Lissau | 4/304 |
| 4,383,234 | A | | 5/1983 | Yatsushiro et al. | 335/253 |
| 4,505,451 | A | | 3/1985 | Jonas | 251/285 |
| 4,570,272 | A | | 2/1986 | Kawaguchi et al. | 4/302 |
| 4,604,735 | A | | 8/1986 | Parsons | 367/93 |
| 4,609,178 | A | | 9/1986 | Baumann | 251/229 |
| 4,611,356 | A | | 9/1986 | Lin | 4/301 |
| 4,671,485 | A | | 6/1987 | Saarem | 251/60 X |
| 4,672,206 | A | | 6/1987 | Suzuki et al. | 250/347 |
| 4,681,141 | A | * | 7/1987 | Wang | 137/607 |
| 4,709,427 | A | | 12/1987 | Laverty, Jr. | 4/427 |
| 4,729,342 | A | | 3/1988 | Loctin | 119/163 |
| 4,756,031 | A | | 7/1988 | Barrett | 4/407 |
| 4,767,922 | A | | 8/1988 | Stauffer | 250/221 |
| 4,787,411 | A | | 11/1988 | Moldenhauer | 137/244 |
| 4,793,588 | A | | 12/1988 | Laverty, Jr. | 251/30.03 |
| 4,795,908 | A | | 1/1989 | Morimoto et al. | 250/353 |
| 4,796,658 | A | | 1/1989 | Caple | 137/312 |
| 4,796,662 | A | | 1/1989 | Hoffmann et al. | 137/596.16 |
| 4,805,247 | A | | 2/1989 | Laverty, Jr. | 4/304 |
| 4,823,414 | A | | 4/1989 | Piersimoni et al. | 4/623 |
| 4,823,825 | A | | 4/1989 | Buchl | 137/1 |
| 4,826,129 | A | | 5/1989 | Fong et al. | 251/129.04 |
| 4,826,132 | A | | 5/1989 | Moldenhauer | 251/129.17 |
| 4,832,263 | A | | 5/1989 | Poynor | 239/197 |
| 4,832,582 | A | | 5/1989 | Buffet | 417/413.1 |
| 4,839,039 | A | | 6/1989 | Parsons et al. | 210/143 |
| 4,891,864 | A | | 1/1990 | Laverty, Jr. | 91/399 |
| 4,893,645 | A | | 1/1990 | Augustinas et al. | 137/315.03 |
| 4,894,698 | A | | 1/1990 | Hijikigawa et al. | 257/254 |
| 4,894,874 | A | | 1/1990 | Wilson | 4/623 |
| 4,910,487 | A | | 3/1990 | Kleinhappl | 335/234 |
| 4,911,401 | A | | 3/1990 | Holcomb et al. | 251/30.03 |
| 4,921,208 | A | | 5/1990 | LaMarca | 251/30.04 |
| 4,921,211 | A | | 5/1990 | Novak et al. | 251/129.04 |
| 4,932,430 | A | | 6/1990 | Fernstrom | 137/85 |
| 4,941,215 | A | | 7/1990 | Liu | 4/406 |
| 4,941,219 | A | | 7/1990 | Van Marcke | 4/623 |
| 4,944,487 | A | | 7/1990 | Holtermann | 251/129.17 |
| 4,977,929 | A | | 12/1990 | Chinnock et al. | 137/863 |
| 4,988,074 | A | | 1/1991 | Najmolhoda | 251/129.08 |
| 4,998,673 | A | | 3/1991 | Pilolla | 239/67 |
| 5,025,516 | A | | 6/1991 | Wilson | 4/623 |
| 5,027,850 | A | | 7/1991 | Peterson et al. | 137/245 |
| 5,032,812 | A | | 7/1991 | Banick et al. | 335/17 |
| 5,036,553 | A | | 8/1991 | Sanderson | 4/313 |
| 5,074,520 | A | | 12/1991 | Lee et al. | 251/40 |
| 5,086,526 | A | | 2/1992 | Van Marcke | 4/623 |
| 5,101,639 | A | * | 4/1992 | Wruck et al. | 62/80 |
| 5,109,885 | A | | 5/1992 | Tauscher | 137/596.17 |
| 5,125,621 | A | | 6/1992 | Parsons et al. | 251/30.03 |
| 5,127,625 | A | | 7/1992 | Kleinhappl | 251/129.17 |
| 5,133,987 | A | | 7/1992 | Spence et al. | 427/581 |
| 5,169,118 | A | | 12/1992 | Whiteside | 251/30.03 |
| 5,188,337 | A | | 2/1993 | Mertens et al. | 251/129.17 |
| 5,195,720 | A | | 3/1993 | Nortier et al. | 251/129.04 |
| 5,213,303 | A | | 5/1993 | Walker | 251/30.02 |
| 5,213,305 | A | | 5/1993 | Whiteside et al. | 251/40 |
| 5,224,685 | A | | 7/1993 | Chiang et al. | 251/129.04 |
| 5,232,194 | A | | 8/1993 | Saadi et al. | 251/40 |
| 5,244,179 | A | | 9/1993 | Wilson | 251/30.03 |
| 5,251,188 | A | | 10/1993 | Parsons et al. | 367/140 |
| 5,265,594 | A | | 11/1993 | Olsson et al. | 128/204.18 |
| 5,265,843 | A | | 11/1993 | Kleinhappl | 251/129.17 |
| 5,293,652 | A | * | 3/1994 | Furr | 4/498 |
| 5,295,655 | A | | 3/1994 | Wilson et al. | 251/40 |
| 5,313,673 | A | | 5/1994 | Saadi et al. | 4/313 |
| 5,315,719 | A | | 5/1994 | Tsutsui et al. | 4/300 |
| 5,335,694 | A | | 8/1994 | Whiteside | 137/625.37 |
| 5,375,811 | A | | 12/1994 | Reinicke | 251/129.16 |
| D354,113 | S | | 1/1995 | Wortier et al. | D23/233 |
| D355,478 | S | | 2/1995 | Allen et al. | D23/249 |
| D357,976 | S | | 5/1995 | Allen et al. | D23/249 |
| 5,412,816 | A | | 5/1995 | Paterson et al. | 4/623 |
| 5,431,008 | A | * | 7/1995 | Ross et al. | 60/803 |
| 5,431,181 | A | | 7/1995 | Saadi et al. | 137/15.11 |
| 5,433,245 | A | | 7/1995 | Prather et al. | 137/554 |
| 5,456,279 | A | | 10/1995 | Parsons et al. | 137/245 |
| 5,474,303 | A | | 12/1995 | Coles | 277/317 |
| 5,481,187 | A | | 1/1996 | Marcott et al. | 324/207.16 |
| 5,508,510 | A | | 4/1996 | Laverty et al. | 250/221 |
| 5,548,119 | A | | 8/1996 | Nortier | 4/623 |
| 5,555,912 | A | | 9/1996 | Saadi et al. | 137/801 |
| 5,566,702 | A | | 10/1996 | Philipp | 137/1 |
| 5,574,617 | A | | 11/1996 | Shimanuki et al. | 361/154 |
| 5,583,434 | A | | 12/1996 | Moyers et al. | 324/207.16 |
| 5,584,465 | A | | 12/1996 | Ochsenreiter | 251/65 |
| 5,586,746 | A | | 12/1996 | Humpert et al. | 4/623 |
| 5,600,237 | A | | 2/1997 | Nippert | 324/207.16 |
| 5,603,127 | A | * | 2/1997 | Veal | 4/246.1 |
| 5,636,601 | A | | 6/1997 | Moriya et al. | 123/90.11 |
| 5,647,388 | A | * | 7/1997 | Butler et al. | 137/1 |
| 5,651,384 | A | | 7/1997 | Rudrich | 137/1 |
| 5,668,366 | A | | 9/1997 | Mauerhofer | 250/221 |
| 5,680,879 | A | | 10/1997 | Sheih et al. | 137/240 |
| 5,708,355 | A | | 1/1998 | Schrey | 323/282 |
| 5,709,245 | A | * | 1/1998 | Miller | 137/625.64 |
| 5,716,038 | A | | 2/1998 | Scarffe | 251/30.03 |
| 5,730,165 | A | | 3/1998 | Philipp | 137/1 |
| 5,747,684 | A | | 5/1998 | Pace et al. | 73/119 A |
| 5,749,521 | A | | 5/1998 | Lattery | 239/64 |
| D396,090 | S | | 7/1998 | Marcichow et al. | D23/233 |
| 5,780,854 | A | | 7/1998 | Lin | 250/347 |

| | | | | | |
|---|---|---|---|---|---|
| 5,787,915 | A | | 8/1998 | Byers et al. | 137/1 |
| 5,787,924 | A | | 8/1998 | Cewers et al. | 137/487.5 |
| 5,797,360 | A | | 8/1998 | Pischinger et al. | 123/90.11 |
| 5,804,962 | A | | 9/1998 | Kather et al. | 324/207.16 |
| 5,815,362 | A | | 9/1998 | Kahr et al. | 361/153 |
| 5,819,336 | A | * | 10/1998 | Gilliam et al. | 4/623 |
| 5,829,467 | A | * | 11/1998 | Spicher | 137/14 |
| 5,855,356 | A | | 1/1999 | Fait | 251/129.04 |
| 5,881,993 | A | | 3/1999 | Wilson et al. | 251/40 |
| 5,887,848 | A | | 3/1999 | Wilson | 251/40 |
| 5,901,384 | A | | 5/1999 | Sim | 4/302 |
| 5,905,625 | A | | 5/1999 | Schebitz | 361/154 |
| 5,915,417 | A | * | 6/1999 | Diaz et al. | 251/129.04 |
| 5,918,855 | A | | 7/1999 | Hamanaka et al. | 251/129.04 |
| 5,927,603 | A | | 7/1999 | McNabb | 239/63 |
| 5,941,505 | A | | 8/1999 | Nagel | 251/335.2 |
| 5,943,712 | A | | 8/1999 | Van Marcke | 4/623 |
| 5,950,983 | A | | 9/1999 | Jahrling | 4/313 |
| 5,961,095 | A | * | 10/1999 | Schrott | 251/129.04 |
| 5,964,192 | A | | 10/1999 | Ishii | 123/90.11 |
| 5,966,076 | A | | 10/1999 | Cantrell | 251/262 |
| 5,967,182 | A | | 10/1999 | Wilson | 137/544 |
| 5,979,500 | A | | 11/1999 | Jahrling et al. | 137/624.12 |
| 5,984,262 | A | | 11/1999 | Parsons et al. | 251/129.04 |
| 5,996,965 | A | | 12/1999 | Eichholz et al. | 251/30.05 |
| 6,000,674 | A | | 12/1999 | Cheng | 251/26 |
| 6,003,170 | A | | 12/1999 | Humpert et al. | 4/623 |
| 6,024,059 | A | | 2/2000 | Kamimaru et al. | 123/90.11 |
| 6,044,814 | A | | 4/2000 | Fuwa | 123/90.11 |
| 6,056,261 | A | | 5/2000 | Aparicio et al. | 251/129.03 |
| 6,065,735 | A | | 5/2000 | Clark | 251/292 |
| 6,073,904 | A | | 6/2000 | Diller et al. | 251/30.03 |
| 6,082,407 | A | | 7/2000 | Paterson et al. | 137/801 |
| 6,118,521 | A | * | 9/2000 | Jung et al. | 250/227.16 |
| 6,127,671 | A | | 10/2000 | Parsons et al. | 250/221 |
| 6,155,231 | A | | 12/2000 | Adachi et al. | 123/399 |
| 6,158,715 | A | | 12/2000 | Kirschbaum | 251/129.06 |
| 6,161,726 | A | | 12/2000 | Parsons et al. | 222/52 |
| 6,182,689 | B1 | | 2/2001 | Lauer et al. | 137/ 550 |
| 6,202,980 | B1 | * | 3/2001 | Vincent et al. | 251/129.04 |
| 6,212,697 | B1 | | 4/2001 | Parsons et al. | 4/ 302 |
| 6,239,423 | B1 | * | 5/2001 | Hama et al. | 250/221 |
| 6,250,601 | B1 | * | 6/2001 | Kolar et al. | 251/129.04 |
| 6,305,602 | B1 | * | 10/2001 | Grabowski et al. | 235/379 |
| 6,639,517 | B1 | | 10/2003 | Chapman et al. | 340/605 |
| 6,913,203 | B2 | | 7/2005 | DeLangis | 236/12.12 |
| 7,069,941 | B2 | | 7/2006 | Parsons et al. | 137/1 |
| 7,396,000 | B2 | | 7/2008 | Parsons et al. | 251/129.04 |
| 7,690,623 | B2 | | 4/2010 | Parsons et al. | 251/129.04 |
| 7,731,154 | B2 | | 6/2010 | Parsons et al. | 251/129.04 |
| 2003/0122059 | A1 | * | 7/2003 | Su et al. | 250/214 B |
| 2004/0025248 | A1 | * | 2/2004 | Lang et al. | 4/623 |
| 2005/0076425 | A1 | * | 4/2005 | Contadini | 4/405 |
| 2005/0133754 | A1 | | 6/2005 | Parsons et al. | 251/129.17 |
| 2006/0006354 | A1 | | 1/2006 | Parsons et al. | 251/129.04 |
| 2007/0034258 | A1 | | 2/2007 | Parsons et al. | 137/269 |

FOREIGN PATENT DOCUMENTS

| | | |
|---|---|---|
| DE | 10054863 | 5/2002 |
| EP | 0337367 | 10/1989 |
| GB | 1314632 | 4/1973 |
| WO | WO85/05648 | 12/1985 |
| WO | WO 03/087641 | 10/2003 |

OTHER PUBLICATIONS

International Search Report issued in PCT Application PCT/US 03/38730 on May 12, 2004 (6 pages).

International Search Report issued in PCT Application PCT/US 03/20117 on Dec. 18, 2003.

International Preliminary Report on Patentability issued in PCT Application PCT/US 04/040887 on Apr. 10, 2006 (11 pages).

International Search Report issued in PCT Application PCT/US 04/040887 on May 25, 2005 (6 pages).

* cited by examiner

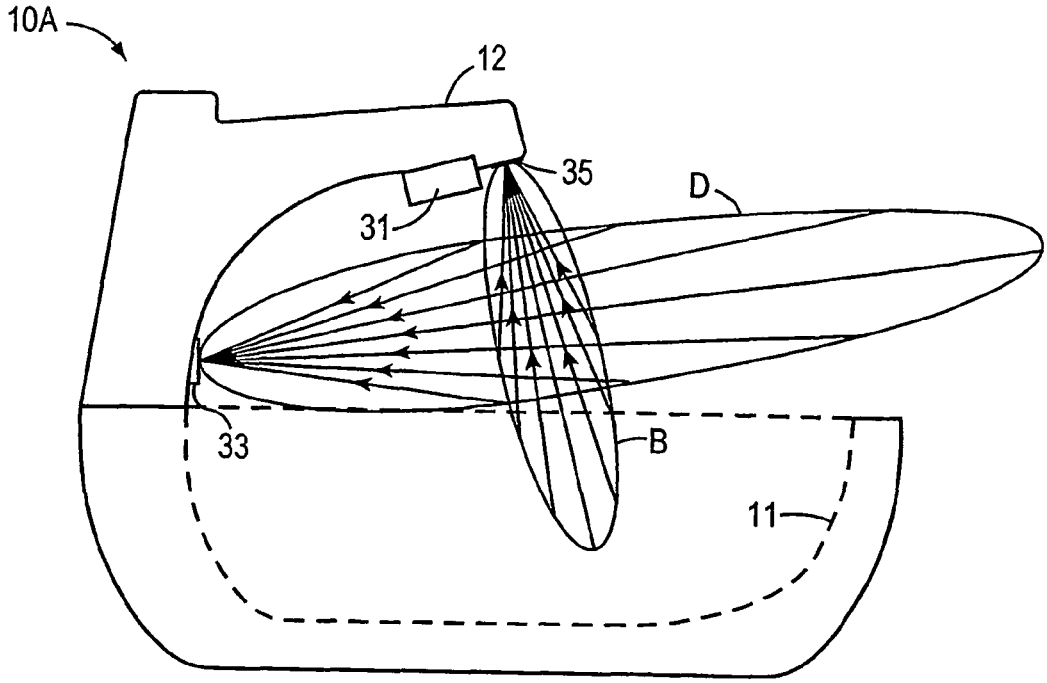
FIG. 3F-I
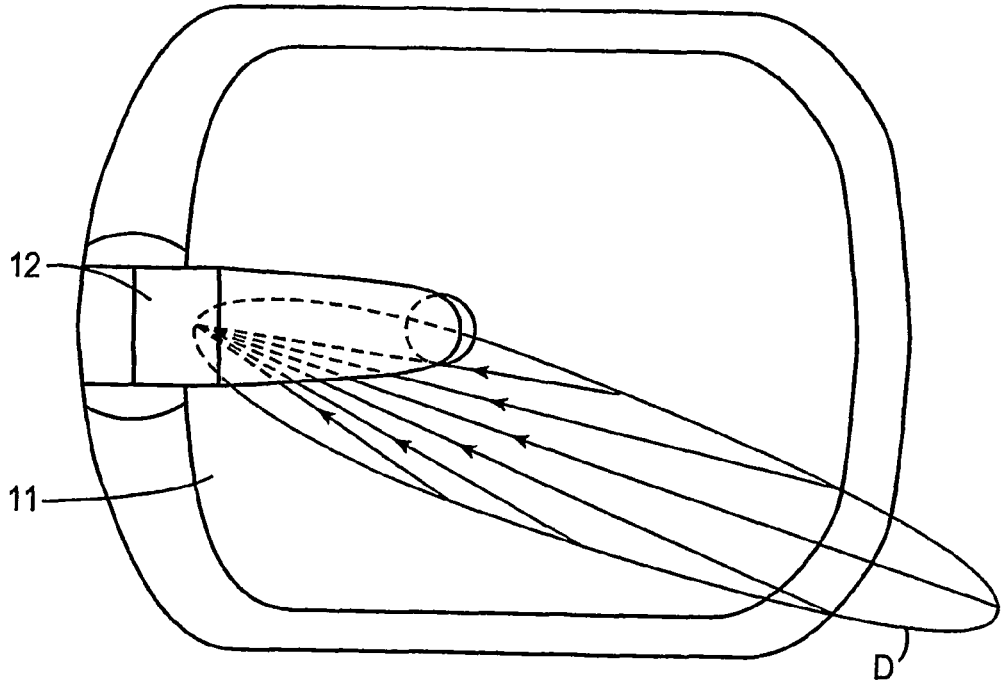
FIG. 3F-II

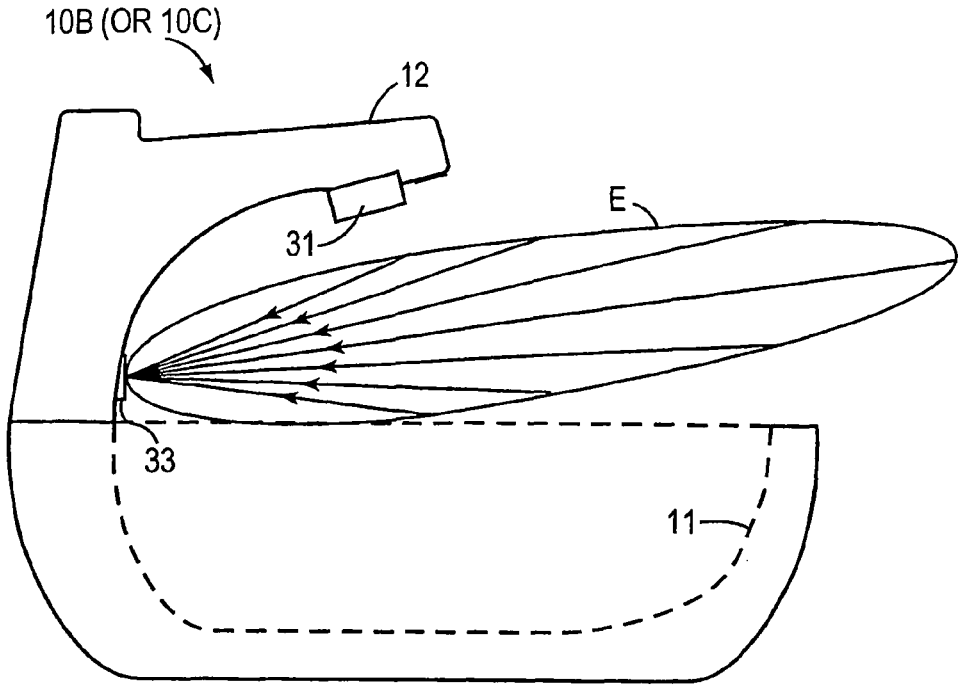
FIG. 3G-I
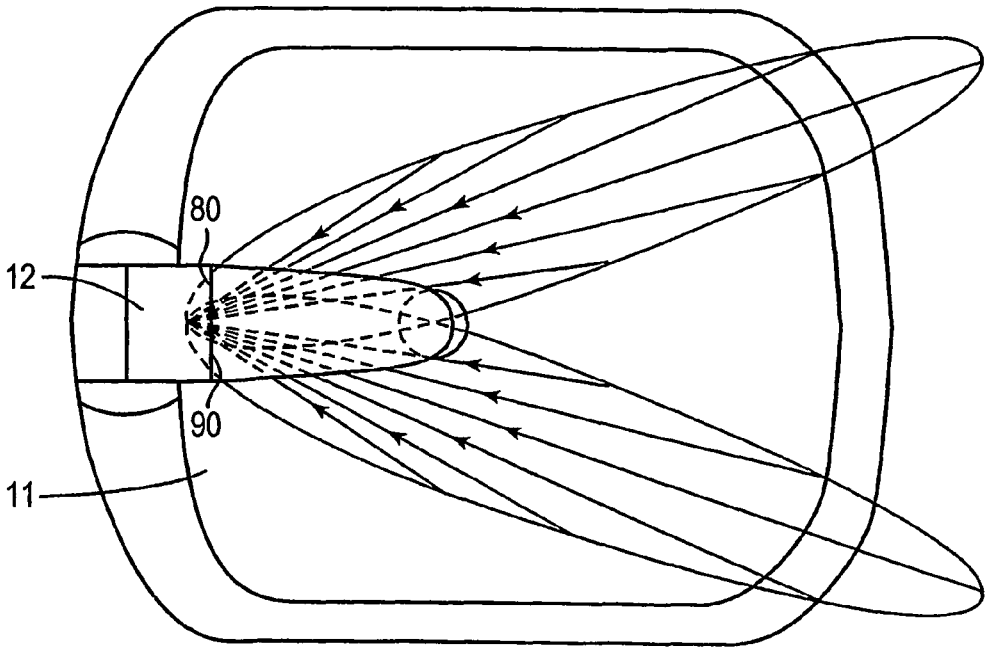
FIG. 3G-II

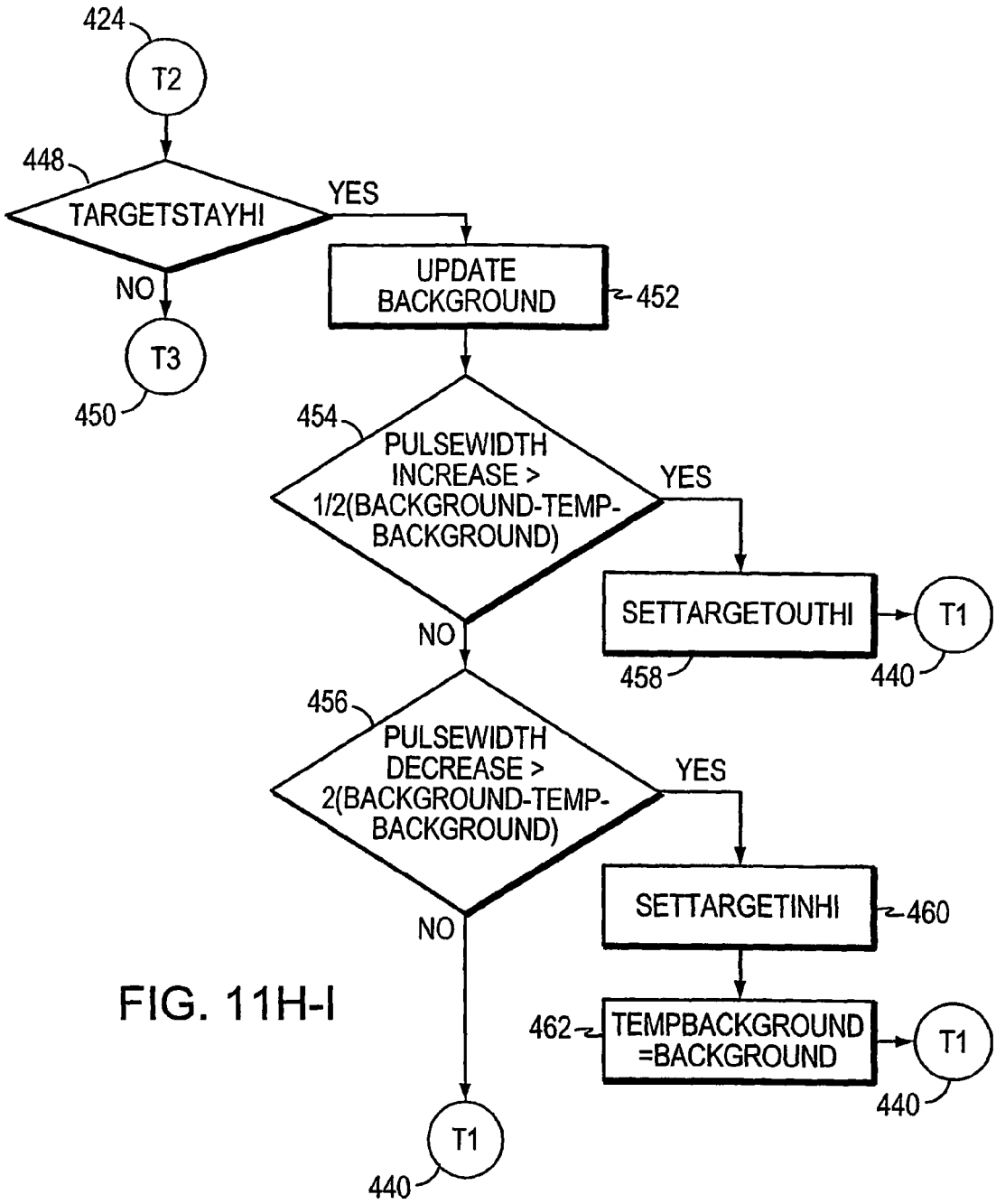
FIG. 11H-I

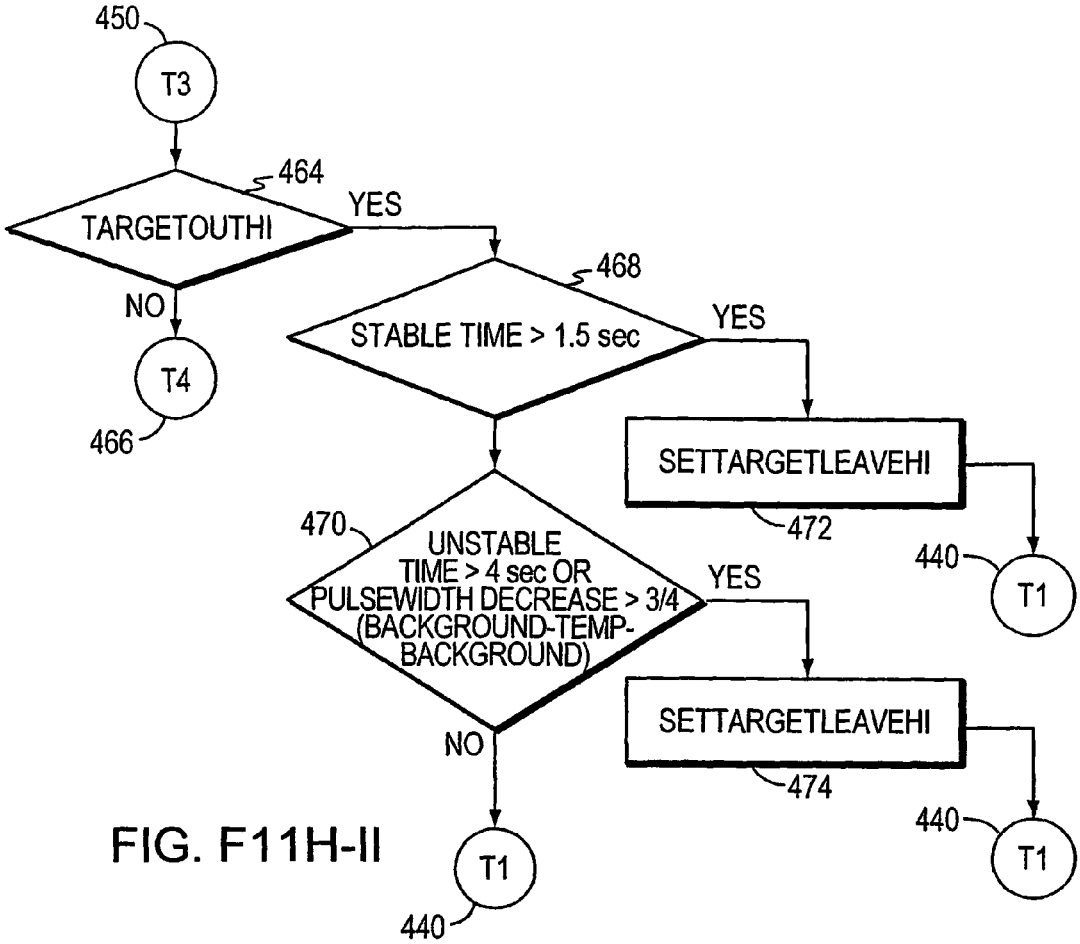
FIG. F11H-II

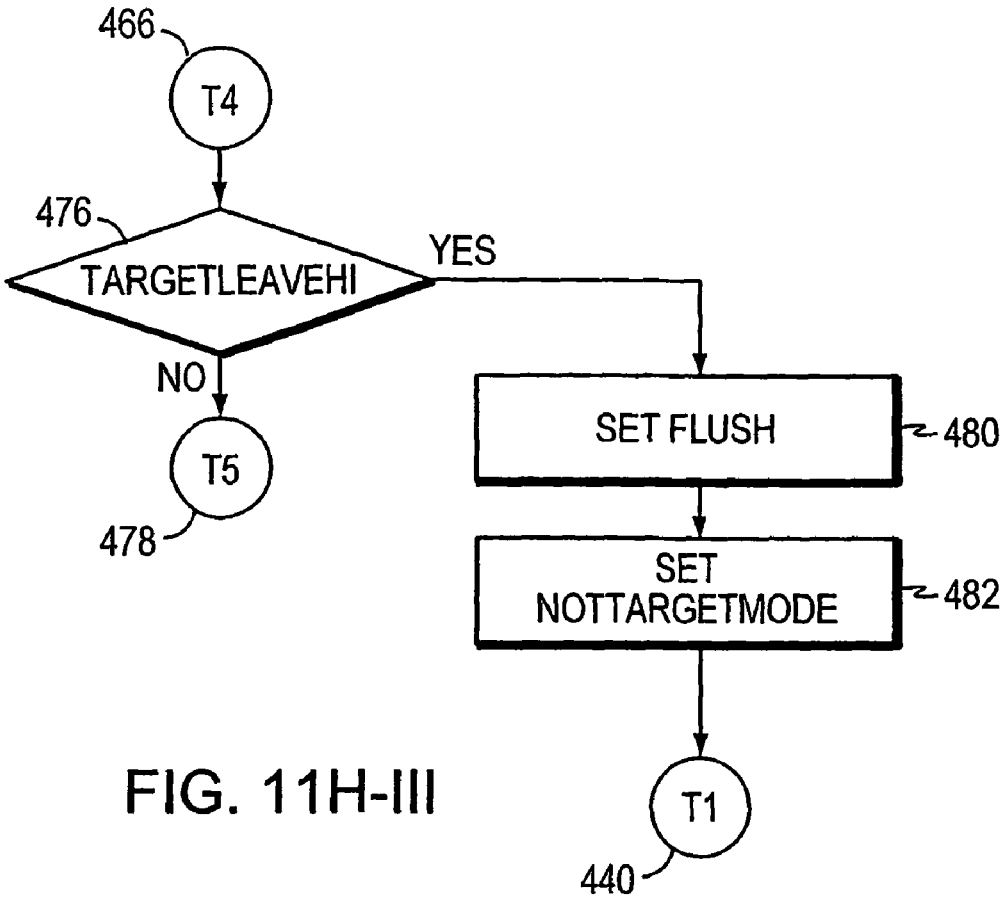
FIG. 11H-III

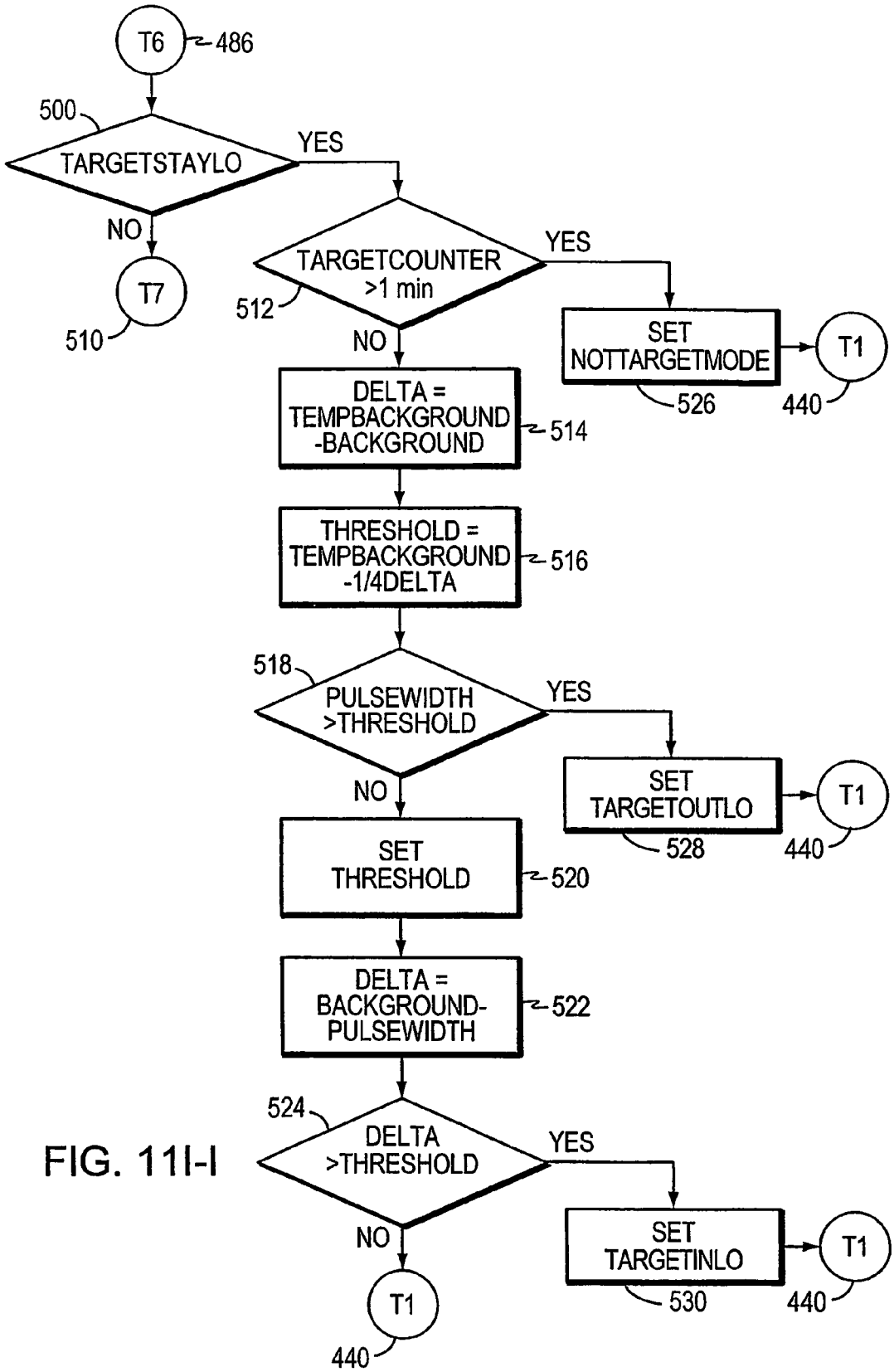
FIG. 11I-I

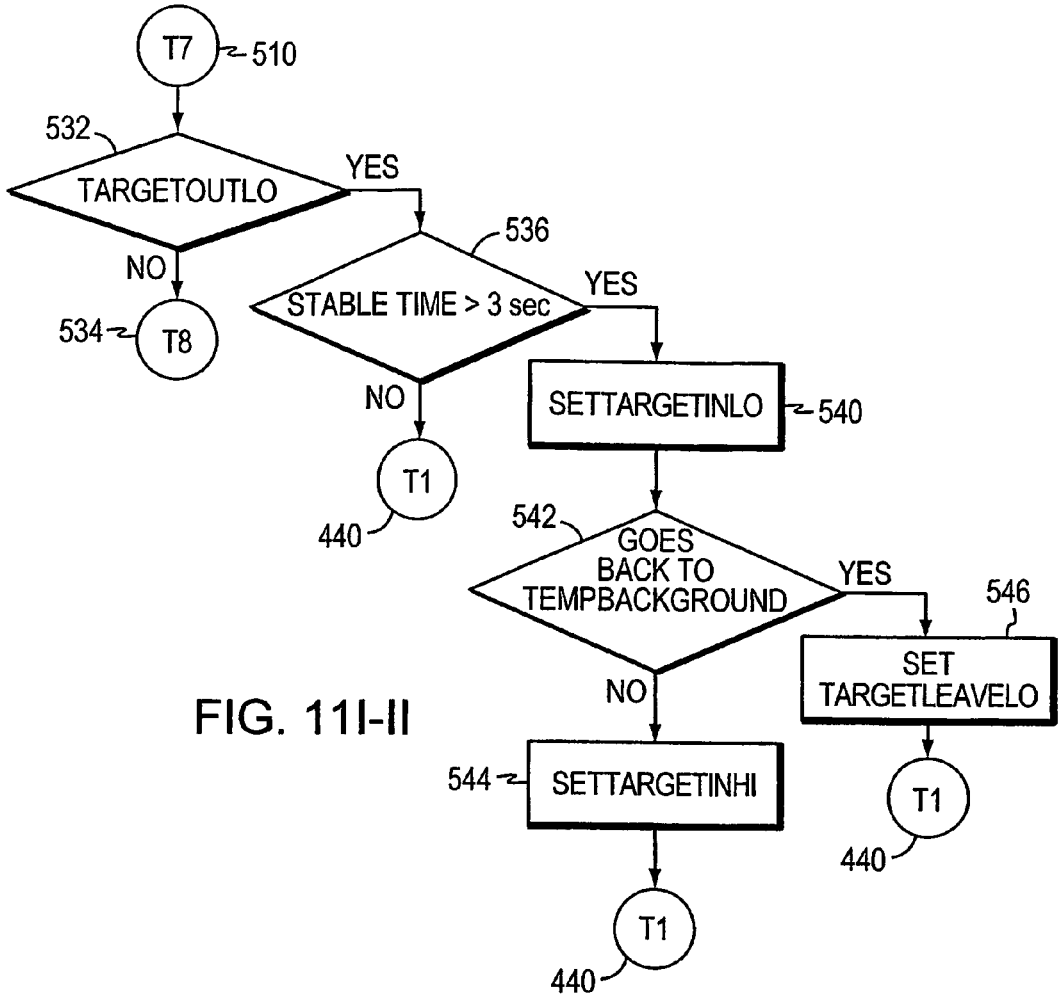
FIG. 11I-II

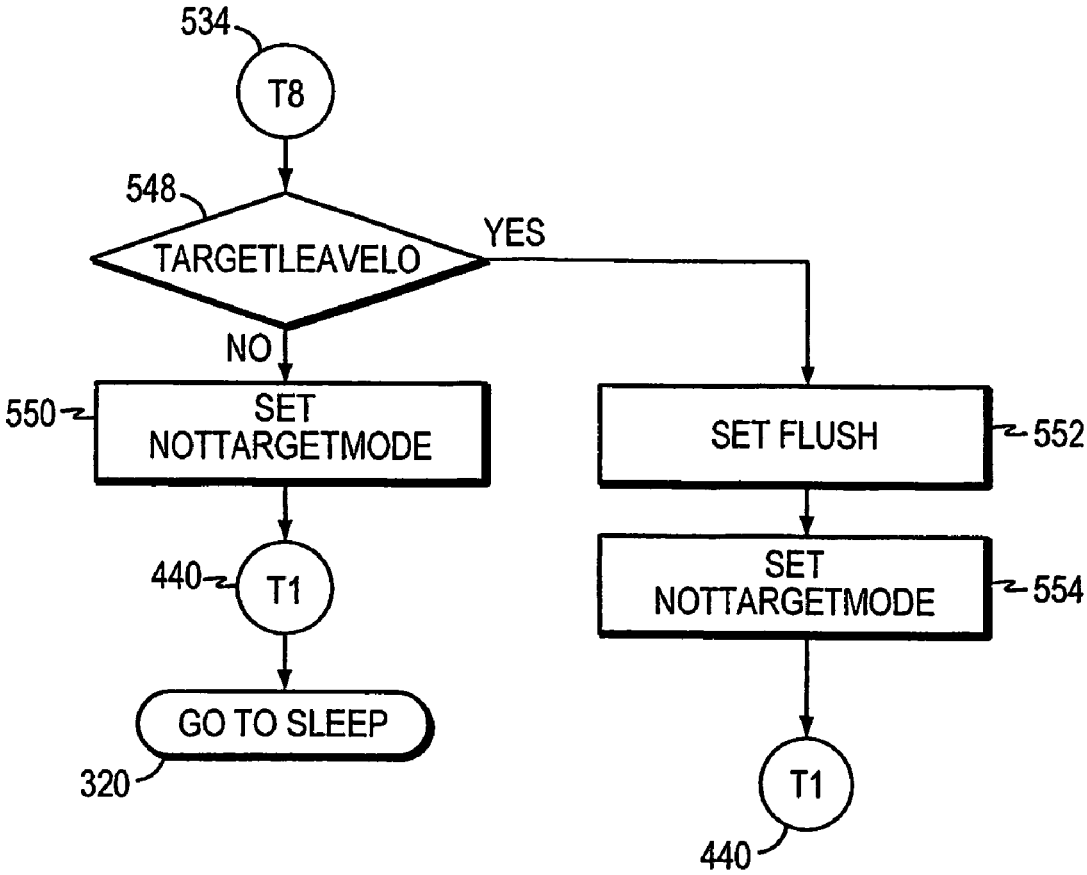
FIG. 11I-III

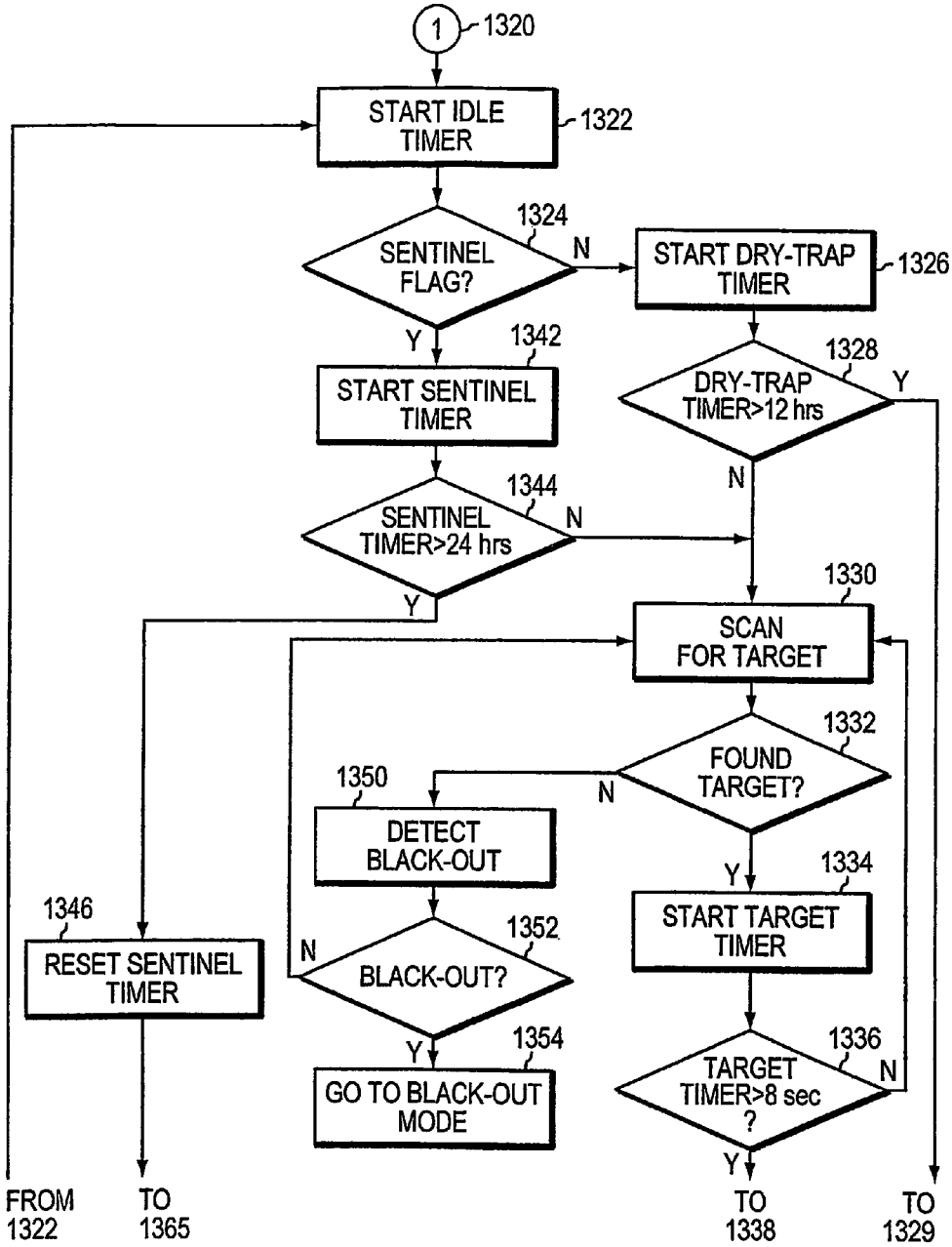
FIG. 14A-I

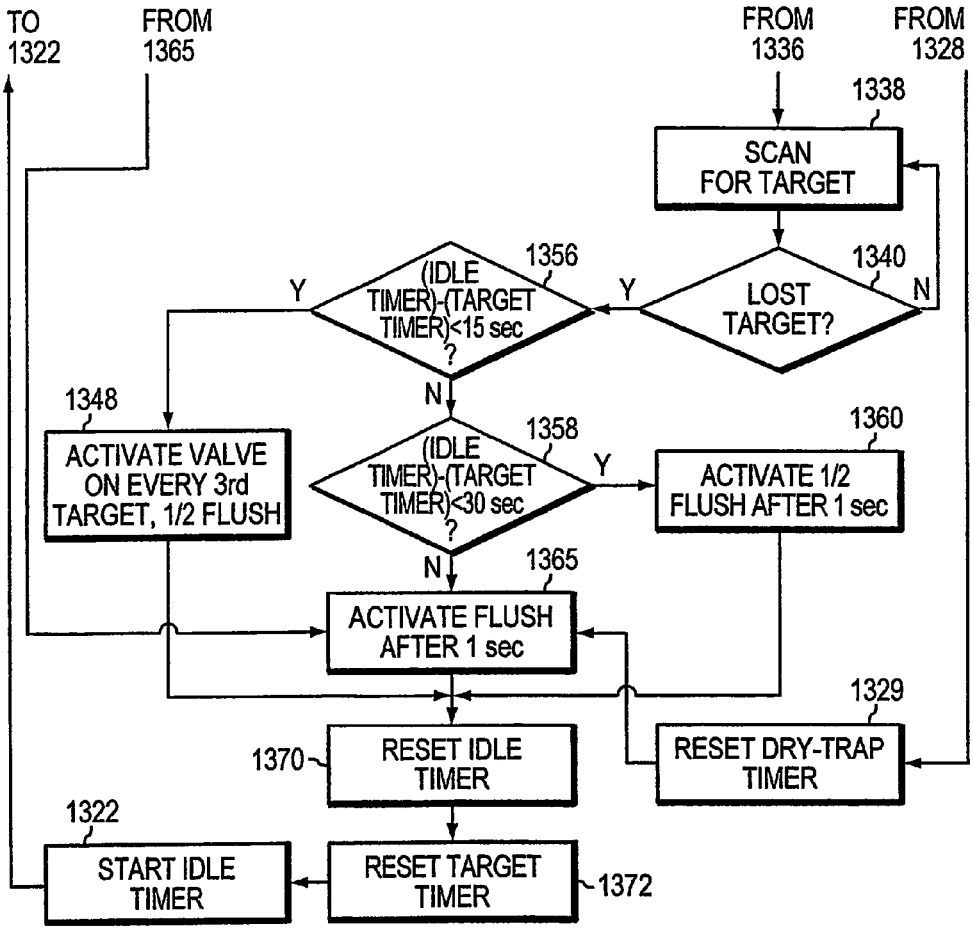
FIG. 14A-II

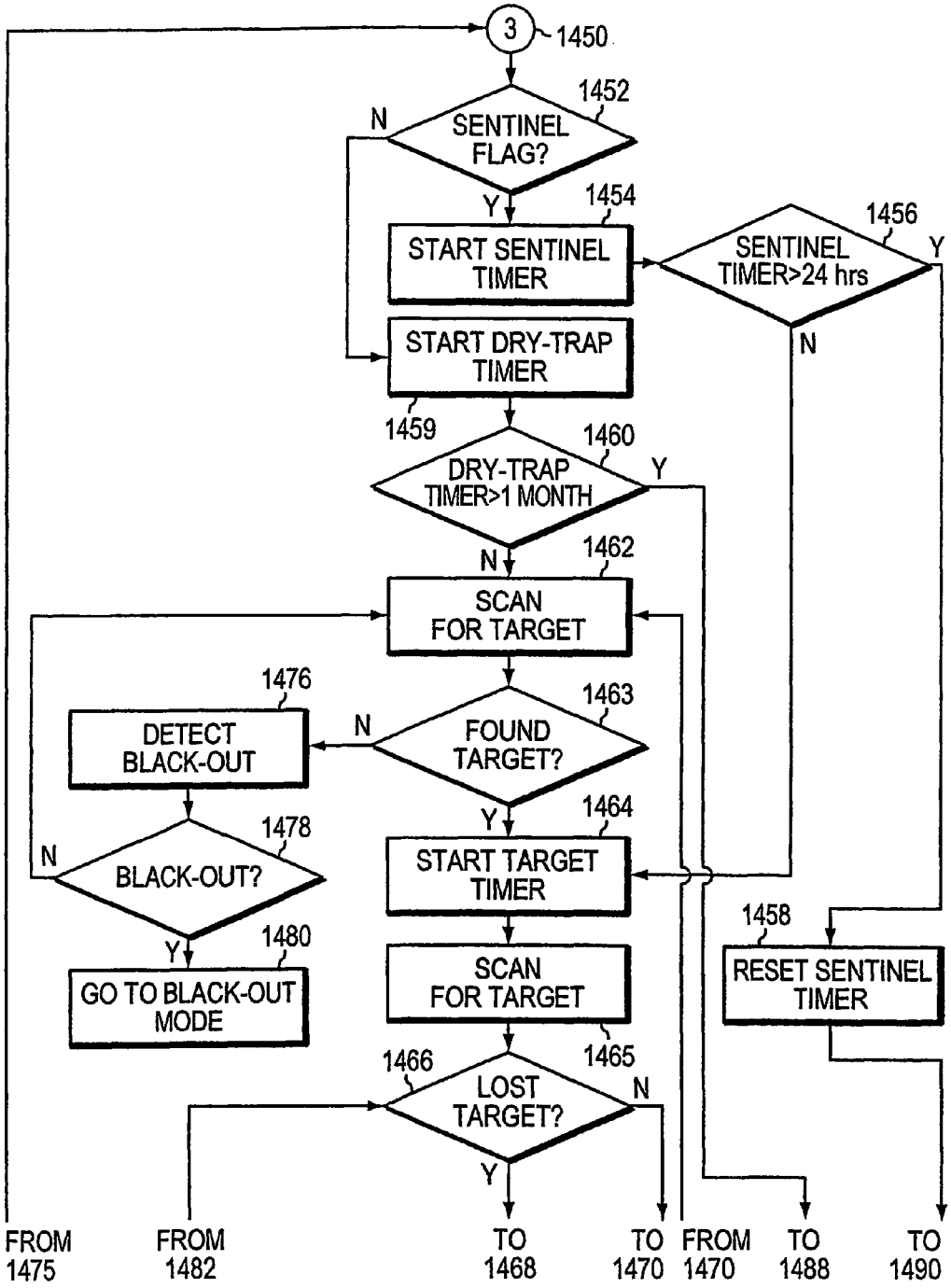
FIG. 14C-I

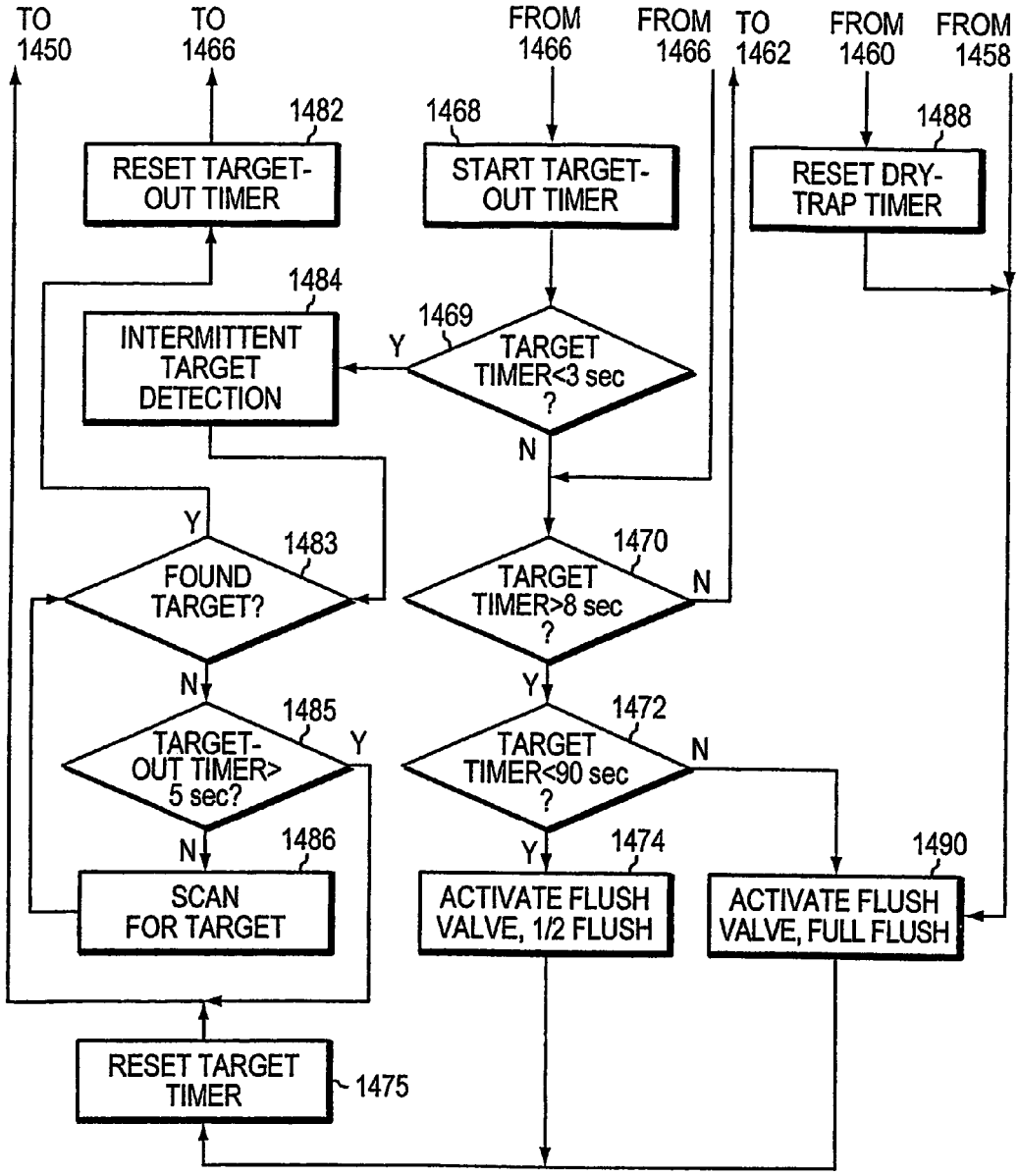
FIG. 14C-II

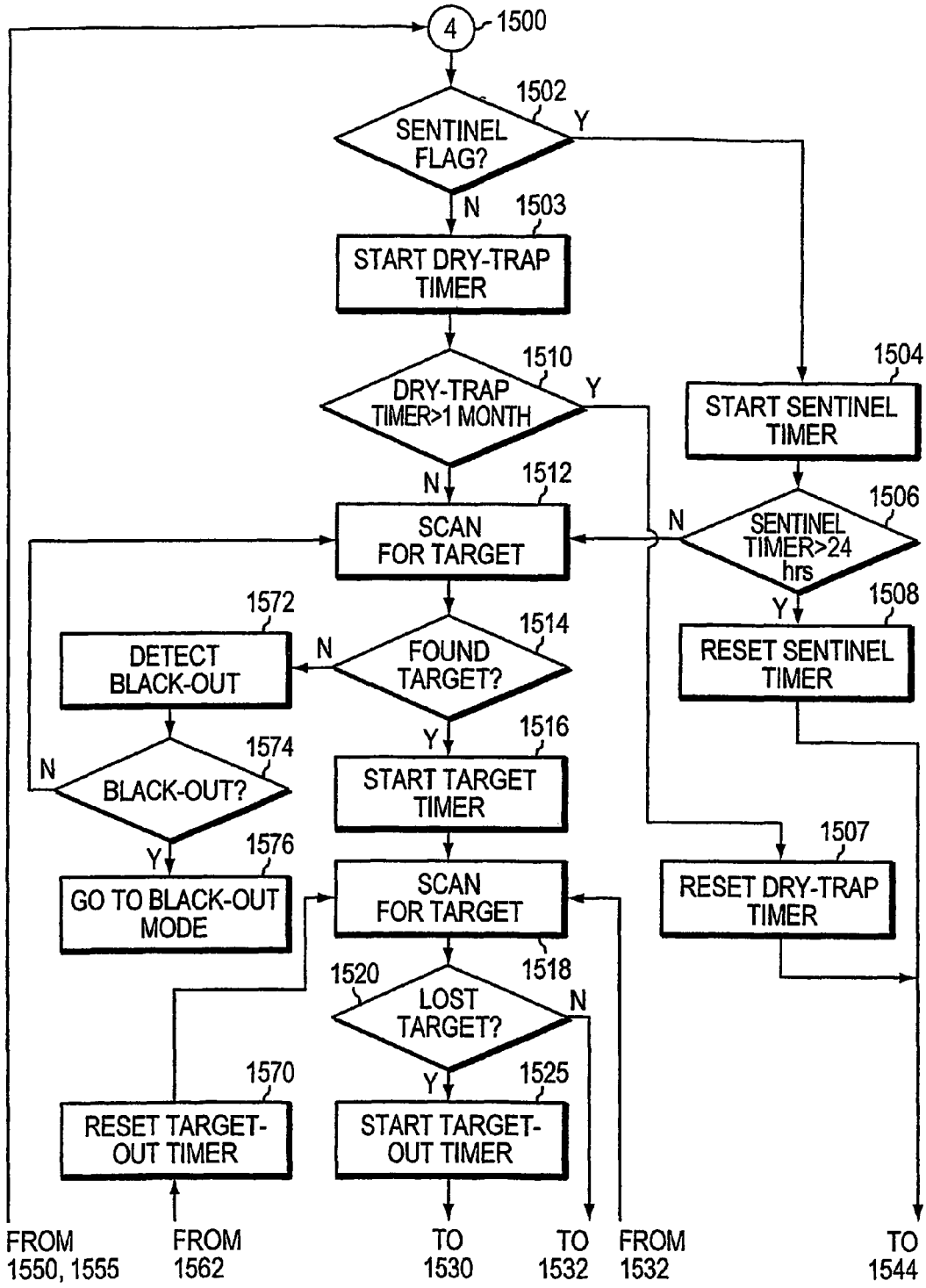
FIG. 14D-I

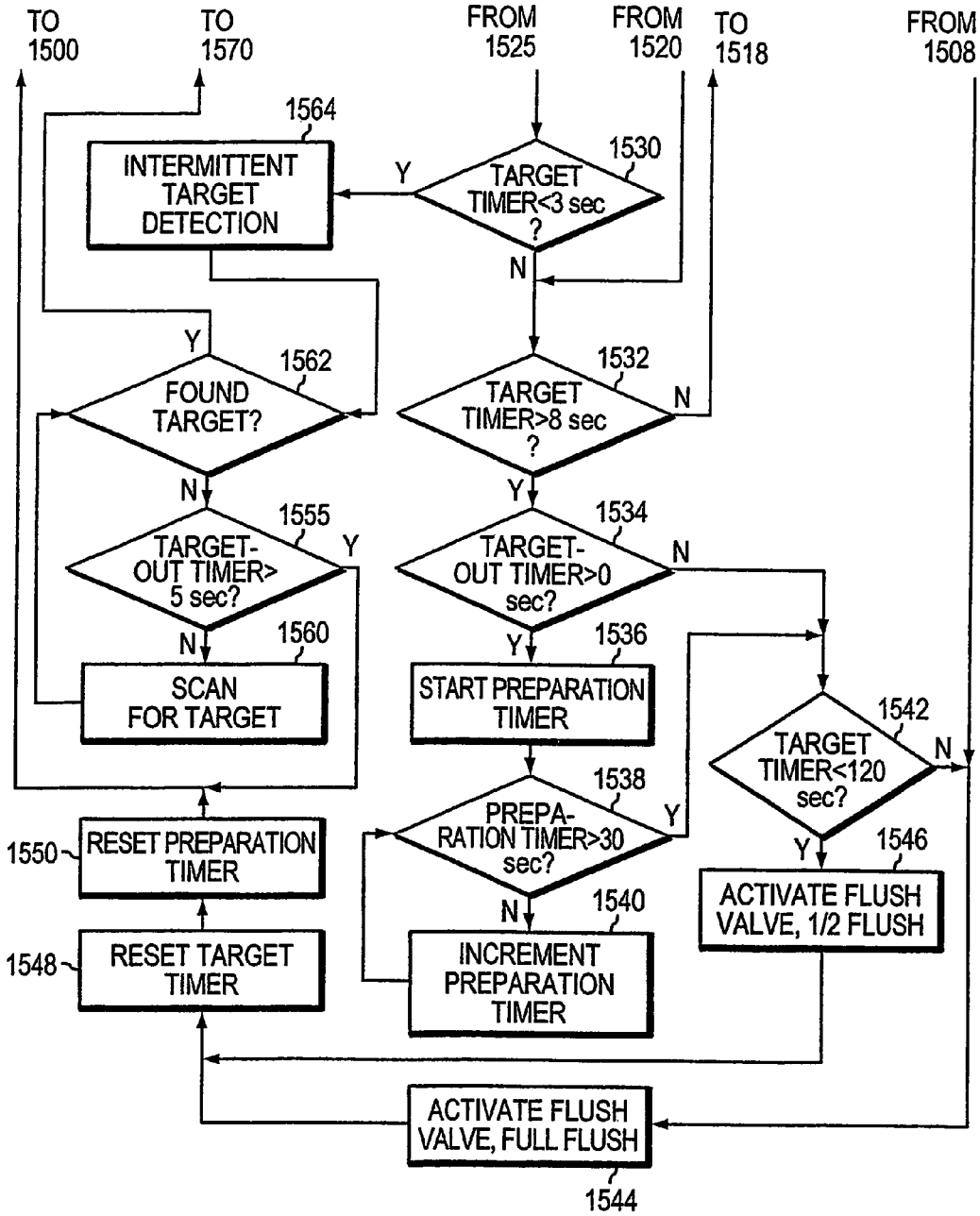
FIG. 14D-II

PASSIVE SENSORS AND CONTROL ALGORITHMS FOR FAUCETS AND BATHROOM FLUSHERS

This application is a continuation of PCT Application PCT/US04/040887, filed on Dec. 6, 2004, which is a continuation-in-part of PCT Application No. PCT/US03/38730, entitled "Passive Sensors for Automatic Faucets and Bathroom Flushers," filed on Dec. 4, 2003; and which is a continuation-in-part of PCT Application No. PCT/US03/41303, entitled "Optical Sensors and Algorithms for Controlling Bathroom Flushers and Faucets," filed on Dec. 26, 2003. The PCT/US04/040887 is also a continuation-in-part of U.S. application Ser. No. 10/860,938, entitled "Electronic Faucets for Long Term Operation," filed on Jun. 3, 2004, which is a continuation of PCT Application Ser. No. PCT/US02/38757, entitled "Electronic Faucets for Long Term Operation," filed on Dec. 4, 2002, and which is a continuation-in-part of U.S. application Ser. No. 10/859,750, entitled "Automatic Bathroom Flushers" filed on Jun. 3, 2004, now U.S. Pat. No. 7,437,778 which is a continuation of PCT Application Ser. No. PCT/US02/38758, entitled "Automatic Bathroom Flushers" filed on Dec. 4, 2002; wherein all of the above-mentioned applications are incorporated by reference. This application is also a continuation-in-part of U.S. application Ser. No. 11/098,574, filed on Apr. 4, 2005, now abandoned which is a continuation of U.S. application Ser. No. 10/440,997, filed on May 19, 2003, now U.S. Pat. No. 6,874,535, which is a continuation PCT Application PCT/US01/43277, filed on Nov. 20, 2001.

The present invention is directed to novel optical sensors. The present invention is, more specifically, directed to novel optical sensors for controlling operation of automatic faucets and bathroom flushers, and in particular, to novel flow control sensors for providing control signals to electronics used in such faucets and flushers.

BACKGROUND OF THE INVENTION

Automatic faucets and bathroom flushers have been used for many years. An automatic faucet typically includes an optical or other sensor that detects the presence of an object, and an automatic valve that turns water on and off, based on a signal from the sensor. An automatic faucet may include a mixing valve connected to a source of hot and cold water for providing a proper mixing ratio of the delivered hot and cold water after water actuation. The use of automatic faucets conserves water and promotes hand washing, and thus good hygiene. Similarly, automatic bathroom flushers include a sensor and a flush valve connected to a source of water for flushing a toilet or urinal after actuation. The use of automatic bathroom flushers generally improves cleanliness in public facilities.

In an automatic faucet, an optical or other sensor provides a control signal and a controller that, upon detection of an object located within a target region, provides a signal to open water flow. In an automatic bathroom flusher, an optical or other sensor provides a control signal to a controller after a user leaves the target region. Such systems work best if the object sensor is reasonably discriminating. An automatic faucet should respond to a user's hands, for instance, it should not respond to the sink at which the faucet is mounted, or to a paper towel thrown in the sink. Among the ways of making the system discriminate between the two it has been known to limit the target region in such a manner as to exclude the sink's location. However, a coat or another object can still provide a false trigger to the faucet. Similarly, this could happen to automatic flushers due to a movement of bathroom doors, or something similar.

An optical sensor includes a light source (usually an infrared emitter) and a light detector sensitive to the IR wavelength of the light source. For faucets, the emitter and the detector (i.e., a receiver) can be mounted on the faucet spout near its outlet, or near the base of the spout. For flushers, the emitter and the detector may be mounted on the flusher body or on a bathroom wall. Alternatively, only optical lenses (instead of the emitter and the receiver) can be mounted on these elements. The lenses are coupled to one or several optical fibers for delivering light from the light source and to the light detector. The optical fiber delivers light to and from the emitter and the receiver mounted below the faucet.

In the optical sensor, the emitter power and/or the receiver sensitivity is limited to restrict the sensor's range to eliminate reflections from the sink, or from the bathroom walls or other installed objects. Specifically, the emitting beam should project on a valid target, normally clothing, or skin of human hands, and then a reflected beam is detected by the receiver. This kind of sensor relies on the reflectivity of a target's surface, and its emitting/receiving capabilities. Frequently, problems arise due to highly reflective doors and walls, mirrors, highly reflective sinks, the shape of different sinks, water in the sink, the colors and rough/shiny surfaces of fabrics, and moving users who are walking by but not using the facility. Mirrors, doors, walls, and sinks are not valid targets, although they may reflect more energy back to the receiver than rough surfaces at a right angle incidence. The reflection of valid targets such as various fabrics varies with their colors and the surface finish. Some kinds of fabrics absorb and scatter too much energy of the incident beam, so that less of a reflection is sent back to the receiver.

A large number of optical or other sensors are powered by a battery. Depending on the design, the emitter (or the receiver) may consume a large amount of power and thus deplete the battery over time (or require large batteries). The cost of battery replacement involves not only the cost of batteries, but more importantly the labor cost, which may be relatively high for skilled personnel.

There is still a need for an optical sensor for use with automatic faucets or automatic bathroom flushers that can operate for a long period of time without replacing the standard batteries. There is still a need for reliable sensors for use with automatic faucets or automatic bathroom flushers.

SUMMARY OF THE INVENTION

The present invention is directed to novel optical sensors and novel methods for sensing optical radiation. The novel optical sensors and the novel optical sensing methods are used, for example, for controlling the operation of automatic faucets and flushers. The novel sensors and flow controllers (including control electronics and valves) require only small amounts of electrical power for sensing users of bathroom facilities, and thus enable battery operation for many years. A passive optical sensor includes a light detector sensitive to ambient (room) light for controlling the operation of automatic faucets or automatic bathroom flushers.

According to one aspect, an optical sensor for controlling a valve of an electronic faucet or bathroom flusher includes an optical element located at an optical input port and arranged to partially define a detection field. The optical sensor also includes a light detector and a control circuit. The light detector is optically coupled to the optical element and the input port, wherein the light detector is constructed to detect ambient light. The control circuit is constructed for controlling opening and closing of a flow valve. The control circuit is also constructed to receive signal from the light detector corresponding to the detected light.

According to another aspect, a system for controlling a valve of an electronic faucet or bathroom flusher includes a first light detector, a second light detector, and a control circuit. The first light detector is optically coupled to a first input port and is constructed to detect ambient light arriving to the first detector from a first field of view (i.e., a first detection field). The second light detector is optically coupled to a second input port and constructed to detect ambient light arriving to the second detector from a second field of view (i.e., a second detection field). The control circuit controls opening and closing of a flow valve, wherein the control circuit is constructed to receive first data from the first light detector, corresponding to the detected ambient light from the first field of view, and to receive second data from the second light detector, corresponding to the detected ambient light from the second field of view. The control circuit is constructed to determine each the opening and closing of the flow valve based on a background level of the ambient light and a light level caused by a user.

Preferred embodiments of this aspect include one or more of the following:

The control circuit is further constructed to control the opening and closing by executing a detection algorithm employing detection of increase and decrease of the ambient light due to the presence of a user within at least one of the fields of view.

The detection algorithm processes detection of the increase of ambient light in the fields of view due to the presence of the user. The detection algorithm processes detection of the decrease of ambient light in the fields of view due to the presence of the user. The detection algorithm processes detection of the increase of ambient light in one of the fields of view and detection of the decrease of ambient light in the other of the fields of view due to the presence of the user.

The system further includes an optical element located at one of the input ports associated with one of the light detectors, wherein the optical element is arranged to partially define the field of view of the light detector. The system may include two optical elements located at the input ports associated with the light detectors, wherein the optical elements are arranged to partially define the field of view of the light detector. The optical element may include an optical fiber, a lens, a pinhole, a slit or a mirror.

According to this aspect, the system may control the flow valve included in an electronic faucet. Alternatively, the system may control the flow valve included in a bathroom flusher system.

The light detector may include a photodiode or a photoresistor. The optical element and the optical input port are constructed so that the light detector receives light in the range of 1 lux to 1000 lux.

According to yet another aspect, a system for controlling a valve of an electronic faucet or bathroom flusher includes a light detector and a control circuit. The light detector is optically coupled to an input port and is constructed to detect ambient light arriving to the detector from a field of view. The control circuit controls opening and closing of a flow valve, wherein the control circuit is constructed to receive signal from the light detector corresponding to the detected ambient light and to determine each the opening and closing of the flow valve based on detected levels of the ambient light measured over several time intervals. The control circuit is further constructed to control the opening and closing by executing a detection algorithm employing detection of increase and decrease of the ambient light due to the presence of a user within the field of view.

Preferred embodiments of this aspect include one or more of the following: The detection algorithm includes determining a transition from background data to target data. The determination is performed by differentiating optical data received from the light detector. The determination is performed using a stochastic algorithm on optical data from the light detector. The stochastic algorithm includes Kalman filter. Alternatively, the determination is performed using a predictive algorithm on optical data received from the light detector. The predictive algorithm includes Jacobi algorithm.

The control circuit is constructed to sample periodically the detector based on the amount of previously detected light. The control circuit is constructed to determine the opening and closing of the flow valve based on a background level of the ambient light and a present level of the ambient light, along with the stability of any light changes detected. The control circuit uses the changes in ambient light to detect arrival of a user and departure of the user, and the presence of a user based on the stability of the change. These parameters cause opening and closing of the valve. The passive optical sensor uses only a light detector that measures the increase or decrease or stability over short times, of primarily ambient light. The sensor's algorithm may execute several states described below. These are entered, for example, when the target is moving in; after the basically stationary target reached the sensor; and upon the departure of the target. From each of these states, the algorithm can enter the idle or a reset state if an error causes the prior state. Alternatively, the control circuit is constructed to open and close the flow valve based on detecting presence of a user, which it does similarly.

According to yet another aspect, an optical sensor for an electronic faucet includes an optical input port, an optical detector, and a control circuit. The optical input port is arranged to receive light. The optical detector is optically coupled to the input port and constructed to detect the received light. The control circuit controls opening and closing of a faucet valve, or a bathroom flusher valve.

Preferred embodiments of this aspect include one or more of the following features: The control circuit is constructed to sample periodically the detector based on the amount of light detected. The control circuit is constructed to adjust a sample period based on the detected amount of light after determining whether a facility is in use. The detector is optically coupled to the input port using an optical fiber. The input port may be located in an aerator of the electronic faucet. The system includes batteries for powering the electronic faucet.

BRIEF DESCRIPTION OF THE DRAWINGS

FIGS. 3, 3A, 3B, 3C and 3D, 3E, 3F-I, 3F-II, 3G-I, and 3G-II show schematically a faucet and a sink relative to different optical detection patterns used by passive optical sensors employed in the automatic faucet systems of FIGS. 1, 1B, 2, 2A, 2B and 2C.

FIGS. 14, 14A-I, 14A-II, 14B, 14C-I, 14C-II, 14D-I and 14D-II illustrate a flow diagram of an algorithm for processing optical data detected by a passive sensor operating an automatic flusher system for delivering water amounts depending on actual use.

DETAILED DESCRIPTION OF ILLUSTRATIVE EMBODIMENTS

Figure 1:
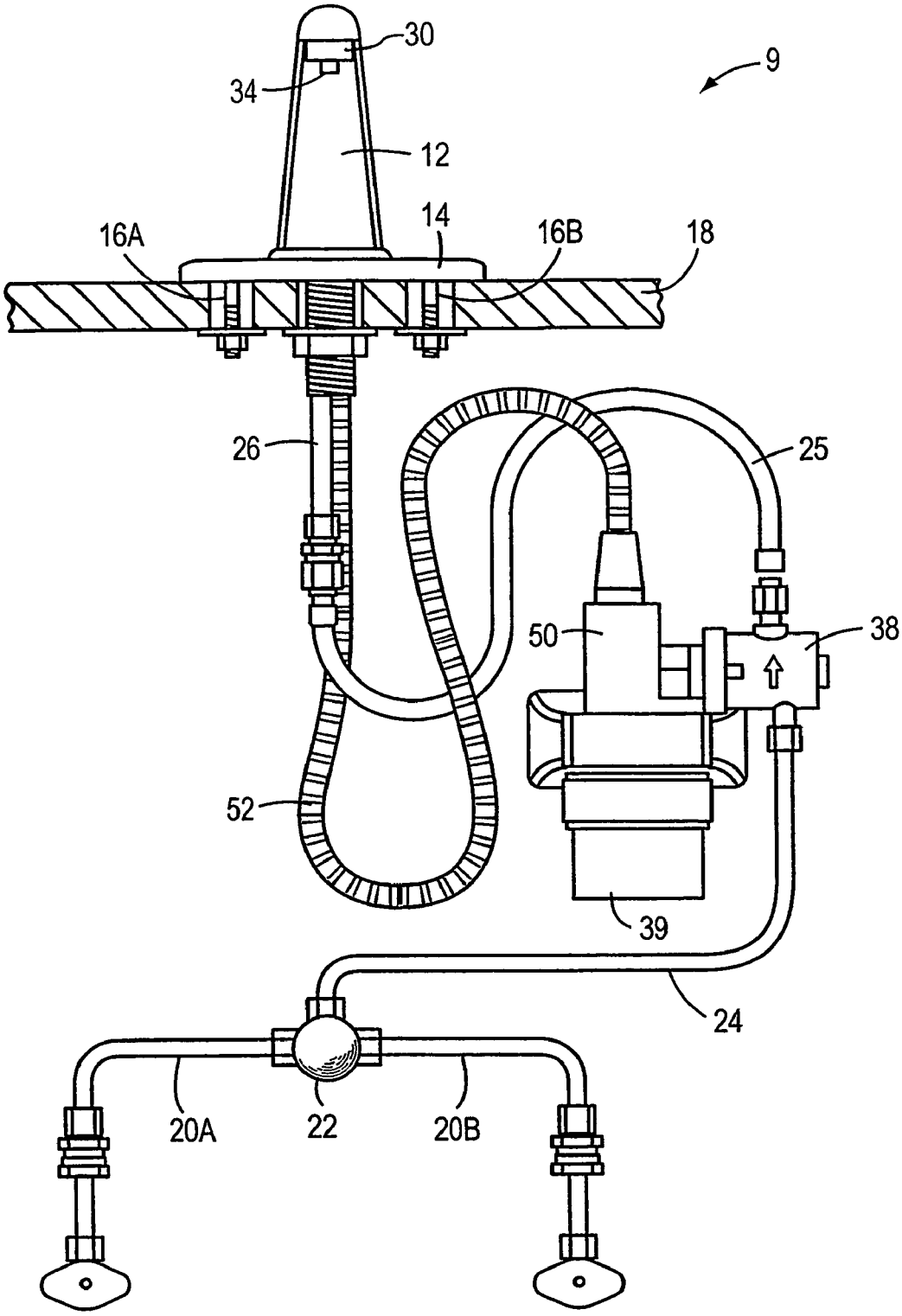
FIG. 1 is a schematic view of an automatic faucet system including a control circuit, a valve and a passive optical sensor for controlling water flow.

FIG. 1 shows an automatic faucet system 9 controlled by a sensor providing signals to a control circuit constructed and arranged to control operation of an automatic valve. The automatic valve, in turn, controls the flow of hot and cold water before or after mixing.

Automatic faucet system 9 includes a faucet body 12 and an aerator 30, including a sensor port 34. Automatic faucet system 9 also includes a faucet base 14 and screws 16A and 16B for attaching the faucet to a deck 18. A cold water pipe 20A and a hot water pipe 20B are connected to a mixing valve 22 providing a mixing ratio of hot and cold water (which ratio can be changed depending on the desired water temperature). Water conduit 24 connects mixing valve 22 to a solenoid valve 38. A flow control valve 38 controls water flow between water conduit 24 and a water conduit 25. Water conduit 25 connects valve 38 to a water conduit 26 partially located inside faucet body 12, as shown. Water conduit 26 delivers water to aerator 30. Automatic faucet system 8 also includes a control module 50 for controlling a faucet sensor and solenoid valve 38, powered by batteries located in battery compartment 39.

Referring to FIG. 1, in a first preferred embodiment, automatic faucet system 9 includes an optical sensor located in control module 50 and optically coupled by a fiberoptic cable 52 to sensor port 34 located in aerator 30. Sensor port 34 receives the distal end of fiberoptic cable 52, which may be coupled to an optical lens located at sensor port 34. The optical lens is arranged to have a selected field of view, which is preferably somewhat coaxial within the water stream discharged from aerator 30, when the faucet is turned on.

Alternatively, the distal end of fiberoptic cable 52 is polished and oriented to emit or to receive light directly (i.e., without the optical lens). Again, the distal end of fiberoptic cable 52 is arranged to have the field of view (for example, field of view A) directed toward sink 11, somewhat coaxial within the water stream discharged from aerator 30. Alternatively, sensor port 34 includes other optical elements, such as an array of pinholes or an array of slits having a selected size, geometry and orientation. The size, geometry and orientation of the array of pinholes or the array of slits is designed to provide a selected detection pattern (shown in FIGS. 3-3D, for a faucet and FIGS. 5-5L, for a flusher).

Referring still to FIG. 1, a fiberoptic cable 52 is preferably located inside water conduit 26 in contact with water. Alternatively, fiberoptic cable 52 could be located outside of the water conduit 26, but inside of faucet body 12. There are alternative ways to provide sensor port 34 inside aerator 30 and alternative ways to arrange an optical fiber 52 coupled to an optical lens 54. In other embodiments, optical lens 54 may be replaced by an array of pinholes or an array of slits. Fiberoptic cable 52 may be replaced by an electric connection to a photosensor located inside aerator 30. Detailed design is described in PCT Application PCT/US03/38730, which is incorporated by reference.

Figure 1A:
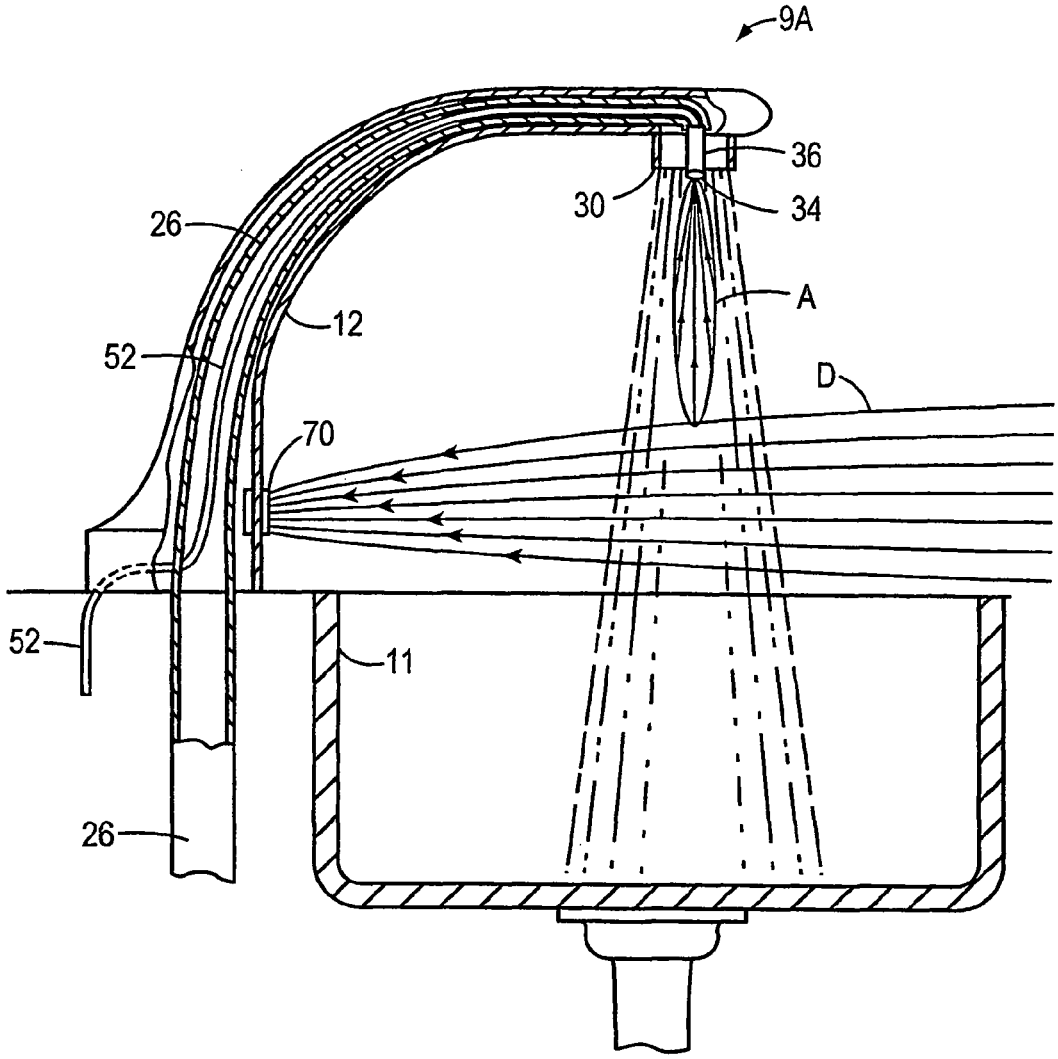
FIG. 1A is a cross-sectional view of a spout and a sink of an automatic faucet system with multiple passive optical sensors.

FIG. 1A illustrates a second preferred embodiment of the automatic faucet system. Automatic faucet system 9A includes faucet body 12 and an aerator 30 including passive sensor 36 coupled to a sensor port 35. Faucet body 12 also includes a second passive sensor 70. Both passive sensors may be located behind a sensor port that receives an optical lens, or an array of slits or pins for defining the detection pattern (or optical field of view).

Preferably, the passive sensor 36 has a field of view somewhat coaxial within the water stream discharged from aerator 30, when the faucet is turned on. Passive sensor 70 has a field of view D that excludes sink 11 and extends beyond the sink to detect a user standing at the sink. The optical elements, such as an array of pinholes or an array of slits have a selected size, geometry and orientation. The size, geometry and orientation of the array of pinholes, or the array of slits are designed to provide a selected detection pattern (shown in FIGS. 3-3D, for a faucet and FIGS. 5-5L, for a flusher).

The optical sensors are passive optical sensors that detect a visible or infrared light detector optically coupled to sensor port 34. There is no light source (i.e., no light emitter) associated with the optical sensor. The visible or near infrared (NIR) light detectors detect light arriving at the corresponding sensor port. The detector provides the corresponding electrical signal to a controller located in control unit 50. The light detector (i.e., light receiver) may be a photodiode, or a photoresistor (or some other optical intensity element having an electrical output, whereby the sensory element will have the desired optical sensitivity). The optical sensor using a photo diode also includes an amplification circuitry. Preferably, the light detector detects light in the range from about 400-500 nanometers up to about 950-1000 nanometers. The light detector is primarily sensitive to ambient light and not very sensitive to body heat (e.g., infrared or far infrared light).

Figure 2:
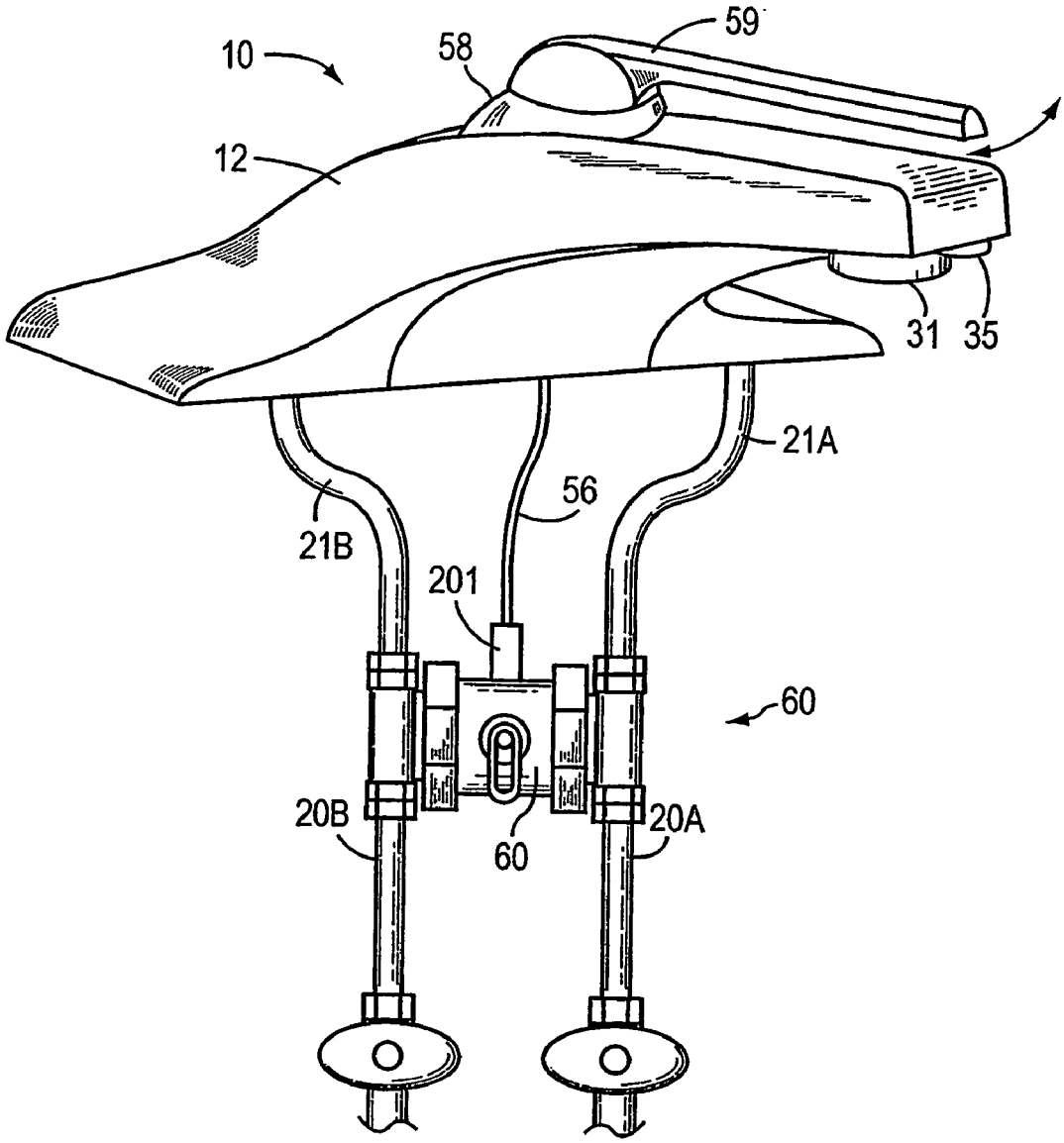
FIGS. 2, 2A, 2B, and 2C show schematically other embodiments of automatic faucet systems with passive optical sensors for controlling water flow.
Figure 2A:
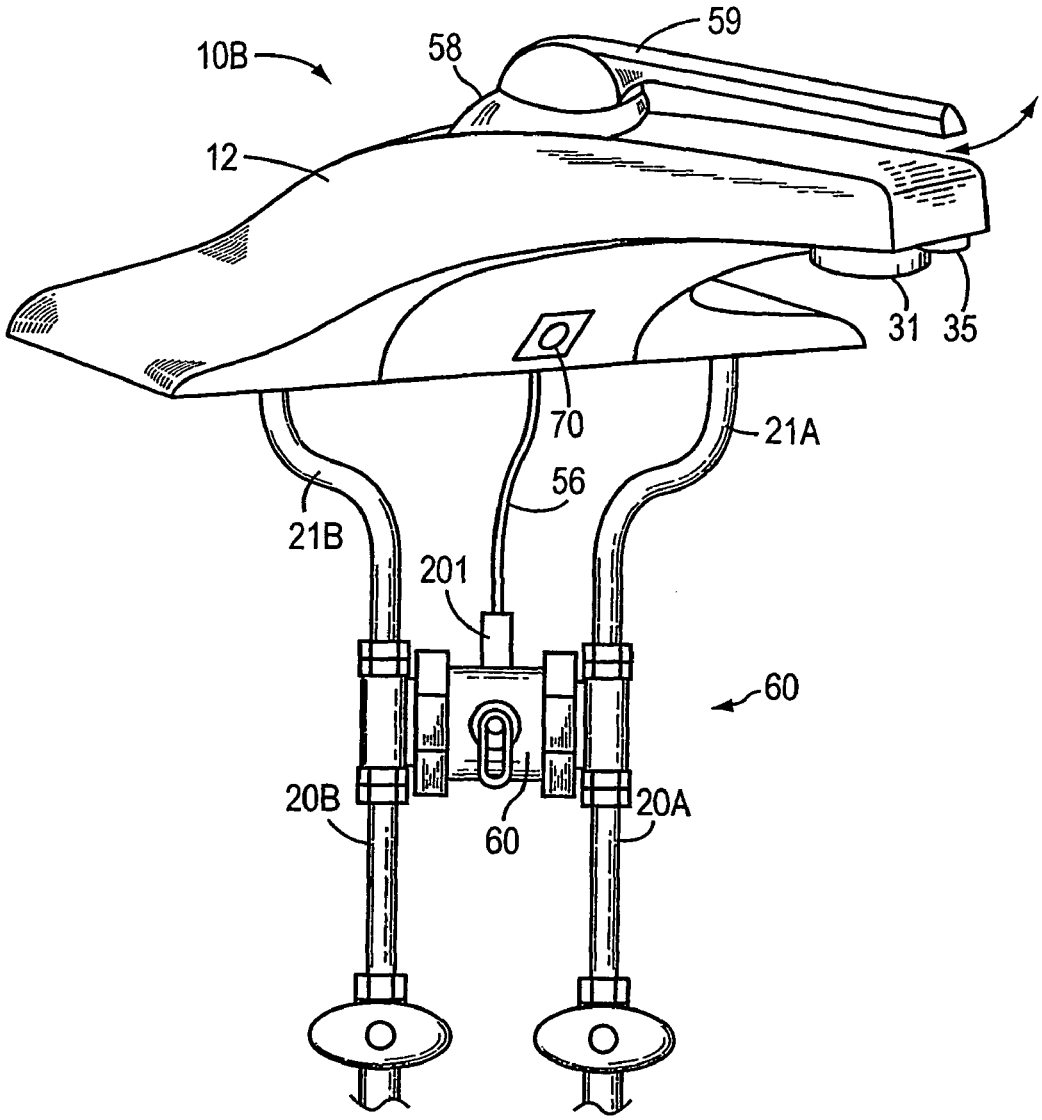
Figure 2B:
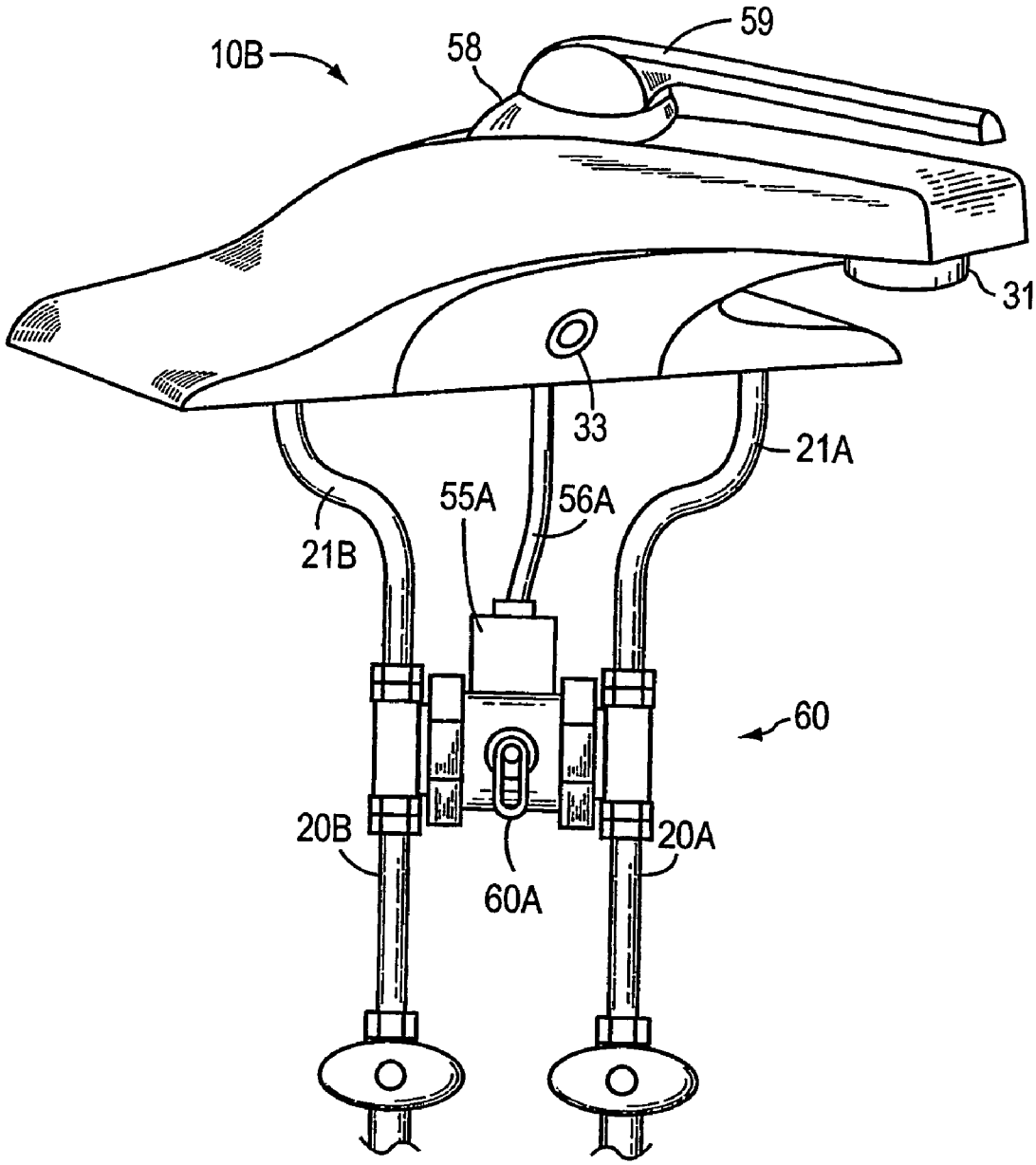
Figure 2C:
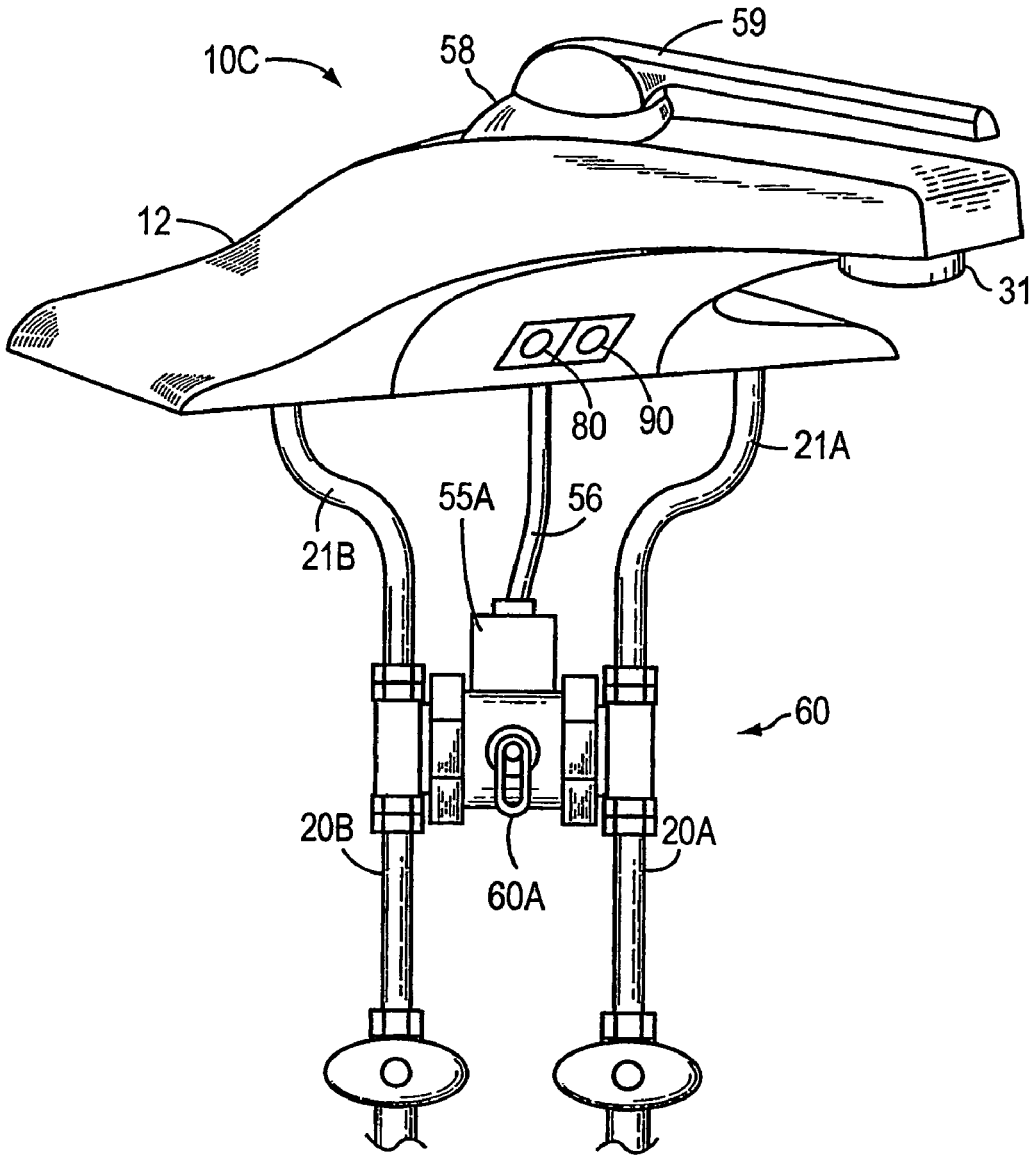

FIGS. 2 through 2C illustrate alternative embodiments of the automatic faucet system. Referring to FIG. 2, automatic faucet system 10 includes a faucet receiving water from a dual-flow faucet valve 60 and providing water from aerator 31. Automatic faucet 10 includes a mixing valve 58 controlled by a handle 59, which may be also coupled to a manual override for valve 60. Dual-flow valve 60 is connected to cold water pipe 20A and hot water pipe 20B, and controls water flow to the respective cold water pipe 21A and hot water pipe 21B.

Dual flow valve 60 is constructed and arranged to simultaneously control water flow in both pipes 21A and 21B upon actuation by a single actuator 201. Specifically, valve 60 includes two flow valves arranged for controlling flow of hot and cold water in the respective water lines. The solenoid actuator 201 is coupled to a pilot mechanism for controlling two flow valves. The two flow valves are preferably diaphragm operated valves (but may also be piston valves, or large flow-rate "fram" valves). Dual flow valve 60 includes a pressure release mechanism constructed to change pressure in a diaphragm chamber of each diaphragm operated valve and thereby open or close each diaphragm valve for controlling water flow. Dual flow valve 60 is described in detail in PCT Application PCT/US01/43277, filed on Nov. 20, 2001, which is incorporated by reference.

Referring still to FIG. 2, coupled to faucet body 12 there is a sensor port 35 for accommodating a distal end of an optical fiber (e.g., fiberoptic cable 52), or for accommodating a light detector. The fiberoptic cable delivers light from sensor port 35 to a light detector. In one preferred embodiment, faucet body 12 includes a control module with the light detector and a controller described in connection with FIGS. 9 and 9A. The controller provides control signals to solenoid actuator 201 via electrical cable 56. Sensor port 35 has a detection field of view (shown in FIGS. 3A and 3B) located outside of the water stream emitted from aerator 31.

Referring to FIG. 2A, automatic faucet system 10A includes faucet body 12 also receiving water from dual-flow faucet valve 60 and providing water from aerator 31. Automatic faucet 10A also includes mixing valve 58 controlled by handle 59. Dual-flow valve 60 is connected to cold water pipe 20A and hot water pipe 20B, and controls water flow to the respective cold water pipe 21A and hot water pipe 21B. The faucet system includes two passive optical sensors 35 and 70 coupled to faucet body 12 and is designed to have a field of view shown in FIGS. 3F-I and 3F-II.

Passive sensor 70 has a field of view D (FIGS. 3F-II and 3F-II) that extends beyond the sink and is designed to detect an approaching user or a user standing next to sink 11. Optical field of view D is also tilted to one side to be relatively insensitive to water flow. Passive sensor 35 has a field of view sensitive to a user's hands located under aerator 31 and to water flow. Sensor 70 provides an "advanced" signal to the system before sensor 35 confirms location of the user's hands. The combination of these two sensors improves detection precision and enables faster response of the system to the user's demand.

Referring to FIG. 2B, automatic faucet system 10B includes faucet body 12 also receiving water from dual-flow faucet valve 60 and providing water from aerator 31. Automatic faucet 10B also includes mixing valve 58 controlled by handle 59. Dual-flow valve 60 is connected to cold water pipe 20A and hot water pipe 20B, and controls water flow to the respective cold water pipe 21A and hot water pipe 21B.

Figure 3:
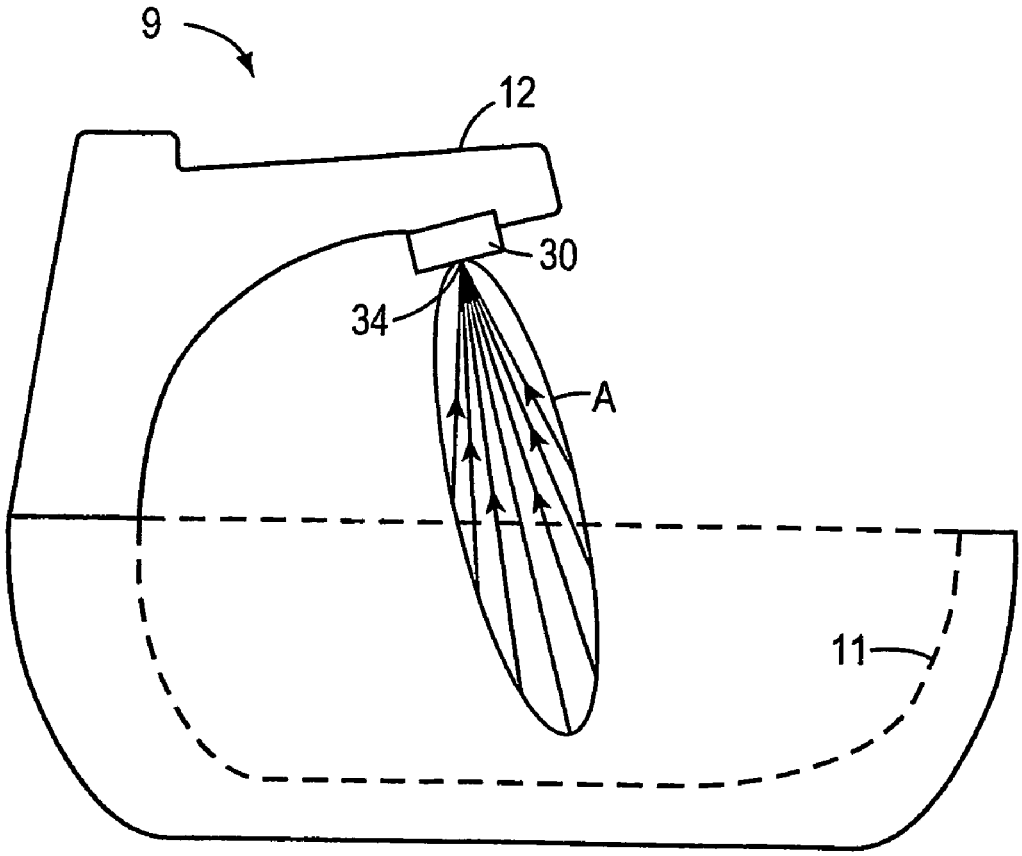
Figure 3A:
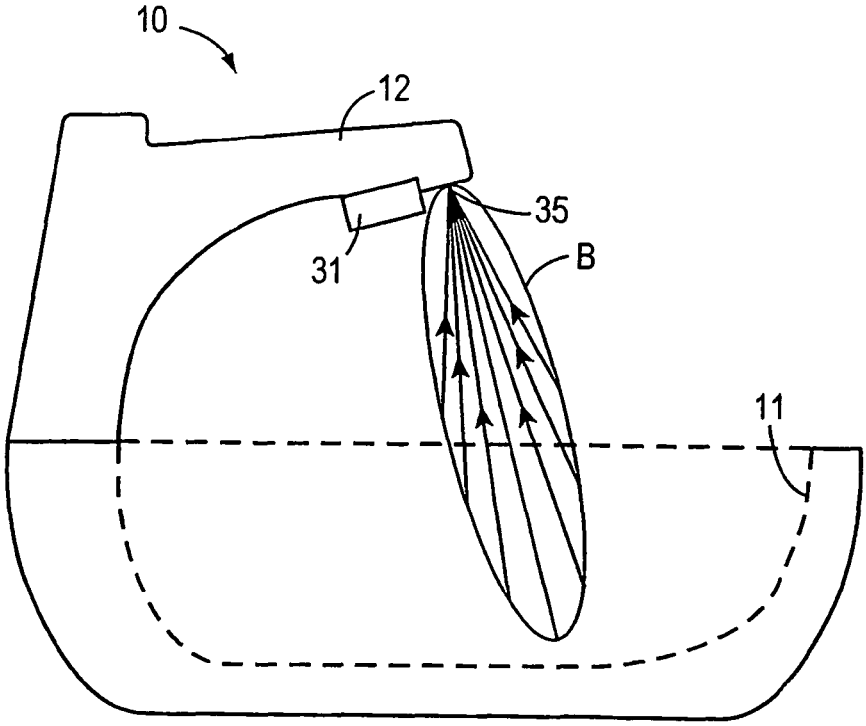
Figure 3B:
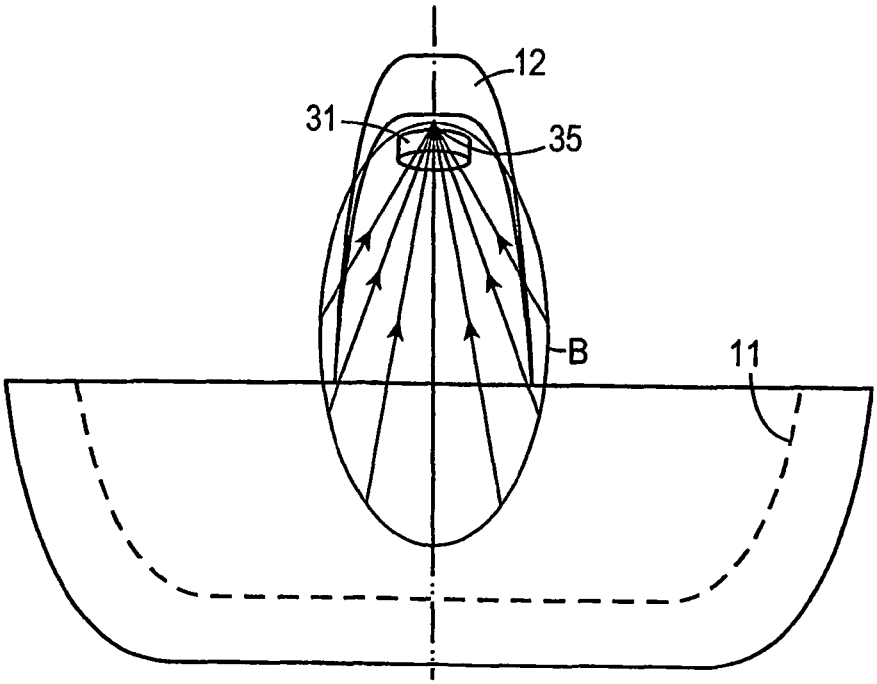
Figure 3C:
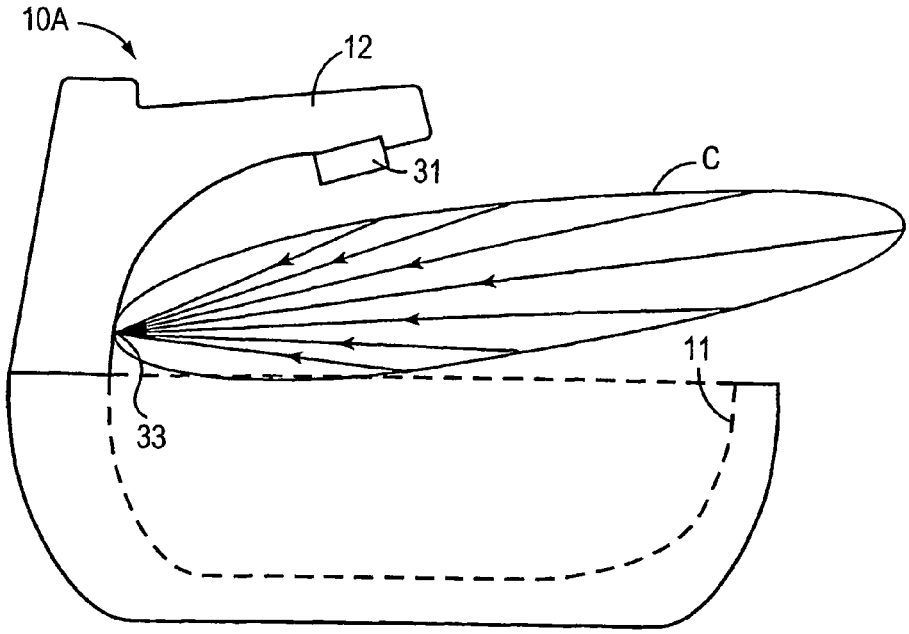
Figure 3D:
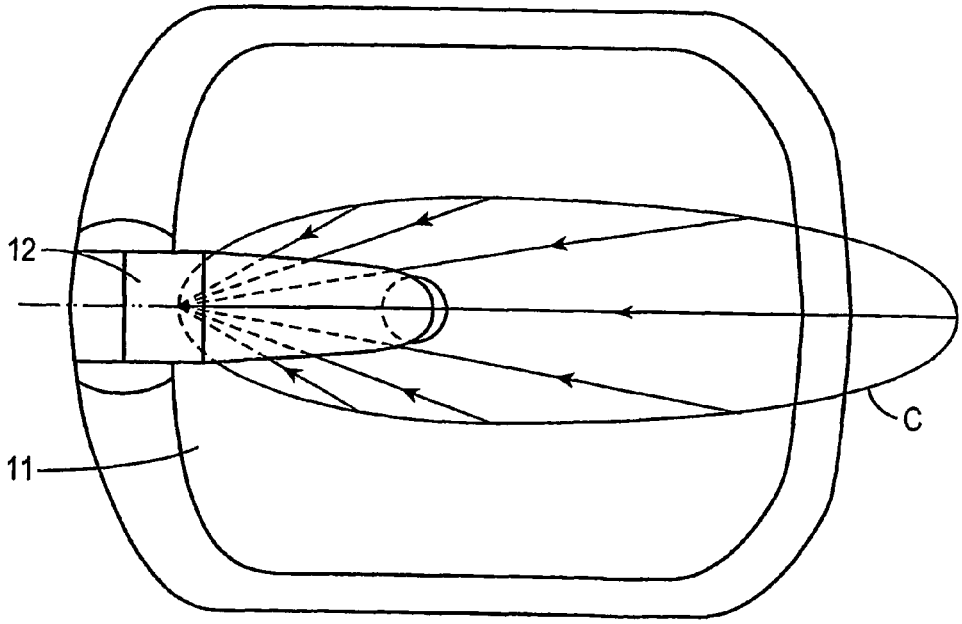

A sensor port 33 is coupled to faucet body 12 and is designed to have a field of view shown in FIGS. 3C and 3D. Sensor port 33 accommodates the distal end of an optical fiber 56A. The proximal end of optical fiber 56A provides light to an optical sensor located in a control module 55A coupled to dual flow valve 60. Control module 55A also includes the control electronics and batteries. The optical sensor detects the presence of an object (e.g., hands), or detects a change in the presence of the object (i.e., movement) in the sink area. Control electronics control the operation of and the readout from the light detector. The control electronics also include a power driver that controls the operation of the solenoid associated with valve 60. Based on the signal from the light detector, the control electronics direct the power driver to open or close solenoid valve 60 (i.e., to start or stop the water flow). The design and operation of actuator 201 is described in detail in PCT Applications PCT/US02/38757; PCT/US02/38758; and PCT/US02/41576, all of which are incorporated by reference as if fully provided herein.

Referring to FIG. 2C, automatic faucet system 10C includes faucet body 12, also receiving water from dual-flow faucet valve 60 and providing water from aerator 31 as described above. Faucet system 10C also includes passive sensors 80 and 90 mounted on faucet body 12. Sensors 80 and 90 can be installed at the same time as one optical unit coupled using several optical fibers (denoted as 56) to optical controller 55A. Alternatively, sensors 80 and 90 have the detection elements (e.g., a photoresistor or a photodiode located inside body 12) and are electrically connected to the microcontroller.

Passive sensors 80 and 90 may include one or several optical elements designed to provide the field of view shown in FIGS. 3G-I and 3G-II. These fields of view are designed to substantially avoid sink 11 and water flowing from aerator 31. Both fields of view are designed to detect a user approaching sink 11 or located at sink 11.

FIG. 3 shows schematically a cross-sectional view of a first preferred detection pattern (A) for the passive optical sensor installed in automatic faucet 9 having faucet body 12. The detection pattern A is associated with sensor port 34 and is shaped by a lens, or an element selected from the optical elements shown in FIGS. 6-6E. The detection pattern A is selected to receive reflected ambient light primarily from sink 11. The pattern's width is controlled, but the range is much less controlled (i.e., FIG. 3 shows pattern A only schematically because detection range is not really limited).

A user standing in front of a faucet will affect the amount of ambient (room) light arriving at the sink and thus will affect the amount of light arriving at the optical detector. On the other hand, a person just moving in the room will not affect significantly the amount of detected light. A user having his hands under the faucet will alter the amount of ambient light being detected by the optical detector even more. Thus, the passive optical sensor can detect the user's hands and provide the corresponding control signal. Here, the detected light does not depend significantly on the reflectivity of the target surface (unlike for optical sensors that use both a light emitter and a receiver). After hand washing, the user removing his hands from under the faucet will again alter the amount of ambient light detected by the optical detector. Then, the passive optical sensor provides the corresponding control signal to the controller (explained in connection with FIGS. 9, 9A and 9B).

Figure 13:
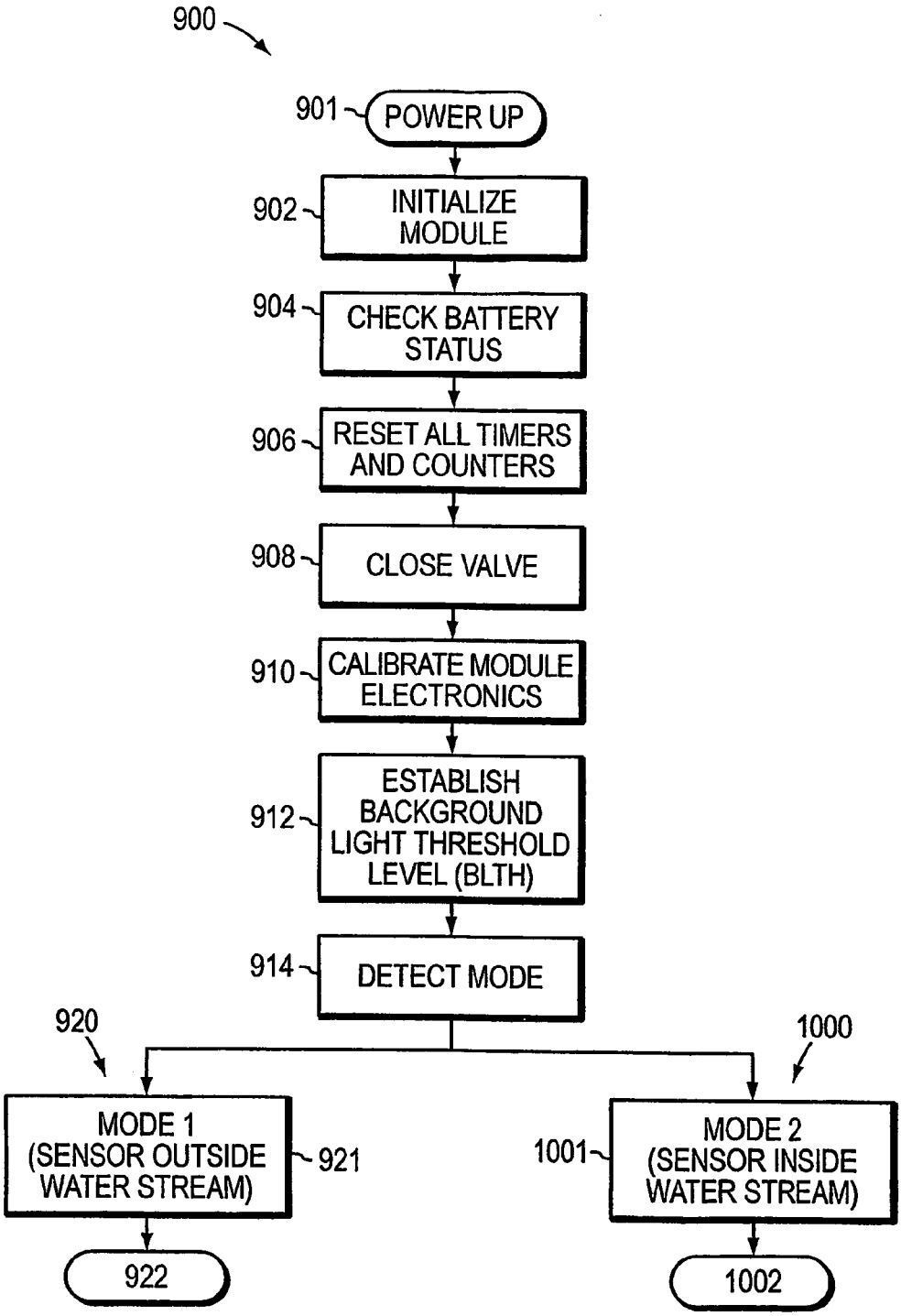
FIGS. 13, 13A and 13B show a flow diagram of an algorithm for processing optical data detected by the passive sensor operating the automatic faucet system.
Figure 13A:
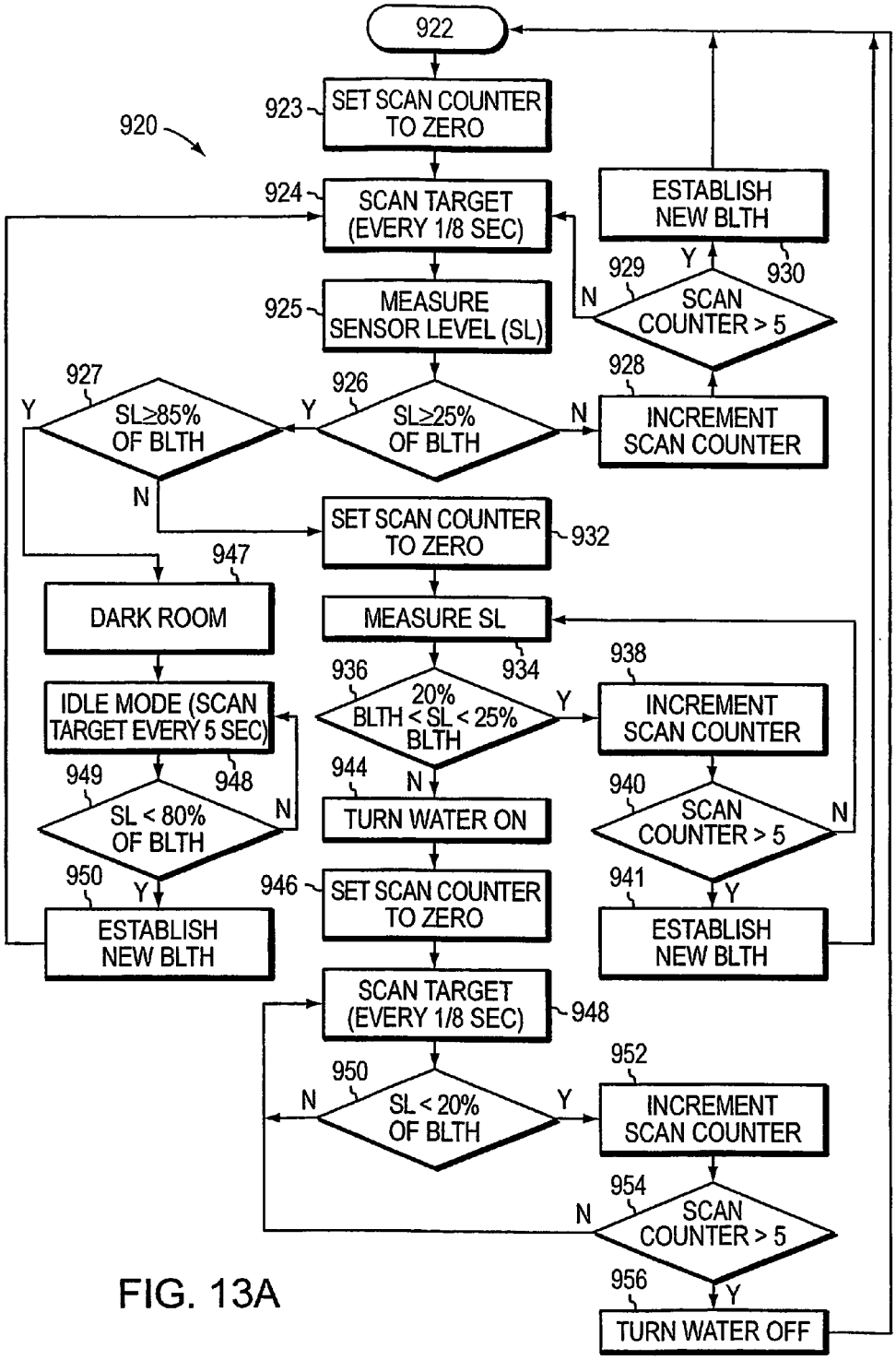
Figure 13B:
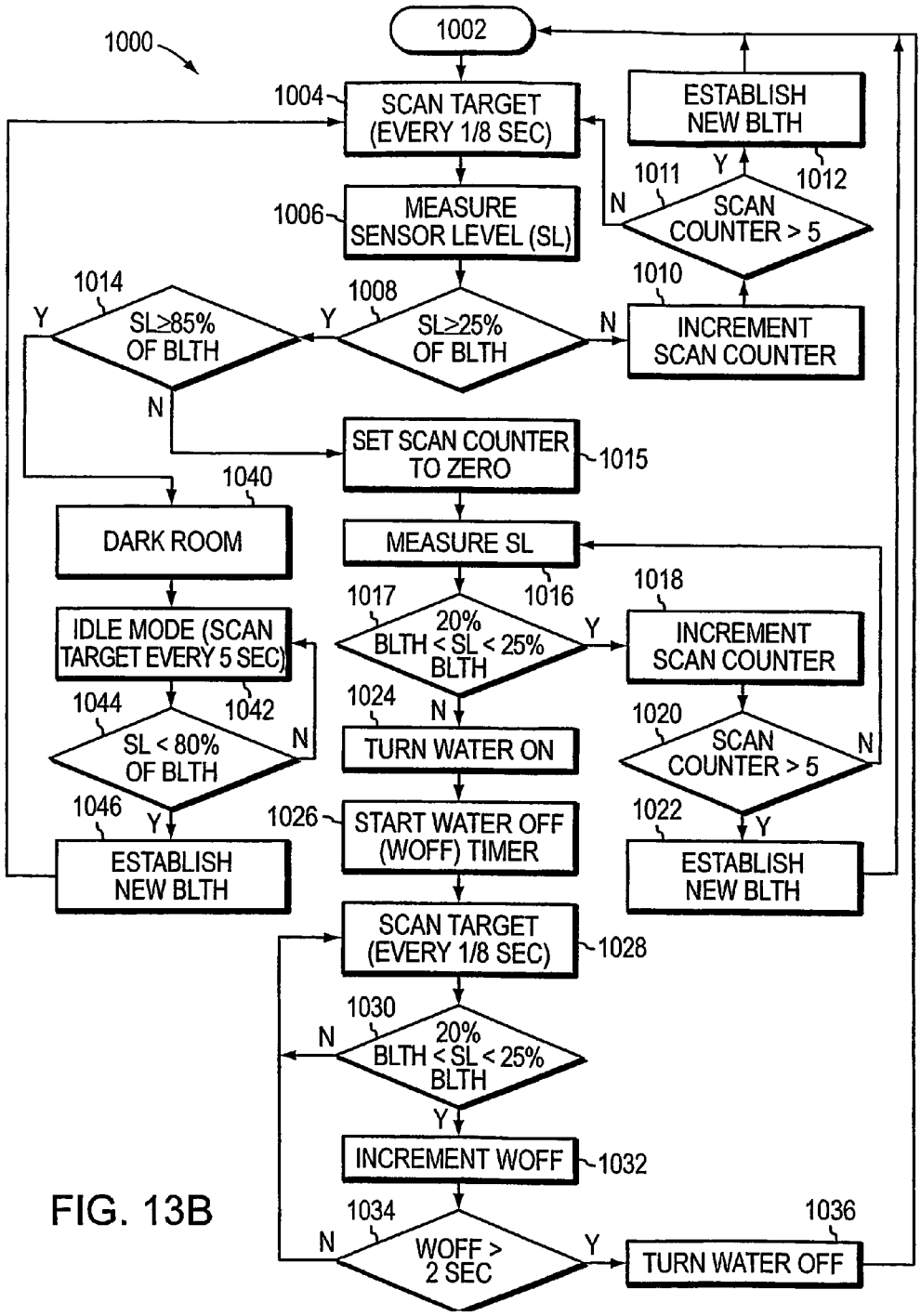

FIGS. 3A and 3B show schematically a second preferred detection pattern (B) for the passive optical sensor installed in automatic faucet 10. The detection pattern B is associated with sensor port 35, and again may be shaped by a lens, or an optical element shown in FIGS. 6-6E. A user having his hands under faucet 10 alters the amount of ambient (room) light detected by the optical detector. As mentioned above, the detected light does not depend significantly on the reflectivity of the user's hands (unlike for optical sensors that use both a light emitter and a receiver). Thus, the passive optical sensor detects the user's hands and provides the corresponding control signal to the controller. FIGS. 13, 13A, and 13B illustrate detection algorithms used for the detection patterns A and B.

FIGS. 3C and 3D show schematically another detection pattern for the passive optical sensor installed in automatic faucet 10A. The detection pattern C is associated with sensor port 33, and is shaped a selected optical element (a lens, slits or pinholes). The detection pattern avoids sink 11 and may extend beyond the sink. In this embodiment, light reflections from sink 11 influence the detected light only minimally. The selected optical element achieves a desired width and orientation of the detection pattern. The range of detection is controlled using detection circuit 253 shown in FIG. 9C. In this embodiment, a user standing in front of faucet 10A will alter the amount of detected ambient light somewhat more than a user passing by depending on the field of view and detection sensitivity. Inadvertent triggering of the system is eliminated by the detection algorithm.

Figure 3E:
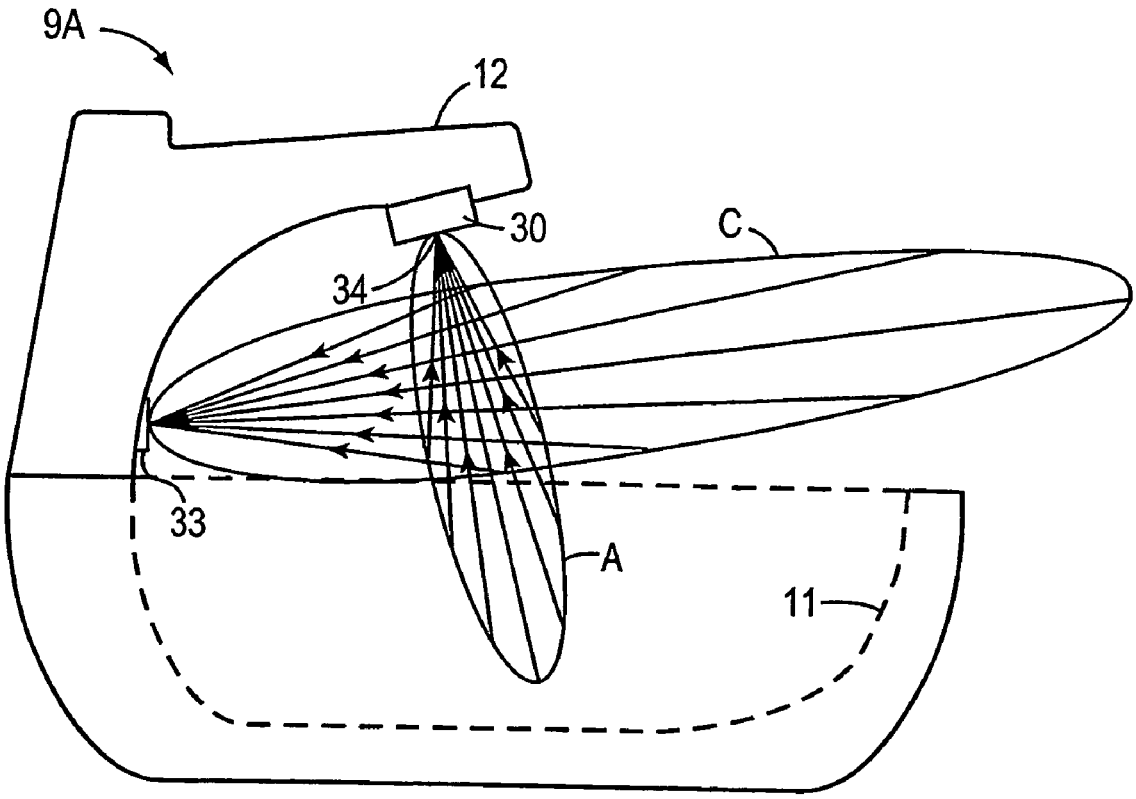

FIG. 3E shows schematically another embodiment of the detection pattern including field of view A, described in connection with FIG. 3, and field of view C, described in connection with FIGS. 3C and 3D. This combined detection pattern is created using two passive optical sensors 33 and 34. Passive sensor 33 has a field of view C created by a selected optical element or several optical elements. The range of detection is partially controlled by detection circuit 253 shown in FIG. 9C. Field of view A is directed downwards toward the sink, as described above. As the user approaches sink 11, the detection algorithm starts detecting the user entering field of view C. Only after the user is located inside field of view C, passive sensor 34 will detect the user's hands inside field of view A. The combination of passive sensors 33 and 34 enables an improved algorithm for detecting the user's presence and departure and avoiding false triggering of the faucet.

In the algorithm, detector 33 has to first detect the user, and after detector 34 detects the user's hands the water flow is initiated. During the water flow, both passive sensors detect the user, while sensor 34 may experience an increased data noise due to the hand movements of the user washing his hands. After passive sensor 34 no longer detects the user, the water flow may be closed upon some change detected by passive sensor 33, presumably due to the user removing his or her hands from under the faucet and perhaps stepping away from the sink. This detection pattern also eliminates errors due to, for example, a paper towel or other objects left in the sink (being detected by sensor 34) since passive sensor 33 will no longer detect the user.

FIGS. 3F-I and 3F-II illustrate another embodiment of the detection pattern utilizing field of view B and field of view D. Fields of view B and D are formed by the use of passive optical sensors 35 and 70, also shown in FIG. 2A. Field of view D is directed to eliminate sink 11 and is angled to one side to be less sensitive to water flowing from aerator 31. Similarly to those described above, passive sensors 35 and 70 are used to improve the detection accuracy and eliminate invalid targets.

Figure 6C:
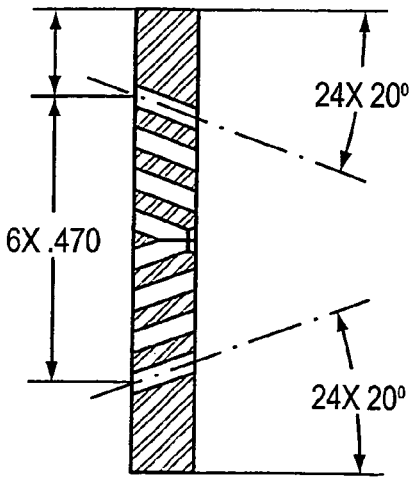
FIGS. 6, 6A, 6B, 6C, 6D and 6E show schematically optical elements used to form the different optical detection patterns shown in FIGS. 3 through 3G-II and in FIGS. 5 through 5L.

Using appropriate selection of the optical elements described in connection with FIGS. 6 through 6C or optical elements such as lenses or arrays of pinholes or slits described in connection with FIGS. 6 through 6C, passive sensor 33 may have a field of view E shown in FIGS. 3G-I and 3G-II. This type of field of view is designed to detect users approaching sink 11 from the left or the right side of the sink, while still minimizing the influence of water flowing from aerator 31.

Field of view E may also be achieved using two passive optical sensors 80 and 90 as shown in FIG. 2C and FIG. 3G-II. The automatic faucet may also use 3 or more passive optical sensors, for example, the combination of passive sensor 35 (shown in FIG. 2A) and passive sensors 80 and 90 (shown in FIG. 2C). The additional passive sensor again improves the detection efficiency, since a user will first enter the field of view shown in FIGS. 3G-I and 3G-II and only then affect optical field of view A (or optical field B) shown in FIGS. 3E and 3F.

Figure 4:
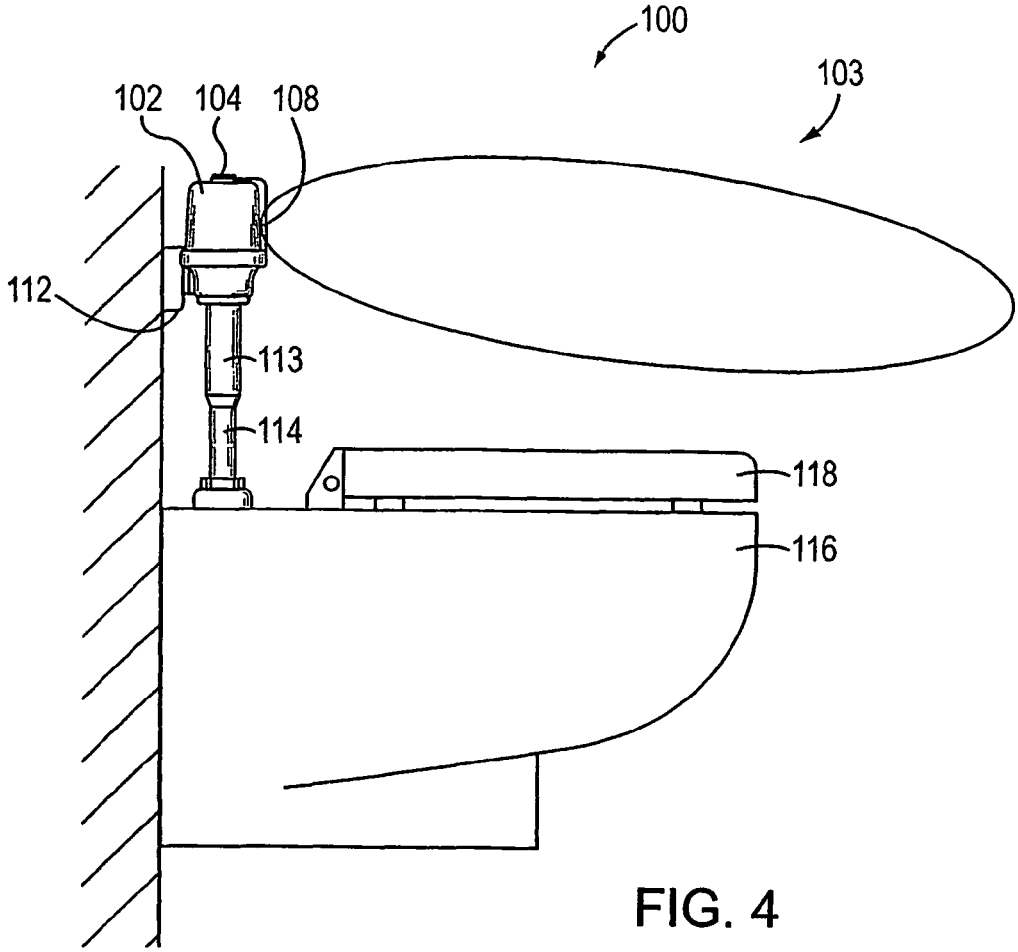
FIG. 4 shows schematically a side view of a toilet including an automatic flusher.
Figure 4A:
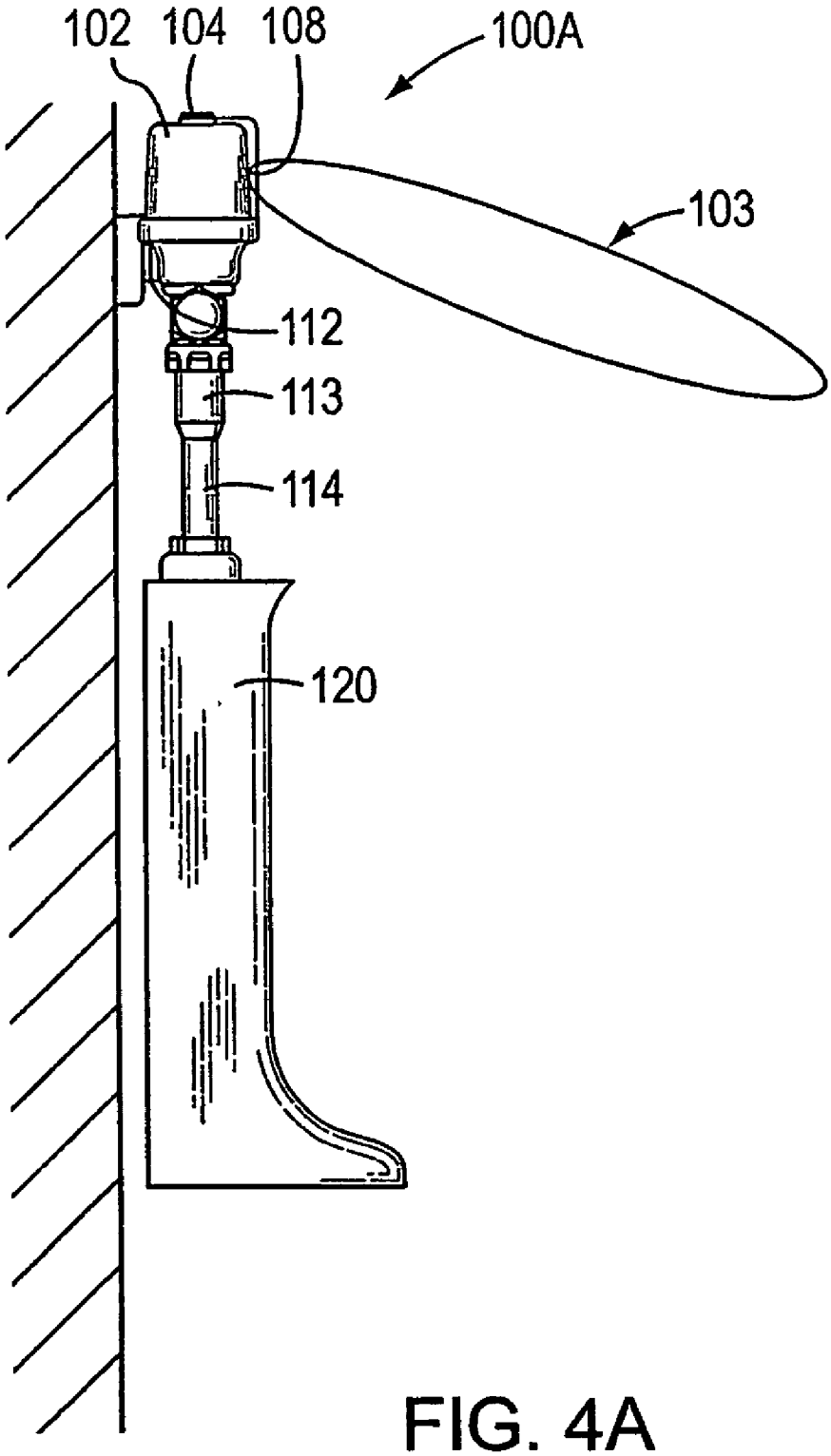
FIG. 4A shows schematically a side view of a urinal including an automatic flusher.

FIG. 4 shows schematically a side view of a toilet including an automatic flusher 100, and FIG. 4A shows schematically a side view of a urinal including an automatic flusher 100A. Flusher 100 receives pressurized water from a supply line 112 and employs a passive optical sensor to respond to actions of a target within a target region 103. After a user leaves the target region, a controller directs opening of a flush valve 102 that permits water flow from supply line 112 to a flush conduit 113 and to a toilet bowl 116.

FIG. 4A illustrates bathroom flusher 100A used for automatically flushing a urinal 120. Flusher 100A receives pressurized water from supply line 112. Flush valve 102 is controlled by a passive optical sensor that responds to actions of a target within a target region 103. After a user leaves the target region, a controller directs opening of a flush valve 102 that permits water flow from supply line 112 to a flush conduit 113.

Bathroom flushers 100 and 100A may have a modular design, wherein their cover can be partially opened to replace the batteries or the electronic module. Bathroom flushers with such a modular design are described in U.S. Patent Application No. 60/448,995, filed on Feb. 20, 2003, which is incorporated by reference for all purposes.

Figure 5:
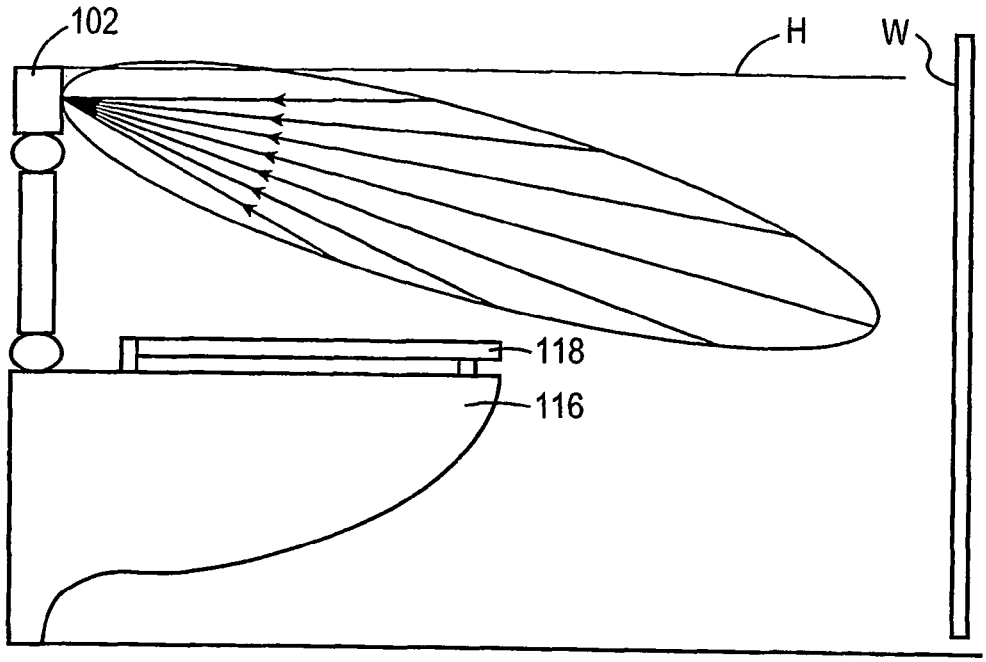
FIGS. 5, 5A, 5B, 5C, 5D, 5E, 5F and 5G show schematically side and top views of different optical detection patterns used by passive optical sensors employed in the automatic toilet flusher of FIG. 4.
Figure 5A:
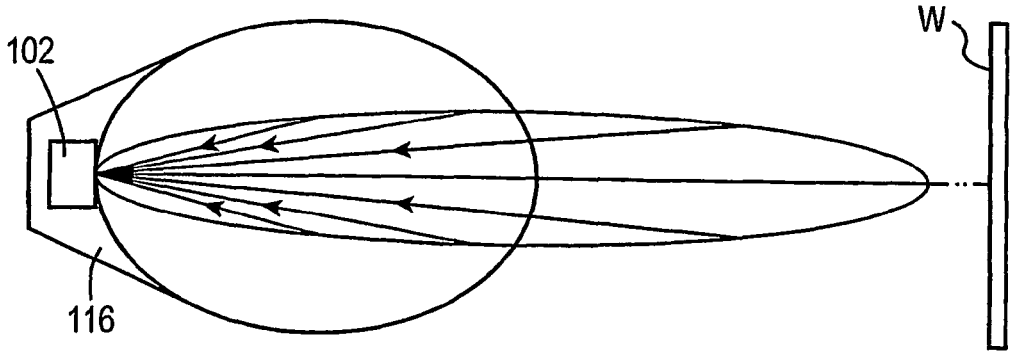

FIGS. 5 and 5A show schematically side and top views of an optical detection pattern used by the passive optical sensor installed in the automatic toilet flusher of FIG. 4. This detection pattern is associated with sensor port 108 and is shaped by a lens, or an element selected from the optical elements shown in FIGS. 6-6E. The pattern is angled below horizontal (H) and directed symmetrically with respect to toilet 116. The range is somewhat limited so as not to be influenced by a wall (W); this can also be done by limiting the detection sensitivity.

Figure 5B:
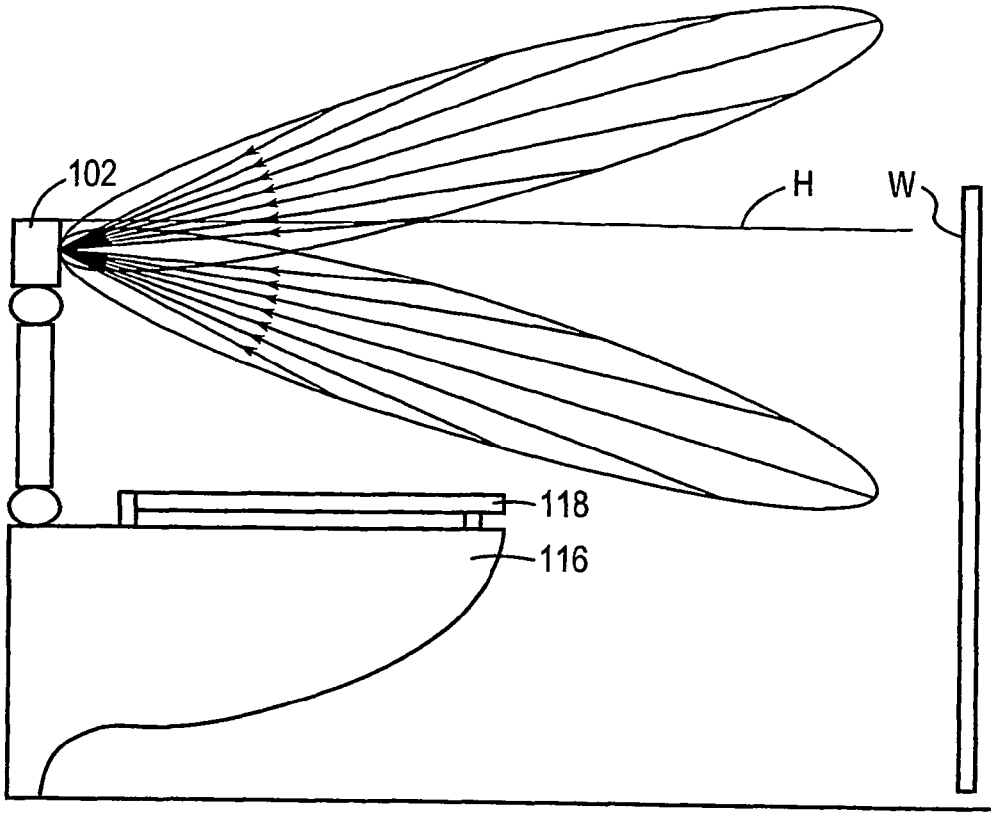
Figure 5C:
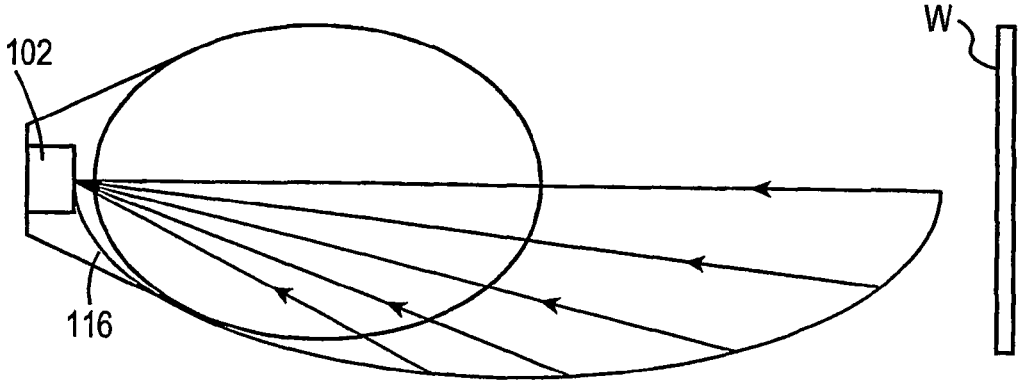

FIGS. 5B and 5C show schematically side and top views of a second optical detection pattern used by the passive optical sensor installed in the automatic toilet flusher of FIG. 4. This detection pattern is shaped by a lens, or another optical element. The pattern is angled both below horizontal (H) and above horizontal (H). Furthermore, the pattern is directed asymmetrically with respect to toilet 116, as shown in FIG. 5C.

Figure 5D:
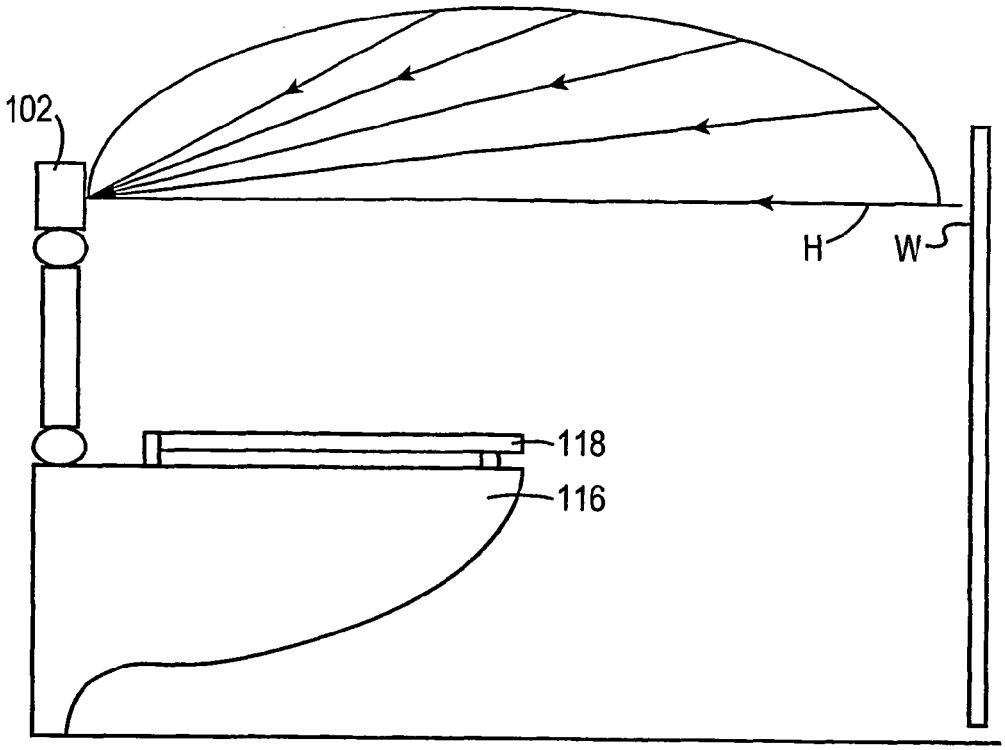
Figure 5E:
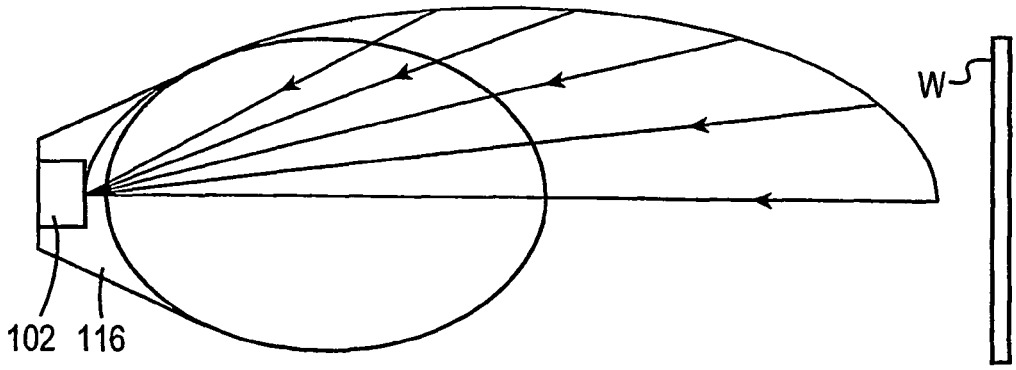

FIGS. 5D and 5E show schematically side and top views of a third optical detection pattern used by the passive optical sensor installed in the automatic toilet flusher of FIG. 4. This detection pattern is again shaped by a lens, or another optical element. The pattern is angled above horizontal (H). Furthermore, the pattern is directed asymmetrically with respect to toilet 116, as shown in FIG. 5E.

Figure 5F:
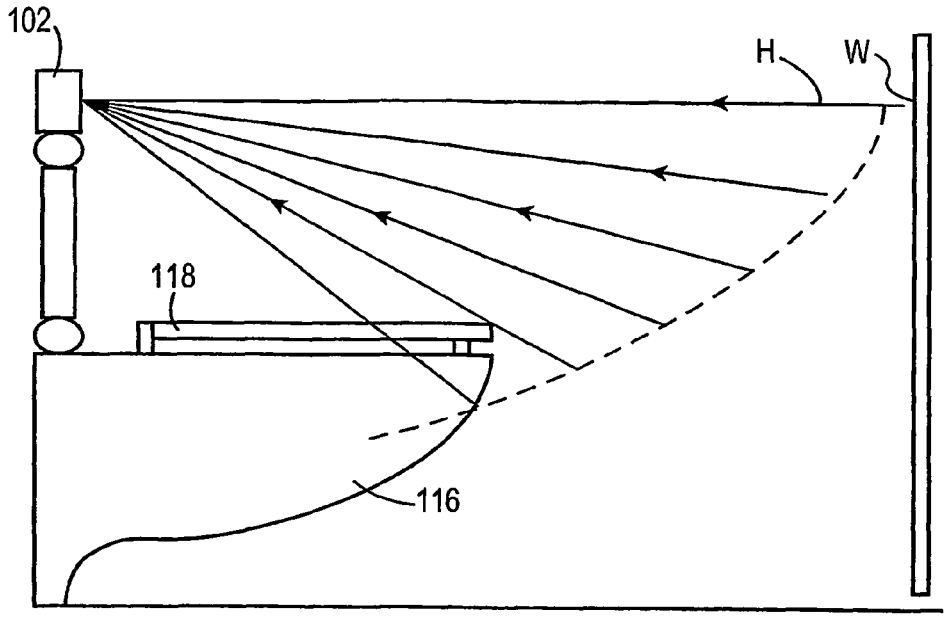
Figure 5G:
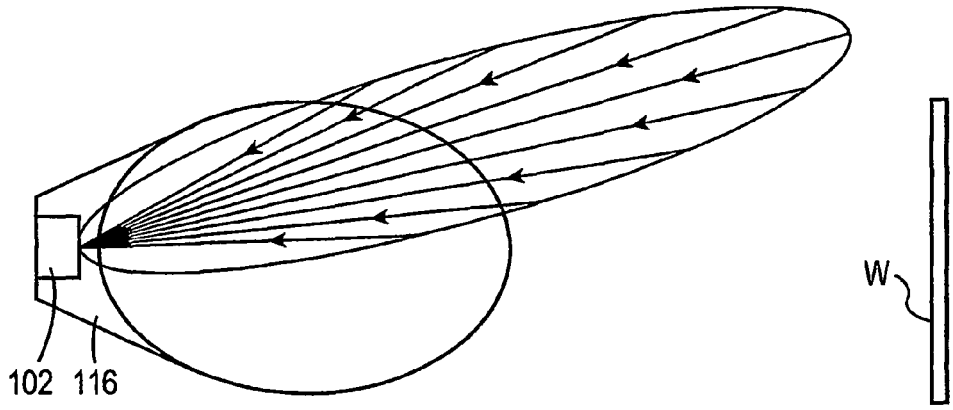

FIGS. 5F and 5G show schematically side and top views of a fourth optical detection pattern used by the passive optical sensor installed in the automatic toilet flusher of FIG. 4. This detection pattern is angled below horizontal (H) and is directed asymmetrically across toilet 116, as shown in FIG. 5G. This detection pattern is particularly useful for "toilet side flushers," described in U.S. application Ser. No. 09/916,468, filed on Jul. 27 2001, or U.S. application Ser. No. 09/972,496, filed on Oct. 6, 2001, both of which are incorporated by reference.

Figure 5H:
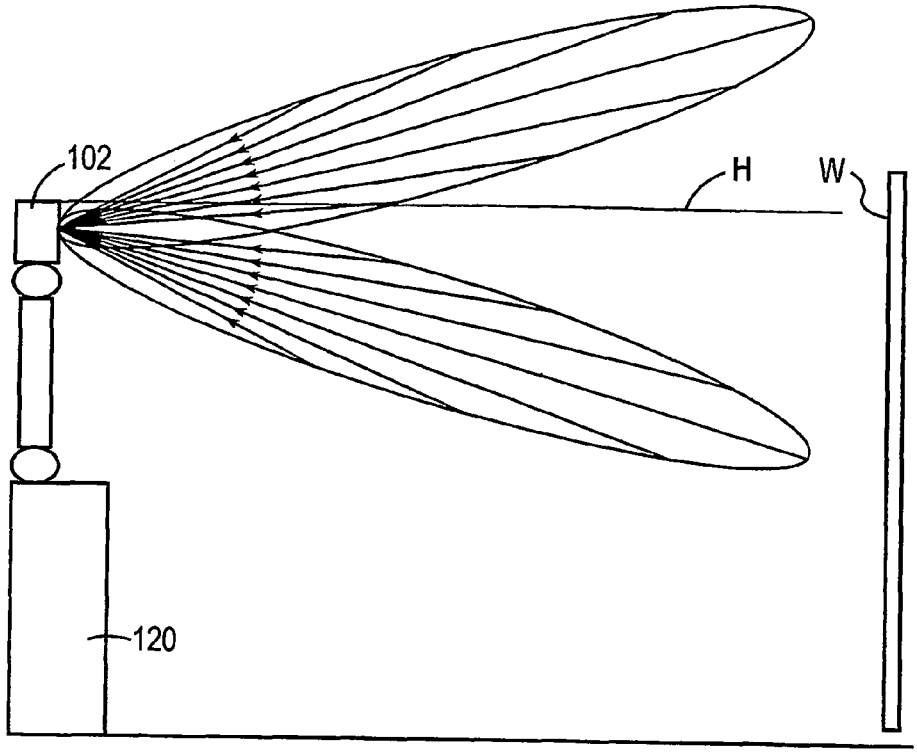
FIGS. 5H, 5I, 5J, 5K and 5L show schematically side and top views of different optical detection patterns used by passive optical sensors employed in the automatic urinal flusher of FIG. 4A.
Figure 5I:
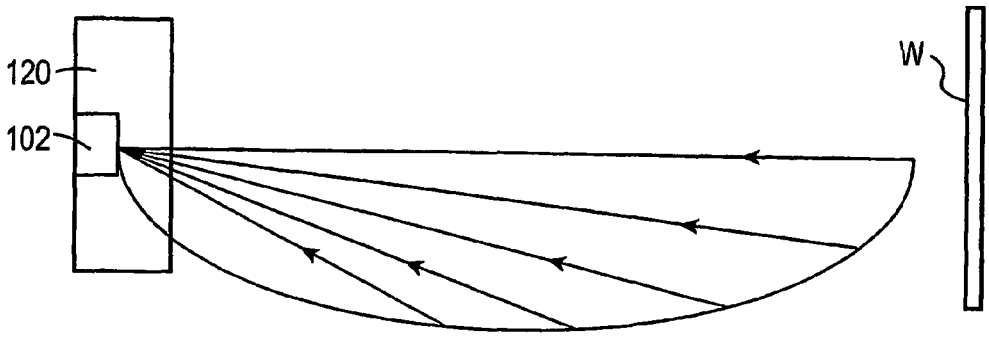

FIGS. 5H and 5I, show schematically side and top views of an optical detection pattern used by the passive optical sensor installed in the automatic urinal flusher of FIG. 4A. This detection pattern is shaped by a lens, or another optical element. The pattern is angled both below horizontal (H) and above horizontal (H) to target ambient light changes caused by a person standing in front of urinal 120. This pattern is directed asymmetrically with respect to urinal 120 (as shown in FIG. 51), for example, to eliminate or at least reduce light changes caused by a person standing at a neighboring urinal.

Figure 5J:
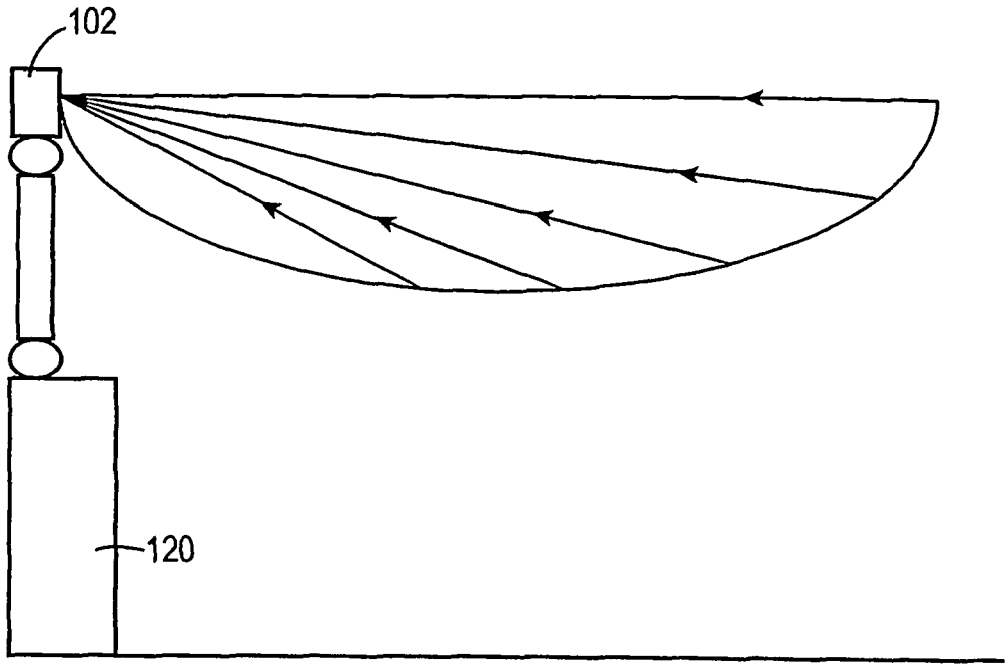
Figure 5K:
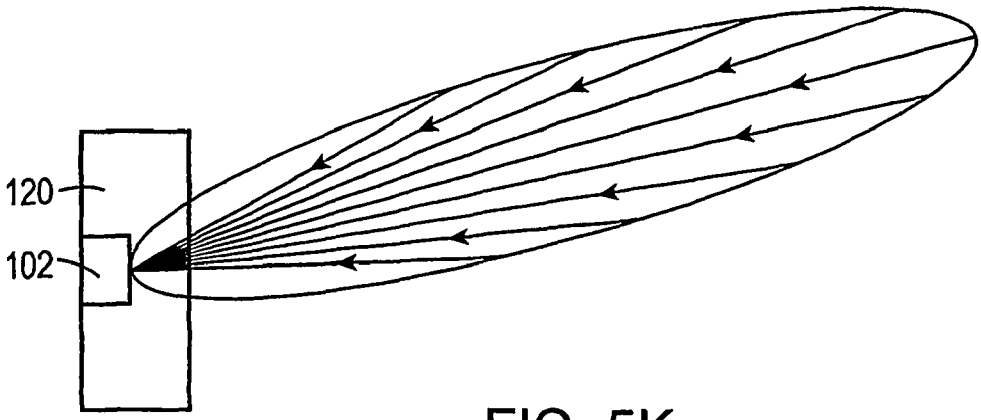
Figure 5L:
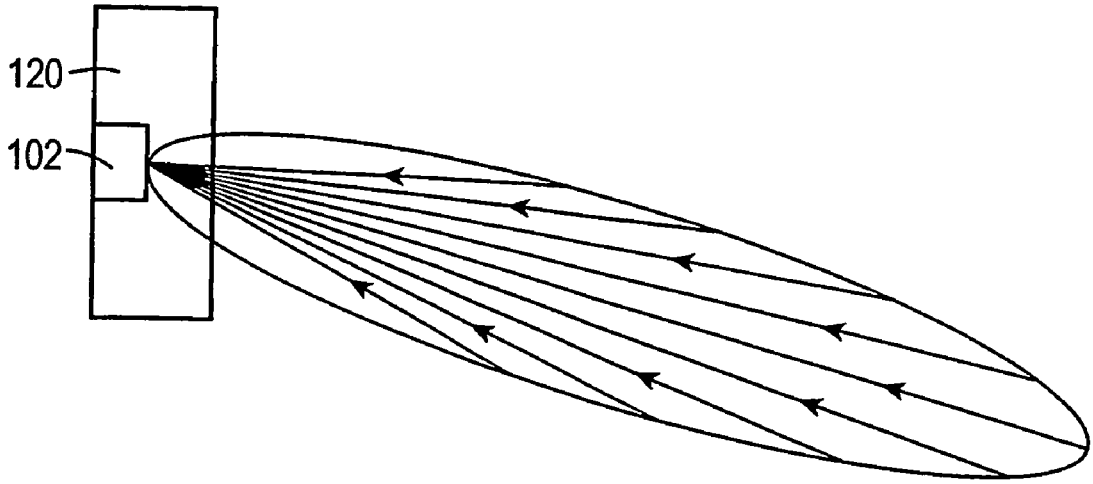

FIGS. 5J, 5K and 5L, show schematically side and top views of another optical detection pattern used by the passive optical sensor installed in the automatic urinal flusher of FIG. 4A. This detection pattern is shaped by a lens, or another optical element, as mentioned above. The pattern is angled below horizontal (H) to eliminate the influence of light caused by a ceiling lamp. This pattern may be directed asymmetrically to the left or to the right with respect to urinal 120 (as shown in FIG. 5K or 5L). These detection patterns are particularly useful for "urinal side flushers," described in U.S. application Ser. No. 09/916,468, filed on Jul. 27 2001, or U.S. application Ser. No. 09/972,496, filed on Oct. 6, 2001.

In general, the field of view of a passive optical sensor can be formed using optical elements such as beam forming tubes, lenses, light pipes, reflectors, arrays of pinholes and arrays of slots having selected geometries. These optical elements can provide a down-looking field of view that eliminates invalid targets such as mirrors, doors, and walls. Various ratios of the vertical field of view to horizontal field of view provide different options for target detection. For example, the horizontal field of view may be 1.2 wider than the vertical field of view or vice versa. A properly selected field of view can eliminate unwanted signals from an adjacent faucet or urinal. The detection algorithm includes a calibration routine that accounts for a selected field of view including the field's size and orientation.

Figure 6B:
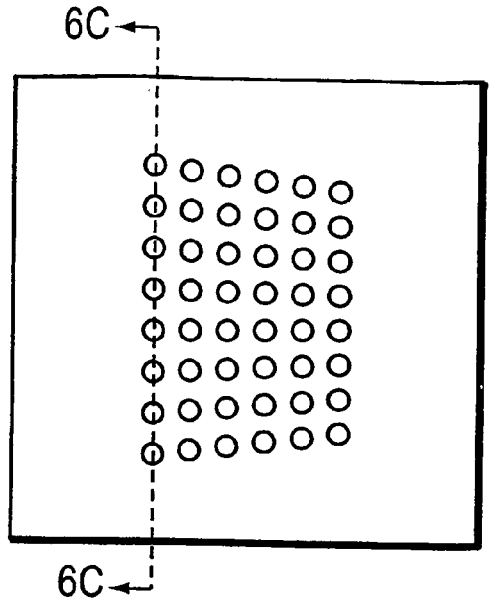
Figure 6A:
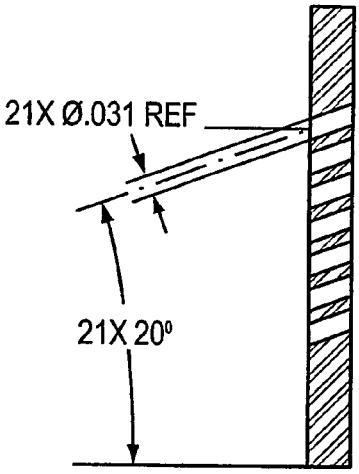
Figure 6:
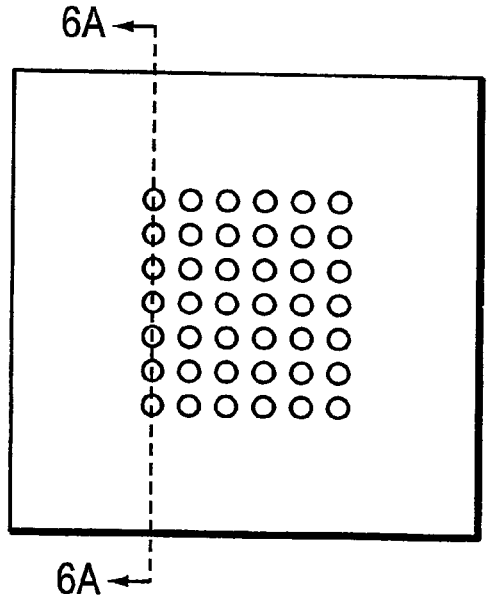
Figure 6D:
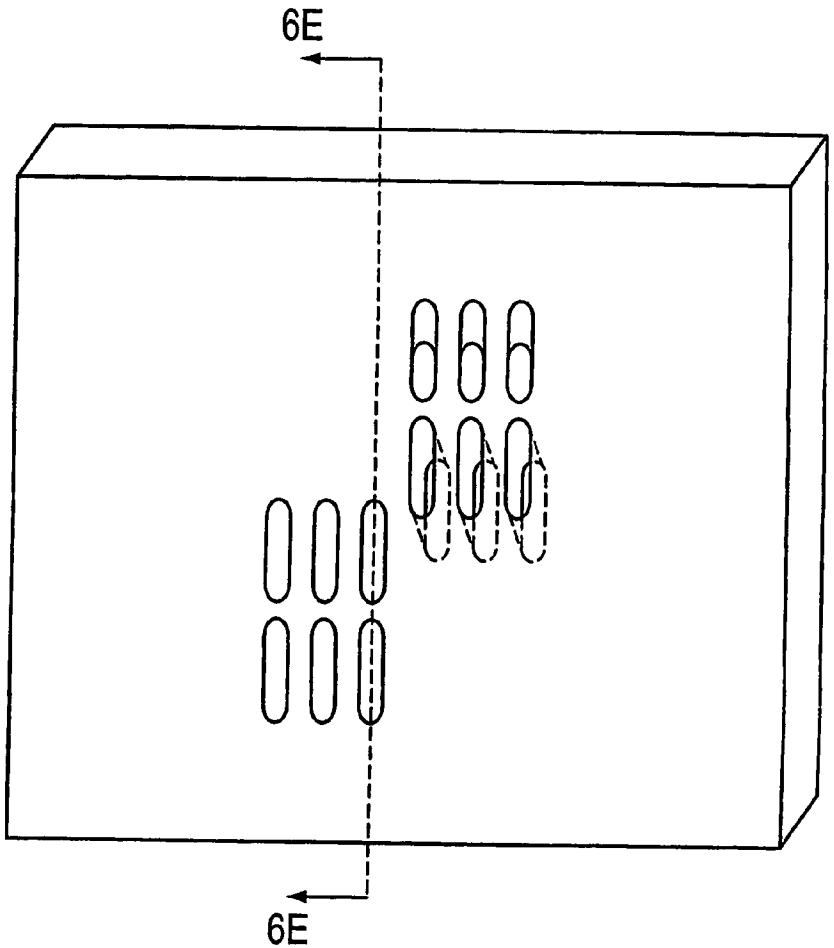
Figure 6E:
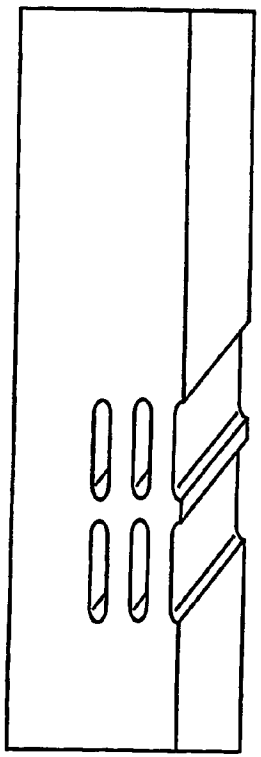

FIGS. 6 through 6E illustrate different optical elements for producing desired detection patterns of the passive sensor. FIGS. 6 and 6B illustrate different arrays of pinholes. The thickness of the plate, the size and the orientation of the pinholes (shown in cross-section in FIGS. 6A and 6C) define the properties of the field of view. FIGS. 6D and 6E illustrate an array of slits for producing a detection pattern shown in FIGS. 5B and 5H. This plate may also include a shutter for covering the top or the bottom detection field.

Figure 7:
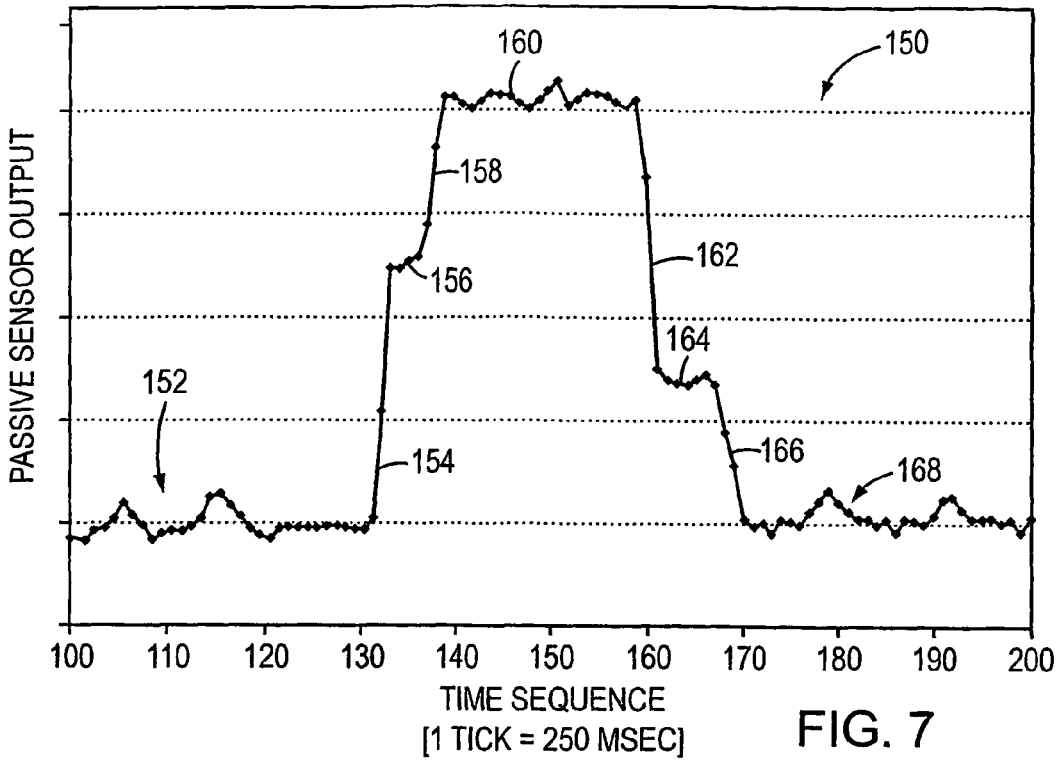
FIGS. 7, 7A, 7B and 7C show optical data detected by passive sensors having geometry shown in FIGS. 1, 2 and 2A.

FIG. 7 shows optical data measured for a passive sensor located inside an aerator as shown for faucet 9 (FIG. 1). Graph 150 shows ambient light variation in a region 152. As an absorptive target enters the field of view, pulse width increases, as shown in region 154. In region 156, the hands of the user are located substantially under the faucet but water is not yet flowing. The water flow is initiated in region 158 and subsequently, in region 160, the user is washing his or her hands. In region 160 the passive sensor detects the water flow and the user's hands. Subsequently, in region 162, the user removed his or her hands from under the faucet, but as shown in a region 164, the water flow still affects the optical signal detected by the passive sensor. In-this region, the algorithm directs the controller to stop the water flow (region 166) and the optical signal returns substantially to the background level in region 168. The control algorithm resolves the above-described regions of the optical data and thus controls the opening and closing of water flow.

Figure 7A:
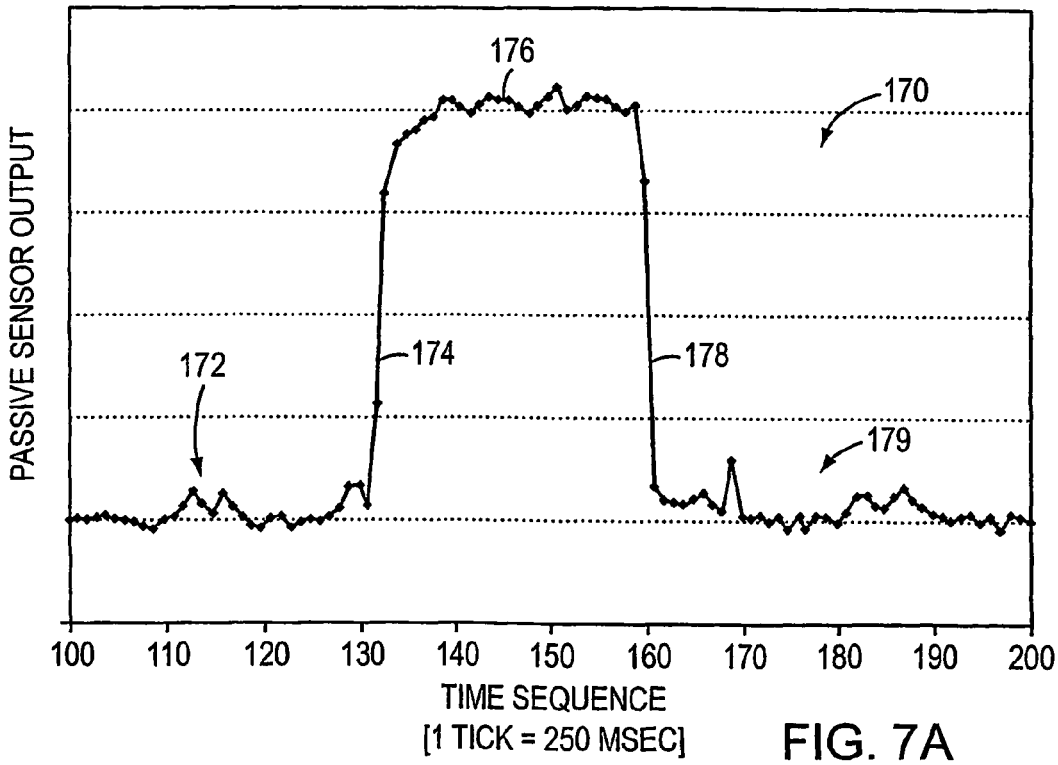

FIG. 7A shows the measured optical data (170) for a passive sensor positioned at a specific site on faucet 10B, shown in FIG. 2B. Initially, in region 172, the passive sensor detects the background data for a period. In region 172 of graph 170, a user enters the field of view, which rapidly affects the optical data. This transition (region 174) is quite sharp, and is followed by substantially constant region 176, where the user is within the field of view. After the user leaves, there is a rapid transition (region 178) back to substantially the original background levels, as shown in region 179.

Figure 7B:
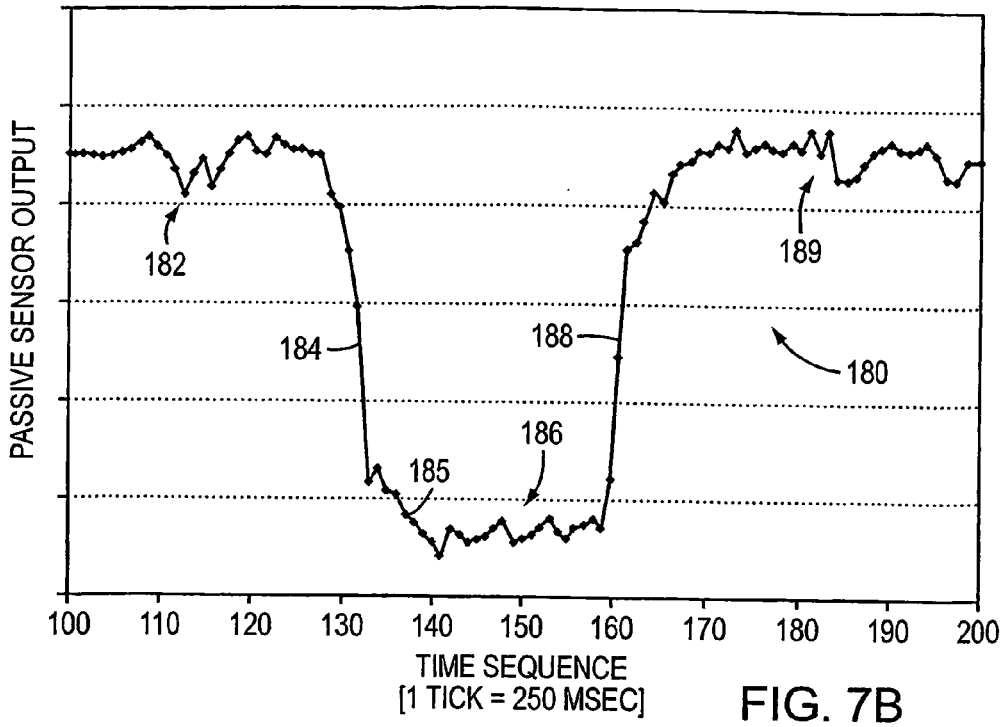

FIG. 7B shows optical data 180 for a passive sensor located on faucet 10 as shown in FIG. 2, wherein the faucet is installed above a dark sink. Graph 180 includes background regions 182 and 189. The user enters the field of view, which is shown in a transition region 184, followed by a less rapid transition region 185 and a substantially constant region 186, in which the user stays in the field of view. A substantially steep transition region 188 is due to the user leaving the field of view wherein the optical data eventually goes back to the background value of region 182, as shown in region 189.

Figure 7C:
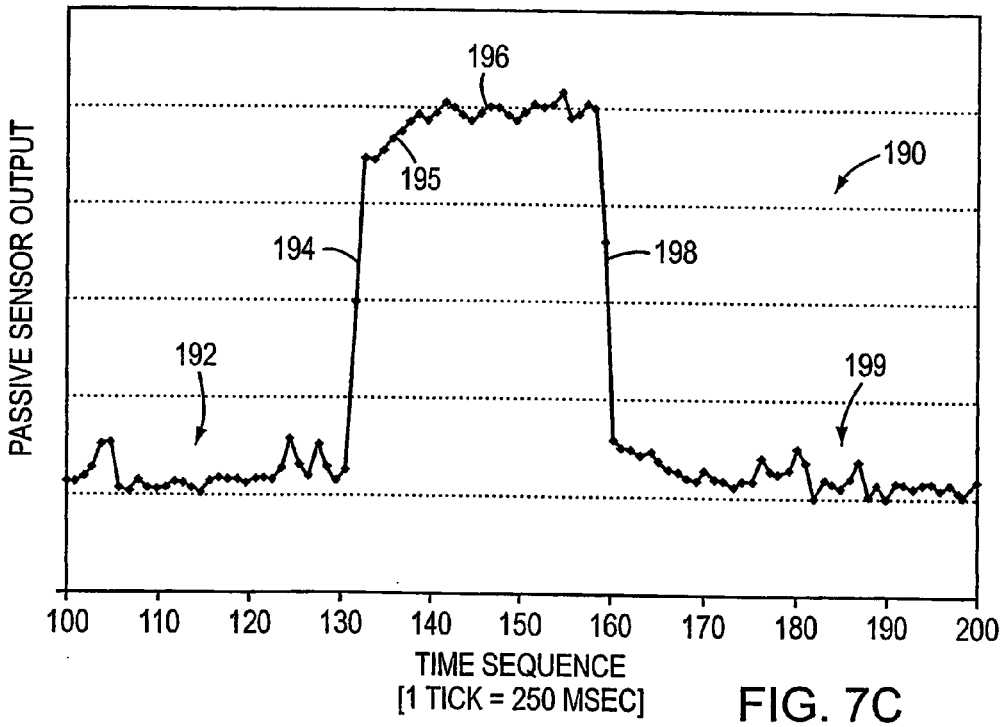

FIG. 7C shows optical data measured by a passive optical sensor located on faucet 10, shown in FIG. 2, wherein this faucet is mounted above a reflective sink. The optical data 190 shows initially a background value region 192, followed by a sharp transition region 194 and another transition region 195. While the user is within the field of view washing his or her hands, the optical data stays substantially constant, as shown by region 196, followed by a sharp transition region 198 caused by the user's departure. The optical data goes back to the background value as shown by region 199.

Optical data graphs 180 and 190 exhibit two transition regions for the user entering the field of view. The first transition region (region 184 or 194) is quite steep, while the second transition region (region 185 or 195) is less steep, enabling a better detection. Further improvement of detection is achieved by the combination of the measured optical data patterns 150, 170, 180 and 190, using several passive sensors as described above.

Figure 8:
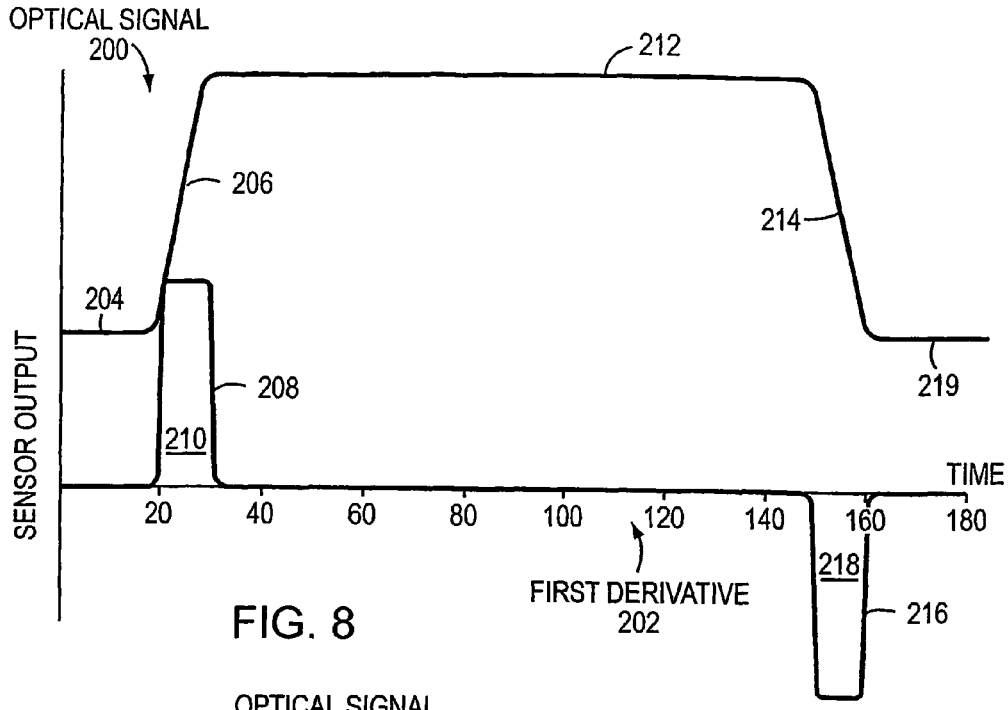
FIGS. 8, 8A, 8B, 8C, 8D and 8E illustrate different variations of optical signals for passive sensors and the signal evaluation by differentiating the optical data.
Figure 8A:
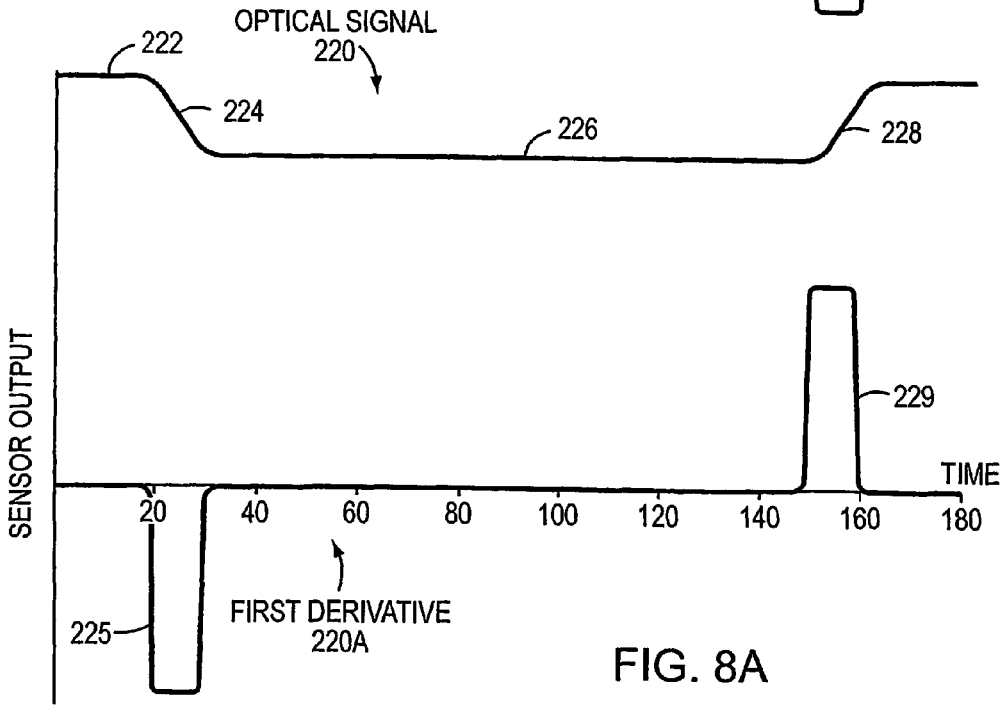
Figure 8B:
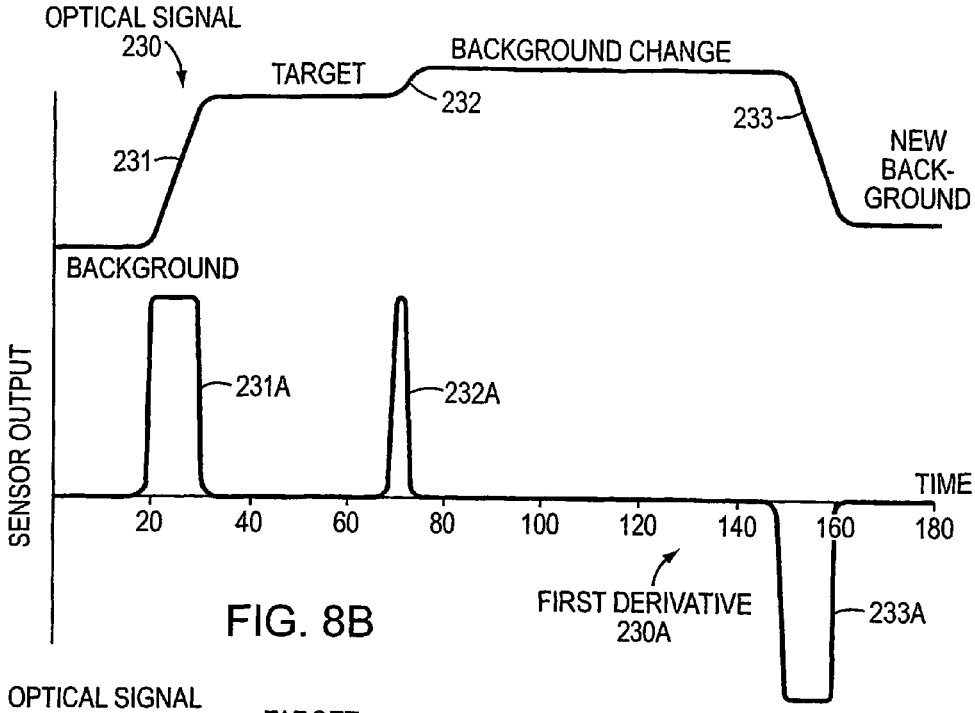
Figure 8C:
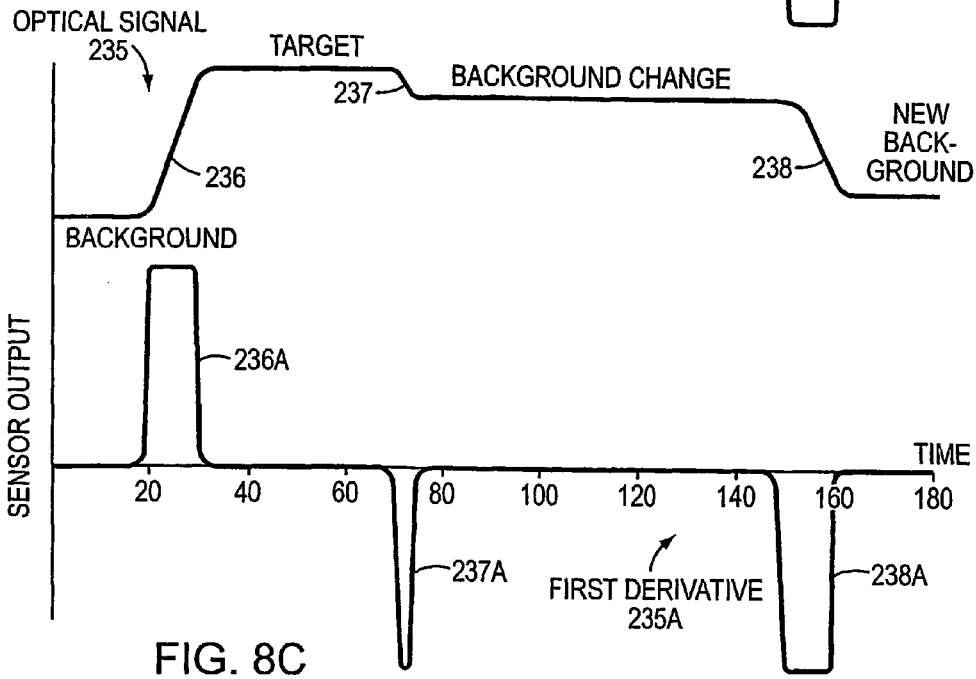
Figure 8D:
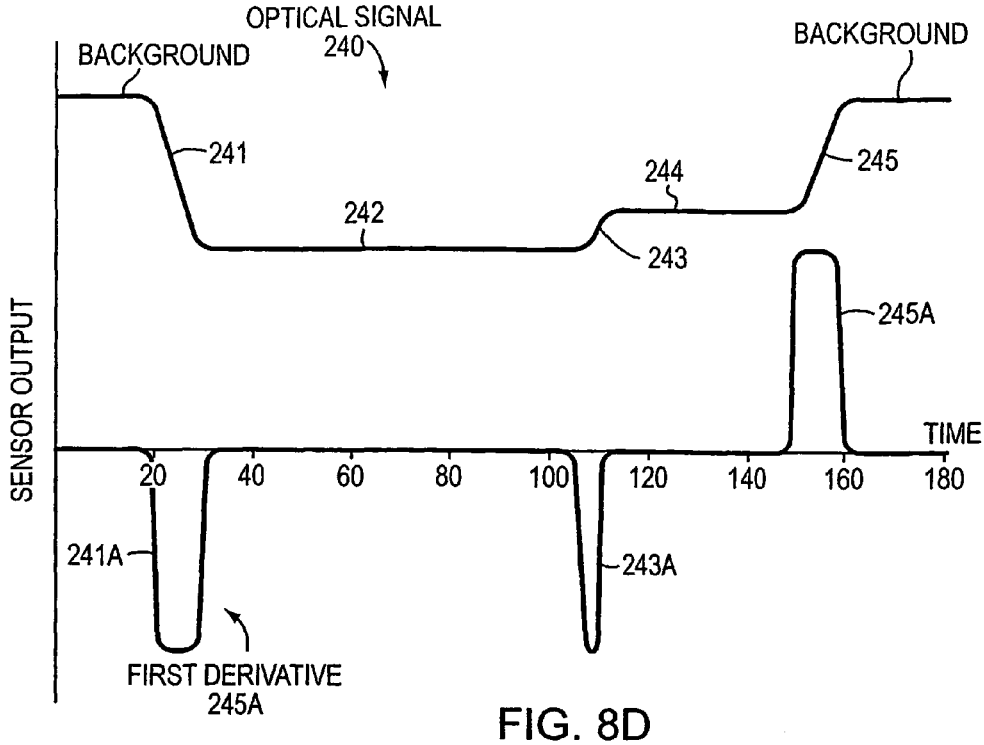
Figure 8E:
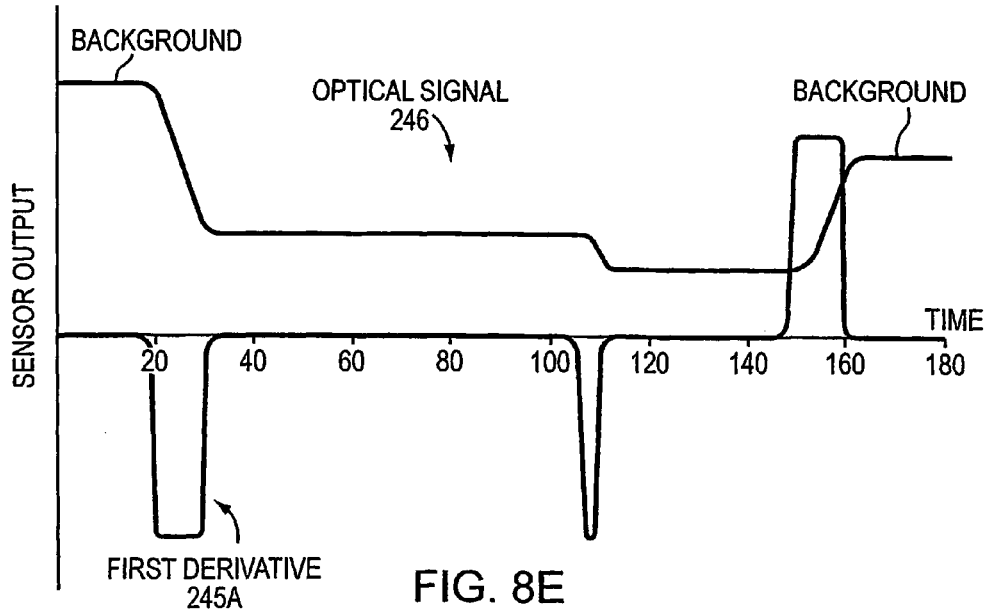

FIGS. 8 through 8E illustrate different types of optical signals modeled for the above-described passive sensor. These modeled data are used to illustrate operation of the detection algorithm for different fields of view and situations where a user enters such a field of view. Each graph shows the modeled optical signal and the first derivative of this signal, enhancing the transition between various states.

Referring to FIG. 8, graph 200 shows modeled optical signal roughly corresponding to the detected optical data shown in FIG. 7A. Optical signal graph 200 shows background values 204 and 219, transition in regions 206 and 214, and target region 212. The first derivative signal 202 exhibits two peaks, 209 and 216, corresponding to the transition regions 206 and 214, respectively. The area 210 on peak 208 corresponds to the transition energy, and similarly the area 218 on the peak 216 again corresponds to the transition energy from the detection state 212 to background state 219.

FIG. 8A shows a modeled optical signal with transitions, similar as optical signal 200, but in this case the target causes an increased amount of ambient light detected by the passive sensor. Optical signal 220 includes background region 222, transition regions 224 and 228, and target region 226. First derivative signal 220A includes two transition peaks 225 and 229, which again have an area corresponding to the energy of the transitions, 224 and 228.

FIGS. 8B and 8C show modeled optical signals that include not only target detection region, but also a change in background levels that can also be measured and used by the algorithms described below. Optical signal 230 includes 3 transitions, 231, 232, and 233, between the background level, the background change level, and a new background level, respectively. The first derivative signal 230A includes peaks 231A, 232A and 233A, corresponding to the transitions.

FIG. 8C shows similar modeled optical signal 235, which now includes a reduced background region after transition 237. The transition regions 236, 237, and 238 can be resolved using the first derivative signal 235A, which exhibits peaks 236A, 237A, and 238A.

FIGS. 8D and 8E show similar optical signals 240 and 246, modeled for a reflecting target that increases the amount of light arriving at the passive sensor. As described above, transition regions 241, 243, and 245 can be resolved using the first derivative signal 240A, exhibiting peaks 241A, 243A and 245A.

We note that, as shown in FIGS. 7-7C, the time scale of changes in the background level are either very slow (e.g. changing sun level over the course of sunset), or very fast (e.g., someone switching off room light). The noise levels have a similar time scale as transition, but do not typically have symmetry or asymmetry with a target time delay sandwiched in between as required by Target. If there is a level differential between clear and target, then there will be an asymmetric transition pattern of the derivative of the time signal with a target delay in between. (Target situation 1.)

If the clear and target have similar light levels then there will be a symmetric transition pattern with a target delay in between. (Target situation 2.) There is a requirement for a minimum and maximum target delay time (i.e., $0<t_0$ and it is unlikely that a target will stay longer than $t_1$, for valid time t, $t_0<t<t_1$.) The background and noise levels can be superimposed to transition target and clear levels at any time. The noise levels may or may not mask signal levels (transition target clear).

The algorithm measures light level at the preset intervals and can use filter measurement to reduce measurement and background noise. Then, the algorithm takes the derivative of detected optical signal. The algorithm may executes the following:

If not in transition then adjust long term average of noise level.

If current sample goes above noise level then.

Assume transition started add level to energy of current transition

Mark time of start of transition

Change sampling time if necessary

If in transition and sample still above noise level

Add level to energy of current transition

If in transition and sample falls below noise level

Check if time scale of transition is in range. If yes, push transition time and energy onto software stack. Else no transition erase energy, time associated reset sampling time If transition with similar energy symmetric or un-symmetric is found in stack that happened between $t_0$ and $t_1$ time ago than FLUSH and erase entire stack Check stack for any transitions longer than $t_1$ in stack and erase.

Other detection algorithms can use various numerical algorithms such as stochastic algorithms (e.g., Kalman filter) or various predictive algorithms (e.g., Jacobi algorithm) to detect the transitions from background level to target level, from a background level to an intermediate level, or from a target level from an intermediate level or a new background level. The use of the stochastic algorithm and the predictive algorithm is particularly useful when the passive sensors are used to control a faucet, where the decision time is limited. That is, a user expects to receive water within a second from the time he or she places his or her hands under the faucet. If there is a delay in water delivery, the user will think that the faucet is out of order. On the other hand, when using passive sensors with the bathroom flushers a time delay is acceptable because a user cannot usually exit the field of view and a new user cannot enter the field of view in a second. Therefore, the delay in flush initiation is acceptable.

Figure 9:
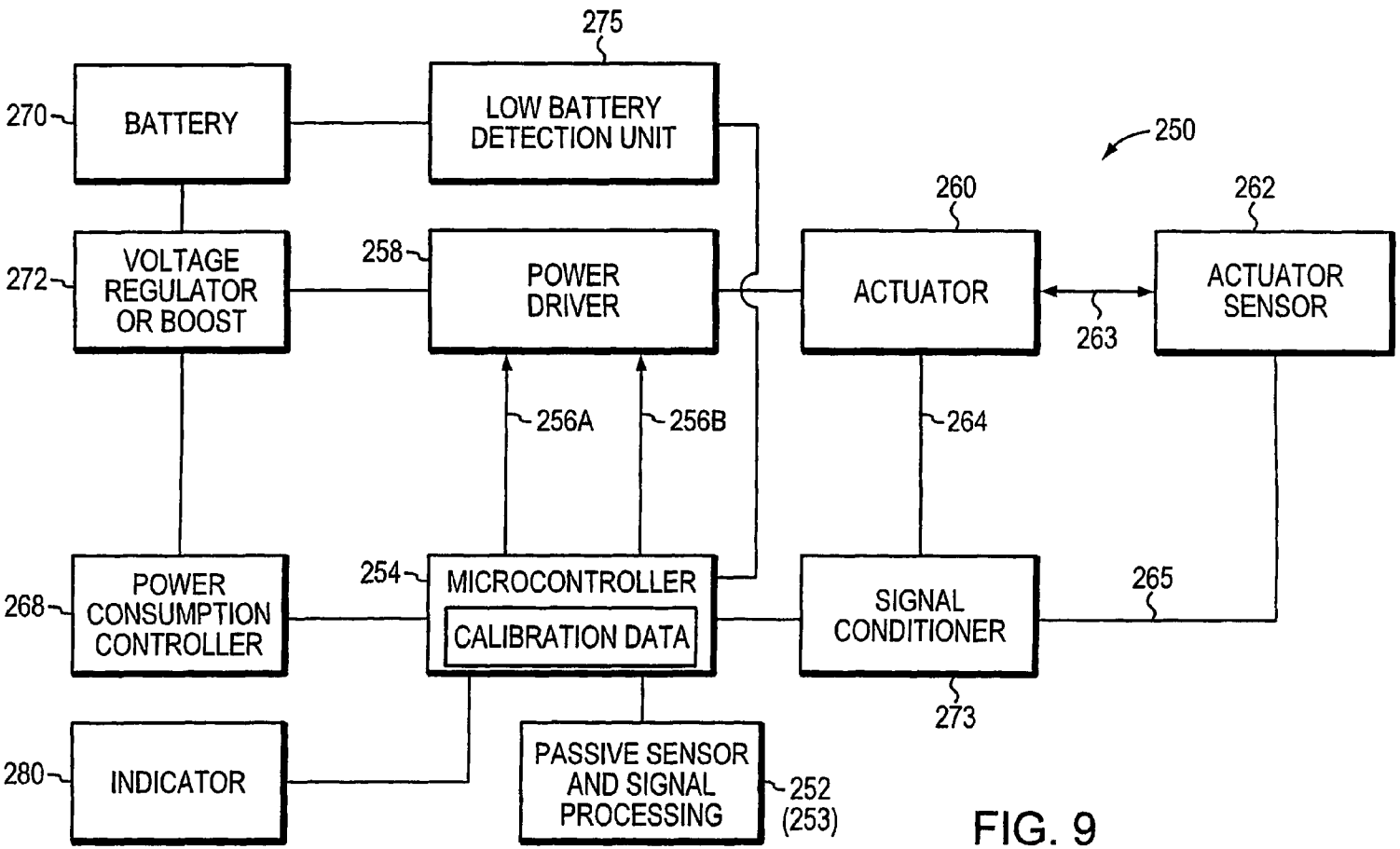
FIG. 9 is block diagram of a control system for controlling a valve operating the automatic faucet systems of FIGS. 1 through 2C, or bathroom flushers of FIGS. 4 and 4A.

FIG. 9 schematically illustrates control electronics 250, powered by a battery 270. Control electronics 250 includes battery regulation unit 272, no or low battery detection unit 275, passive sensor and signal processing unit 252, and the microcontroller 254. Battery regulation unit 272 provides power for the whole controller system. It provides 6.0 V power through 6.0V power 1 to "no battery" Detector; it provides 6.0 V power to low battery detector; it also provides 6.0 V to power driver 258. It provides a regulated 3.0 V power to microcontroller 254.

"No battery" detector generates pulses to microcontroller 254 in form of "No Battery" signals to notify microcontroller 254. Low Battery detector is coupled to the battery/power regulation through the 6.0V power. When power drops below 4.2V, the detector generates a pulse to the microcontroller (i.e., low battery signal). When the "low battery" signal is received, microcontroller will flash indicator 280 (e.g., an LED) with a frequency of 1 Hz, or may provide a sound alarm. After flushing 2000 times under low battery conditions, microcontroller will stop flushing, but still flash the LED.

As described in connection with FIG. 9, passive sensor and signal processing module 252 converts the resistance of a photoresistor to a pulse, which is sent to microcontroller 254 through the charge pulse signal. The pulse width changes represent the resistance changes, which in turn correspond to the illumination changes. The control circuit also includes a clock/reset unit that provides clock pulse generation, and it resets pulse generation. It generates a reset pulse with 4 Hz frequency, which according to the clock pulse, is the same frequency. The reset signal is sent to microcontroller 254 to reset the microcontroller or wake up the microcontroller from sleep mode.

A manual button switch may be formed by a reed switch, and a magnet. When the button is pushed down by a user, the circuitry sends out signal to the clock/reset unit through manual signal IRQ, then forces the clock/reset unit to generate a reset signal. At the same time, the level of the manual signal level is changed to acknowledge to microcontroller 254 that it is a valid manual flush signal.

Referring still to FIG. 9, control electronics 250 receives signals from optical sensor unit 252 and controls an actuator 260, a controller or microcontroller 254, an input element (e.g., the optical sensor), a solenoid driver 258 (power driver) receiving power from a battery 270 regulated by a voltage regulator 272. Microcontroller 254 is designed for efficient power operation. To save power, microcontroller 254 is initially in a low frequency sleep mode and periodically addresses the optical sensor to see if it was triggered. After triggering, the microcontroller provides a control signal to a power consumption controller 268, which is a switch that powers up voltage regulator 272 (or a voltage boost 272), optical sensor unit 252, and a signal conditioner 273. (To simplify the block diagram, connections from power consumption controller 268 to optical sensor unit 252 and to signal conditioner 273 are not shown.)

Microcontroller 254 can receive an input signal from an external input element (e.g., a push button) that is designed for manual actuation or control input for actuator 260. Specifically, microcontroller 254 provides control signals 256A and 256B to power driver 258, which drives the solenoid of actuator 260. Power driver 258 receives DC power from battery and voltage regulator 272 regulates the battery power to provide a substantially constant voltage to power driver 258. An actuator sensor 262 registers or monitors the armature position of actuator 260 and provides a control signal 265 to signal conditioner 273. A low battery detection unit 275 detects battery power and can provide an interrupt signal to microcontroller 254.

Actuator sensor 262 provides data to microcontroller 254 (via signal conditioner 273) about the motion or position of the actuator's armature and this data is used for controlling power driver 258. The actuator sensor 262 may be an electromagnetic sensor (e.g., a pick up coil) a capacitive sensor, a Hall effect sensor, an optical sensor, a pressure transducer, or any other type of a sensor.

Preferably, microcontroller 254 is an 8-bit CMOS microcontroller TMP86P807M made by Toshiba. The microcontroller has a program memory of 8 Kbytes and a data memory of 256 bytes. Programming is done using a Toshiba adapter socket with a general-purpose PROM programmer. The microcontroller operates at 3 frequencies ($f_c$=16 MHz, $f_c$=8 MHz and $f_s$=332.768 kHz), wherein the first two clock frequencies are used in a normal mode and the third frequency is used in a low power mode (i.e., a sleep mode). Microcontroller 254 operates in the sleep mode between various actuations. To save battery power, microcontroller 254 periodically samples optical sensor unit 252 for an input signal, and then triggers power consumption controller 268. Power consumption controller 268 powers up signal conditioner 273 and other elements. Otherwise, optical sensor unit 252, voltage regulator 272 (or voltage boost 272) and signal conditioner 273 are not powered to save battery power. During operation, microcontroller 254 also provides indication data to indicator 280. Control electronics 250 may receive a signal from the passive optical sensor or the active optical sensor described above. The passive optical sensor includes only a light detector providing a detection signal to microcontroller 254.

Low battery detection unit 275 may be the low battery detector model no. TC54VN4202EMB, available from Microchip Technology. Voltage regulator 272 may be the voltage regulator part no. TC55RP3502EMB, also available from Microchip Technology (http://www.microchip.com). Microcontroller 254 may alternatively be a microcontroller part no. MCU COP8SAB728M9, available from National Semiconductor.

Figure 9A:
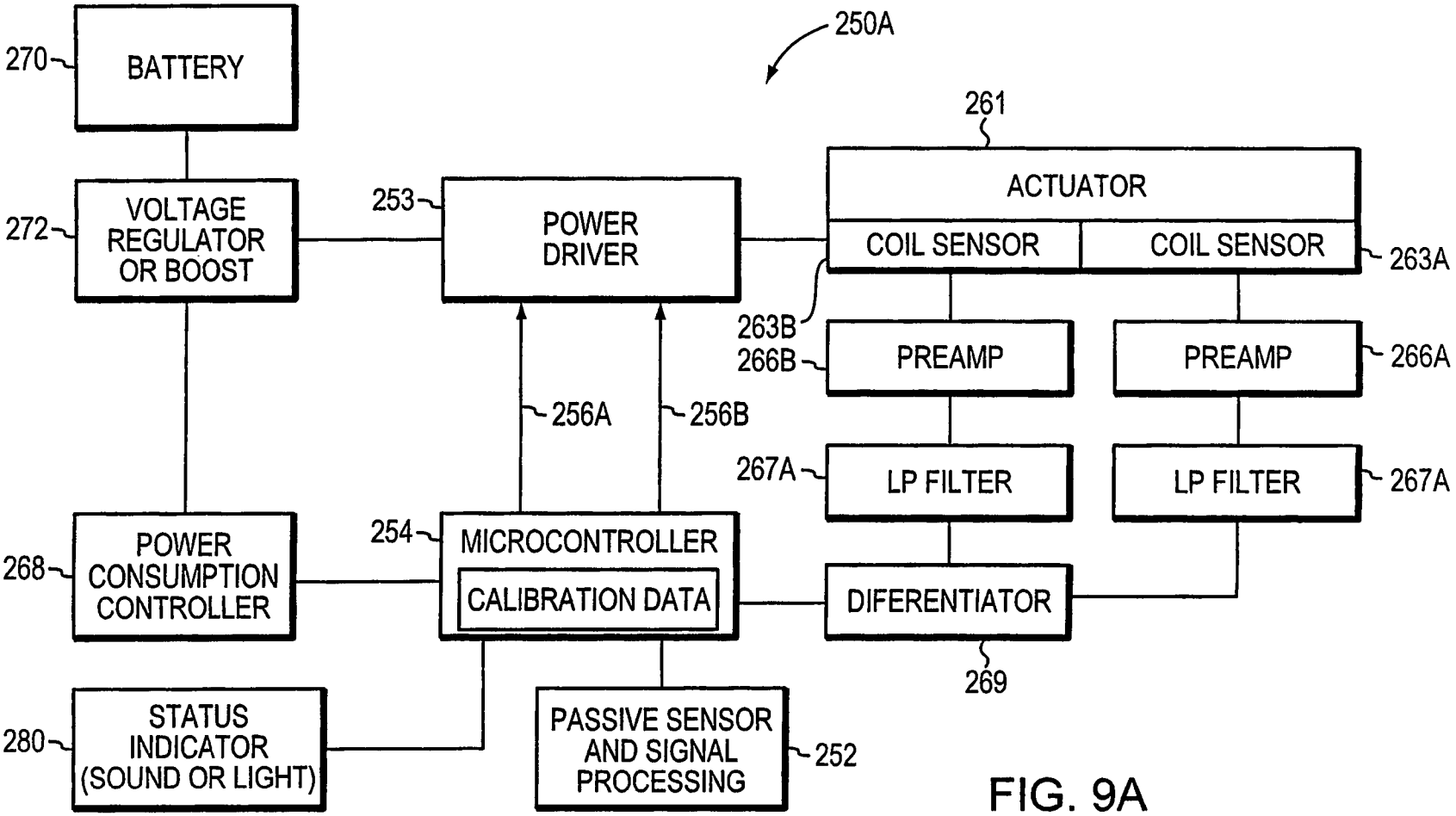
FIG. 9A is block diagram of another control system for controlling a valve operating the automatic faucet systems of FIGS. 1 through 2C, or bathroom flushers of FIGS. 4 and 4A.

FIG. 9A schematically illustrates another embodiment of control electronics 250. Control electronics 250A receives signals from optical sensor unit 252 and controls actuator 261. As described above, the control electronics also includes microcontroller 254, solenoid driver 258 (i.e., power driver), voltage regulator 272, and a battery 270. Solenoid actuator 261 includes two coil sensors, 263A and 263B. Coil sensors 263A and 263B provide a signal to the respective preamplifiers 266A and 266B and low pass filters 267A and 267B. A differentiator 269 provides the differential signal to microcontroller 254 in a feedback loop arrangement.

To open a fluid passage, microcontroller 254 sends OPEN signal 256B to power driver 258, which provides a drive current to the drive coil of actuator 261 in the direction that will retract the armature. At the same time, coils 263A and 263B provide induced signal to the conditioning feedback loop, which includes the preamplifier and the low-pass filter. If the output of a differentiator 269 indicates less than a selected threshold calibrated for the retracted armature (i.e., the armature did not reach a selected position), microcontroller 254 maintains OPEN signal 256B asserted. If no movement of the solenoid armature is detected, microcontroller 254 can apply a different (higher) level of OPEN signal 256B to increase the drive current (up to several times the normal drive current) provided by power driver 258. This way, the system can move the armature, which is stuck due to mineral deposits or other problems.

Microcontroller 254 can detect the armature displacement (or even monitor armature movement) using induced signals in coils 263A and 263B provided to the conditioning feedback loop. As the output from differentiator 269 changes in response to the armature displacement, microcontroller 254 can apply a different (lower) level of OPEN signal 256B, or can turn off OPEN signal 256B, which in turn directs power driver 258 to apply a different level of drive current. The result usually is that the drive current has been reduced, or the duration of the drive current has been much shorter than the time required to open the fluid passage under worst-case conditions (that has to be used without using an armature sensor). Therefore, the control system saves considerable energy and thus extends the life of battery 270.

Advantageously, the arrangement of coil sensors 263A and 263B can detect latching and unlatching movement of the actuator armature with great precision. (However, a single coil sensor, or multiple coil sensors, or capacitive sensors may also be used to detect movement of the armature.) Microcontroller 254 can direct a selected profile of the drive current applied by power driver 258. Various profiles may be stored in microcontroller 254, and may be actuated based on the fluid type, the fluid pressure (water pressure), the fluid temperature (water temperature), if the time actuator 261 has been in operation since installation or last maintenance, a battery level, input from an external sensor (e.g., a movement sensor or a presence sensor), or other factors. Based on the water pressure and the known sizes of the orifices, the automatic flush valve can deliver a known amount of flush water.

Figure 9B:
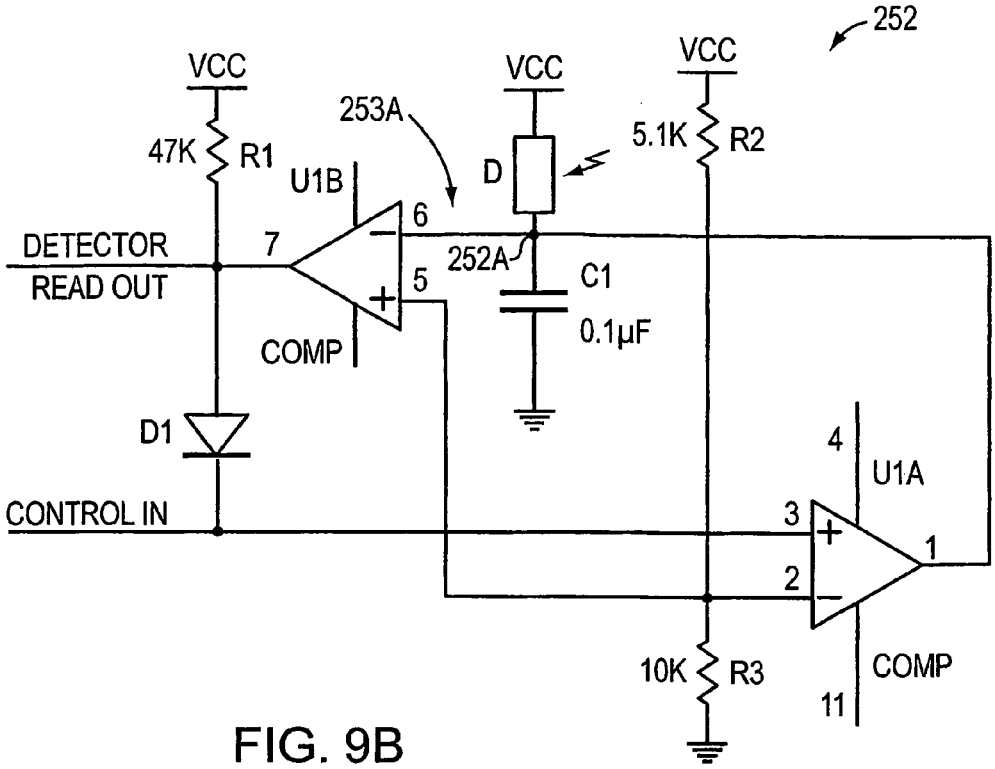
FIG. 9B is a schematic diagram of a detection circuit used with passive optical sensors used in the automatic faucet system or the automatic flusher system.

FIG. 9B provides a schematic diagram of a detection circuit 252 used for the passive optical sensor 50. The passive optical sensor does not include a light source (no light emission occurs) and only includes a light detector that detects arriving light. As compared to the active optical sensor, the passive sensor enables reduced power consumption since all power consumption related to the IR emitter is eliminated. The light detector may be a photodiode, a photoresistor or some other optical element providing electrical output depending on the intensity or the wavelength of the received light. The light receiver is selected to be active in the range or 350 to 1,500 nanometers and preferably 400 to 1,000 nanometers, and even more preferably, 500 to 950 nanometers. Thus, the light detector is not sensitive to body heat emitted by the user of faucet 10, or body heat emitted by the user located in front of flushers 100 or 100A.

The detection circuit 252, used by the passive sensor enables a significant reduction in energy consumption, and includes a detection element D (e.g., a photodiode or a photoresistor), two comparators (U1A and U1B) connected to provide a read-out from the detection element upon receipt of a high pulse. Preferably, the detection element is a photoresistor. The voltage $V_{cc}$ is +5 V (or +3V) received from the power source. Resistors $R_2$ and $R_3$ are voltage dividers between $V_{cc}$ and the ground. Diode $D_1$ is connected between the pulse input and output line to enable the readout of the capacitance at capacitor $C_1$ charged during the light detection.

Preferably, the photoresistor is designed to receive light of intensity in the range of 1 lux to 1000 lux, by appropriate design of optical lens 54 or the optical elements shown in FIGS. 6 through 6E. For example, optical lens 54 may include a photochromatic material or a variable size aperture. In general, the photoresistor can receive light of intensity in the range of 0.1 lux to 500 lux for suitable detection. The resistance of the photodiode is very large for low light intensity, and decreases (usually exponentially) with the increasing intensity.

Referring still to FIG. 9B, the default logic at CONTROL IN is "high". Comparator U1A output a "high" to node 252A. And DETECTOR READ OUT is logic "low". Microcontroller output logic 0 from CONTROL IN; upon receiving a "high" pulse at the input connection, comparator U1A receives the "high" pulse and provides the "high" pulse to node A. At this point, the corresponding capacitor charge is read out through comparator U1B to the output 7. The output pulse is a square wave having a duration that depends on the photocurrent that charged capacitor $C_1$ during the light detection time period: Thus, microcontroller 34 receives a signal that depends on the detected light. The CONTROL IN is kept "low" long enough to fully discharge C1. Then, CONTROL IN returns to "high." Comparator U1A also follows the input, node 252A starts to charge capacitor C1, and comparator U1B output will turn to "high". Microcontroller starts a timer when DETECTOR READ OUT turns to "high". When C1 (node A) voltage reach ⅔ Vcc, U1B output will turn to "low", stop timer. The timer value (or the pulse width from DETECTOR READ OUT) is depends on the photocurrent. This process is being repeated to measure the ambient light. The square wave has duration proportional to the photocurrent excited at the photo resistor. The detection signal is in a detection algorithm executed by microcontroller 254.

By virtue of the elimination of the need to employ an energy-consuming IR light source used in the active optical sensor, the system can be configured so as to achieve a longer battery life (usually many years of operation without changing the batteries). Furthermore, the passive sensor enables a more accurate means of determining presence of a user, the user motion, and the direction of user's motion.

The preferred embodiment as it relates to which type of optical sensing element is to be used is dependent upon the following factors: The response time of a photoresistor is on the order or 20-50 milliseconds, whereby a photodiode is on the order of several microseconds, therefore the use of a photoresistor will require a significantly longer time form which impacts overall energy use.

Furthermore, the passive optical sensor can be used to determine light or dark in a facility and in turn alter the sensing frequency (as implemented in the faucet detection algorithm). That is, in a dark facility the sensing rate is reduced under the presumption that in such a modality the faucet or flusher will not be used. The reduction of sensing frequency further reduces the overall energy consumption, and thus this extends the battery life.

Figure 9C:
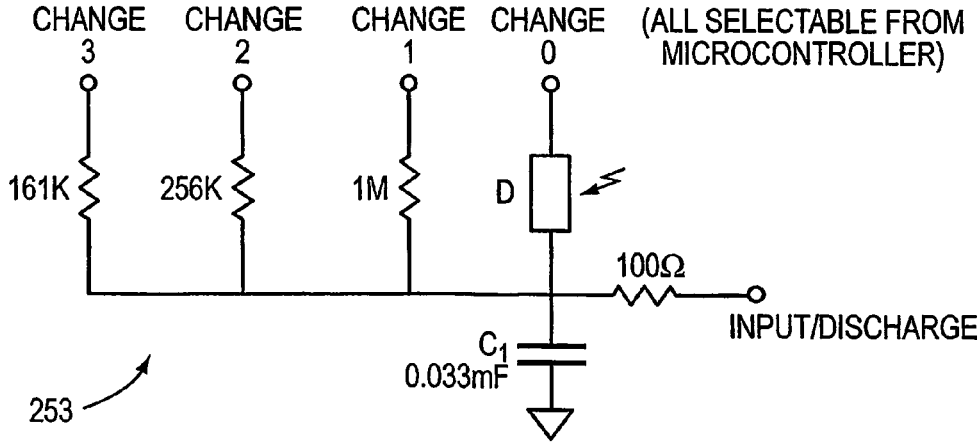
FIG. 9C is a schematic diagram of another detection circuit used with passive optical sensors used in the automatic faucet system or the automatic flusher system.

FIG. 9C provides a schematic diagram of an alternatice detection circuit 253. This circuit may be used directly connected to the microcontroller, as describe below. This circuit may be included into circuit 252 (FIG. 9B at 253A). In FIG. 9C, three resistors are connected in parallel with photodetector D. Providing VCC to CHARGE1, or CHARGE2, or CHARGE3 at different light condition, is equivalent to different parallel resistors connected to photodetector D. Thus, this system can adjust the resolution of DETECTOR READ OUT.

The microcontroller reads out optical data as follows: First, all charge pins are set to Hi-Z (Just like no Vcc, no current goes to capacitor). Then, the input/dicharge pin is set as output, and is set "low" so that capacitor $C_1$ discharges from this pin. Next, the discharge pin is charged as input. At this moment, the logic of this pin is "low". Then, the charge pin is set to "Hi." The microcontroller selects charge 0, or charge 0+charge X (X=1, 2, 3). Thus, the current goes from charge 0+chargeX to the capacitor, and at the same time the timer is started. The capacitor voltage will increase, when it reaches ⅔ Vcc (which is the microcontroller power supply, and it's also I/O output voltage). At this point the logic in input/discharge pin will turn from "low " to "high" and the timed is stoped. The timer value corresponded to the charge time, which is depend on charge current (that goes through photodetector D, and through one or several parallel resistors). By selecting different parallel resitors and charge together with photocell, the timer resolution can be adjusted and the maximum charge time can be limited.

Figure 10:
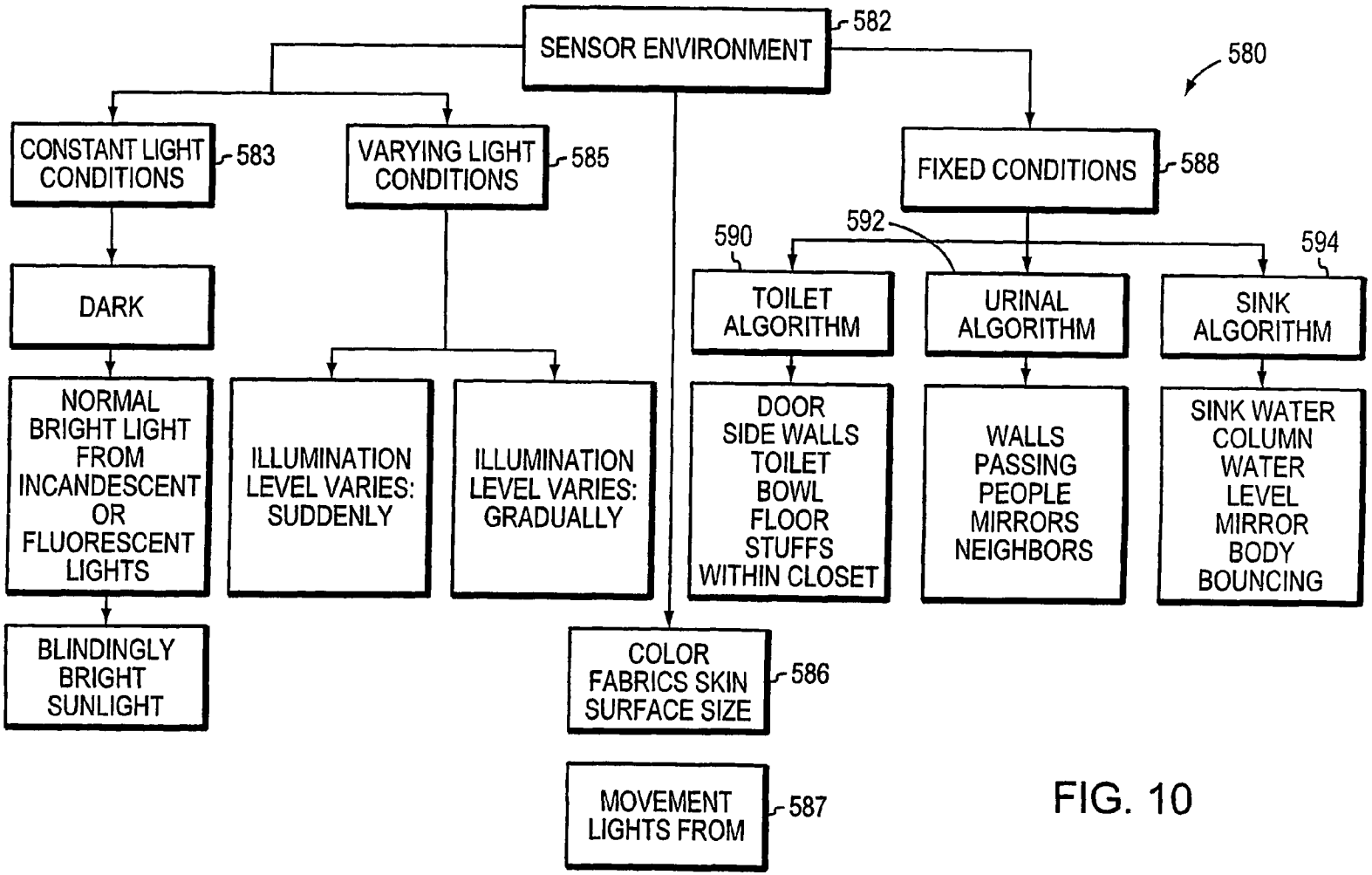
FIG. 10 is a block diagram that illustrates various factors that affect operation and calibration of the passive optical system.

FIG. 10 illustrates various factors that affect operation and calibration of the passive optical system. The sensor environment is important since the detection depends on the ambient light conditions. If the ambient light in the facility changes from normal to bright, the detection algorithm has to recalculate the background and the detection scale. The detection process differs when the lighting conditions vary (585), as shown in the provided algorithms. There are some fixed conditions (588) for each facility such as the walls, toilet locations, and their surfaces. The provided algorithms periodically calibrate the detected signal to account for these conditions. The above-mentioned factors are incorporated in the following algorithms.

Figure 11:
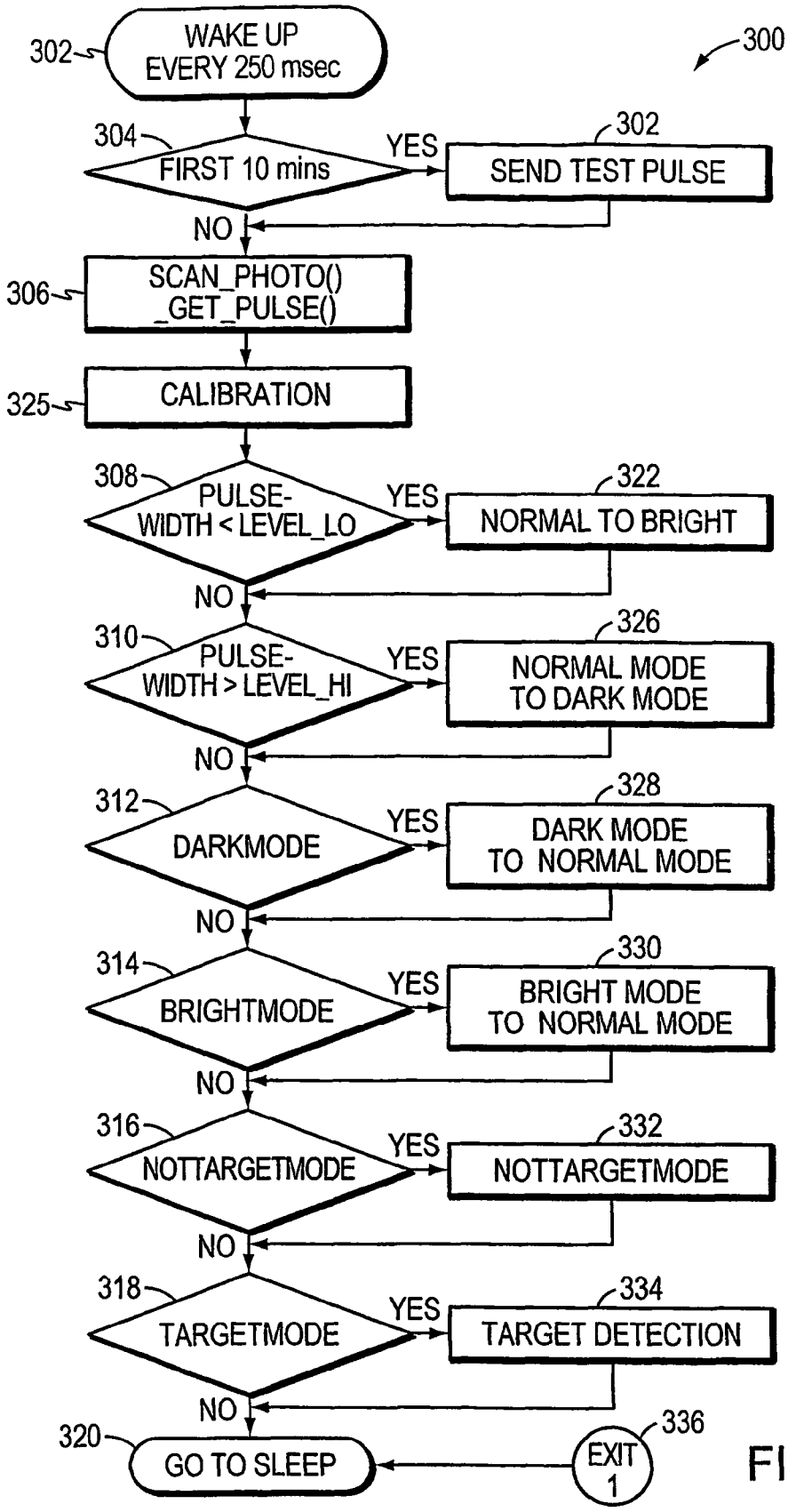
FIGS. 11, 11A, 11B, 11C, 11D, 11E, 11F, 11G, 11H, 11H-I, 11H-II, 11H-III, 11I, 11I-I, 11I-II, 111-III show a flow diagram of an algorithm processing data detected by a passive sensor operating an automatic flusher system.
Figure 11A:
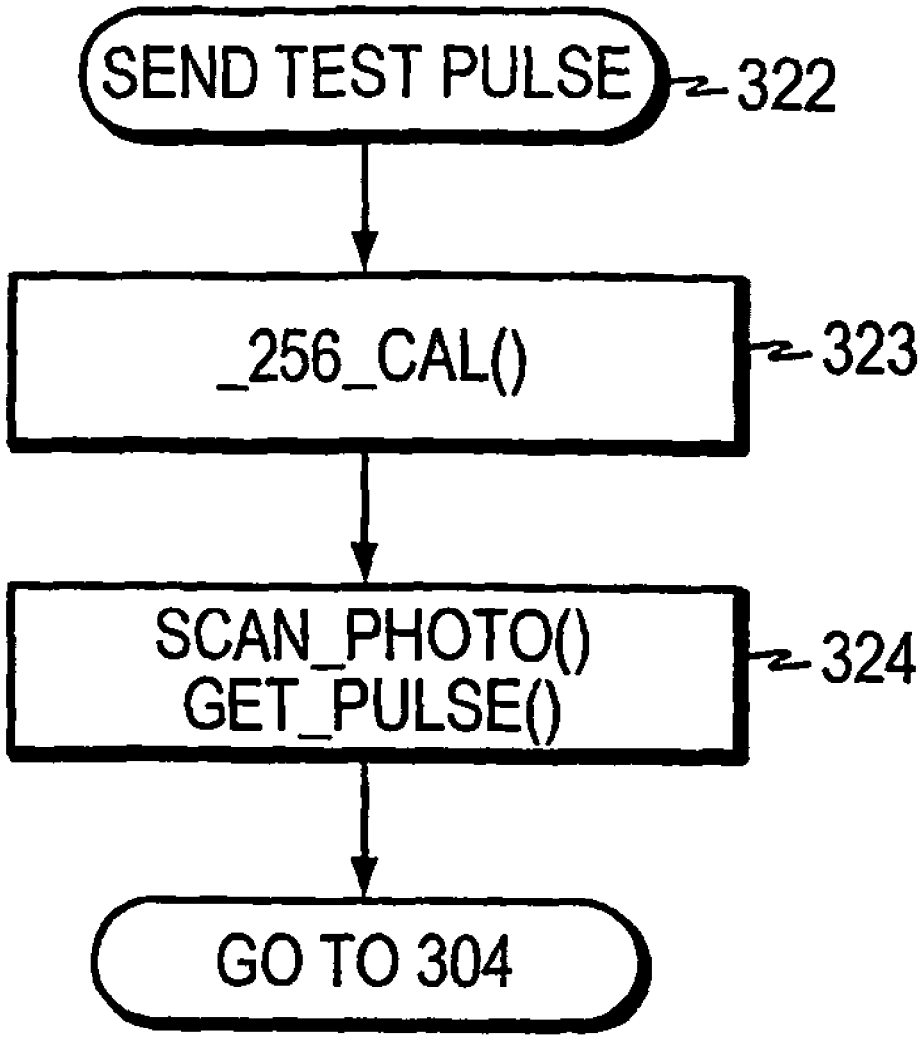
Figure 11B:
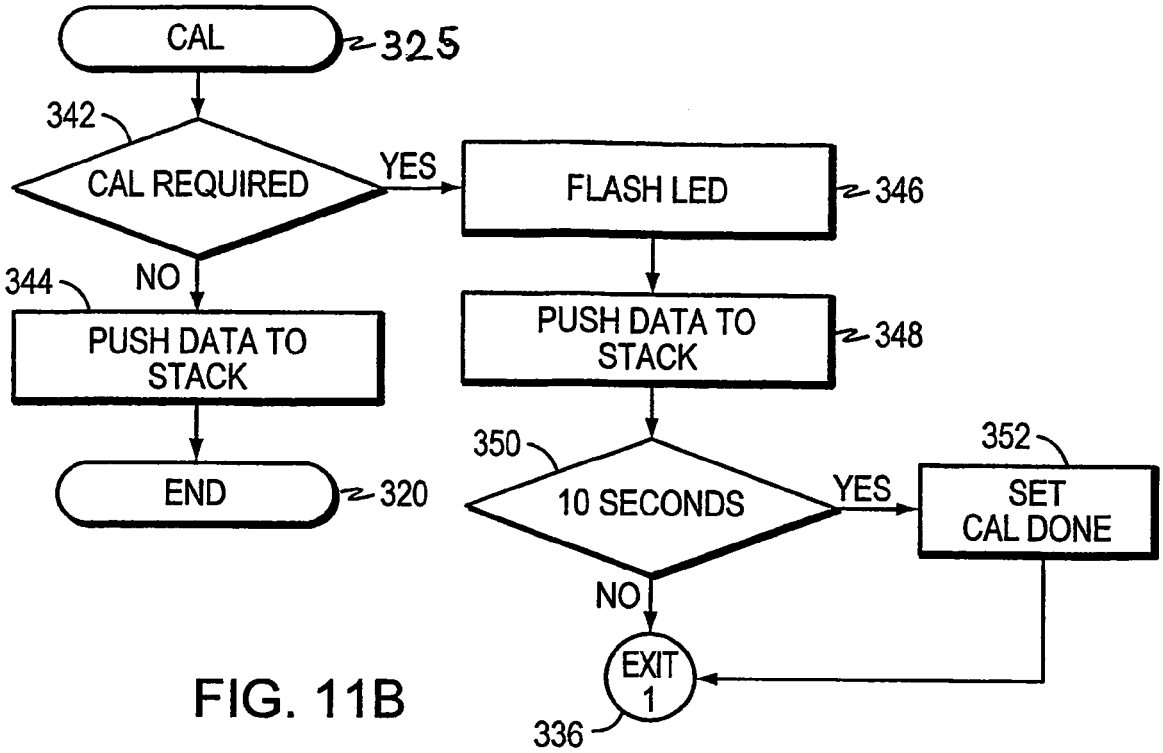
Figure 11C:
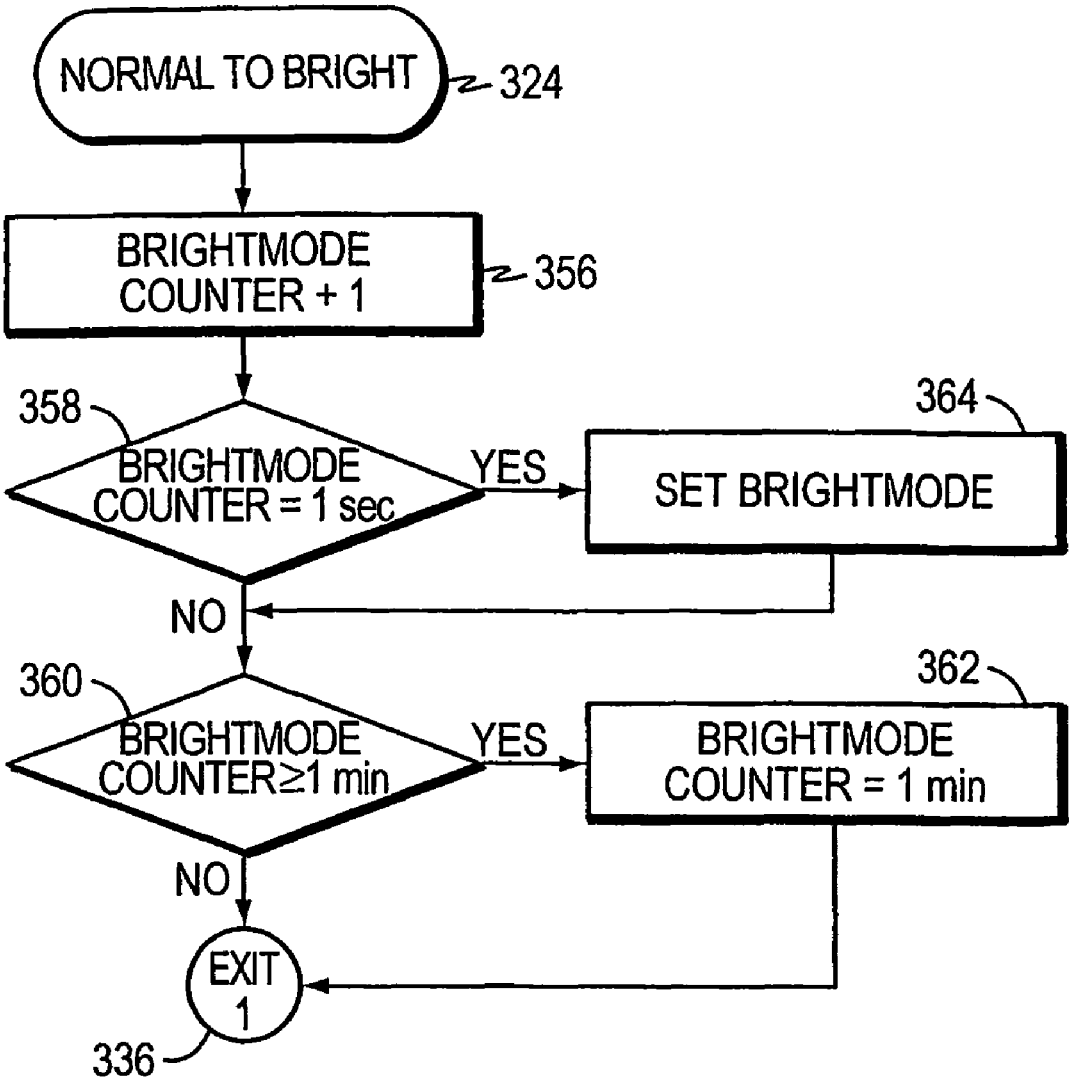
Figure 11D:
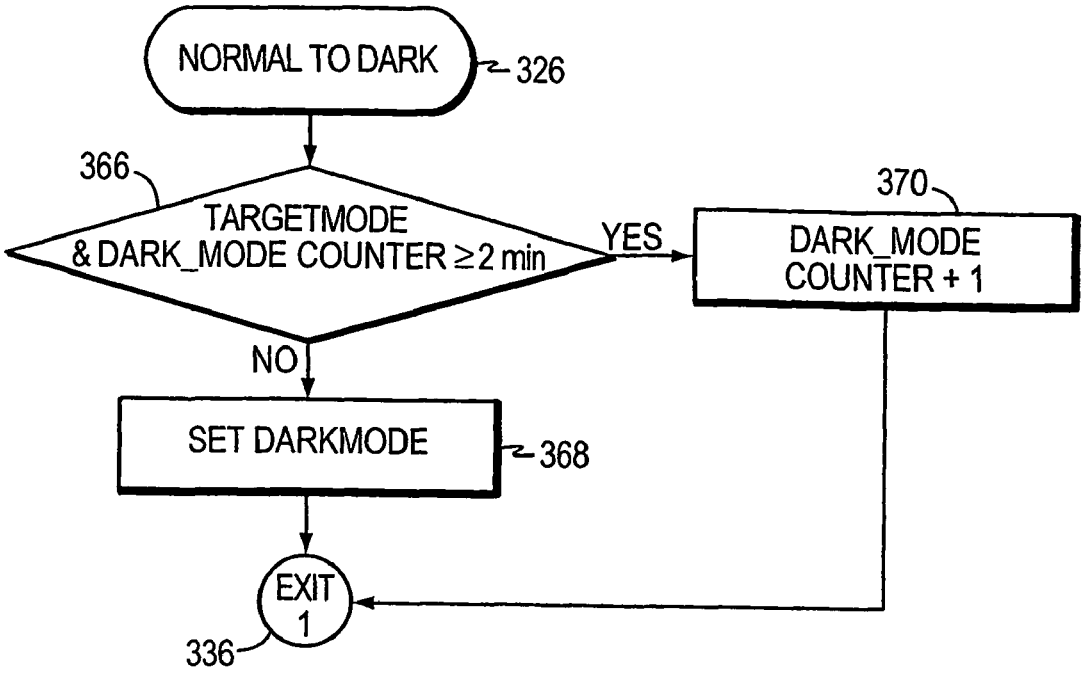
Figure 11E:
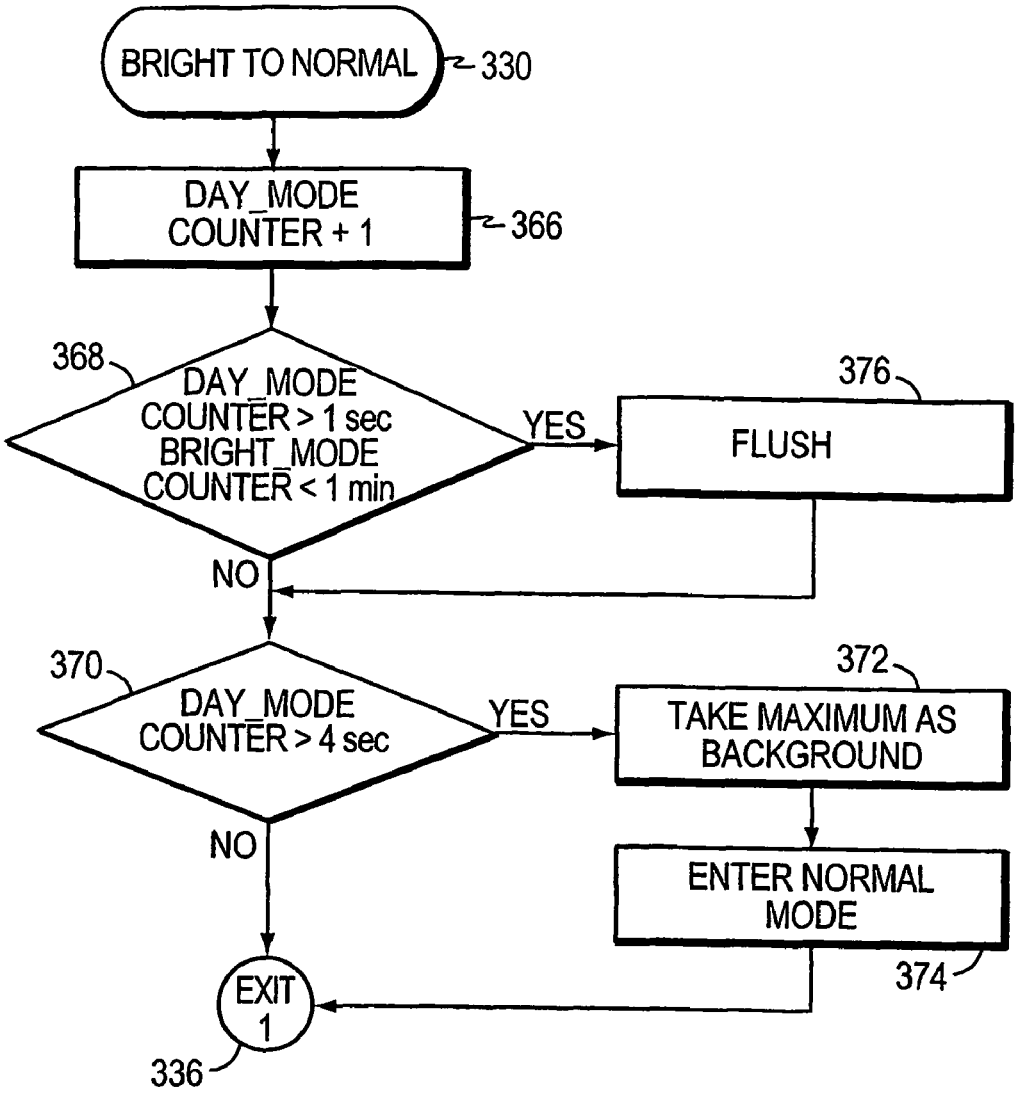
Figure 11F:
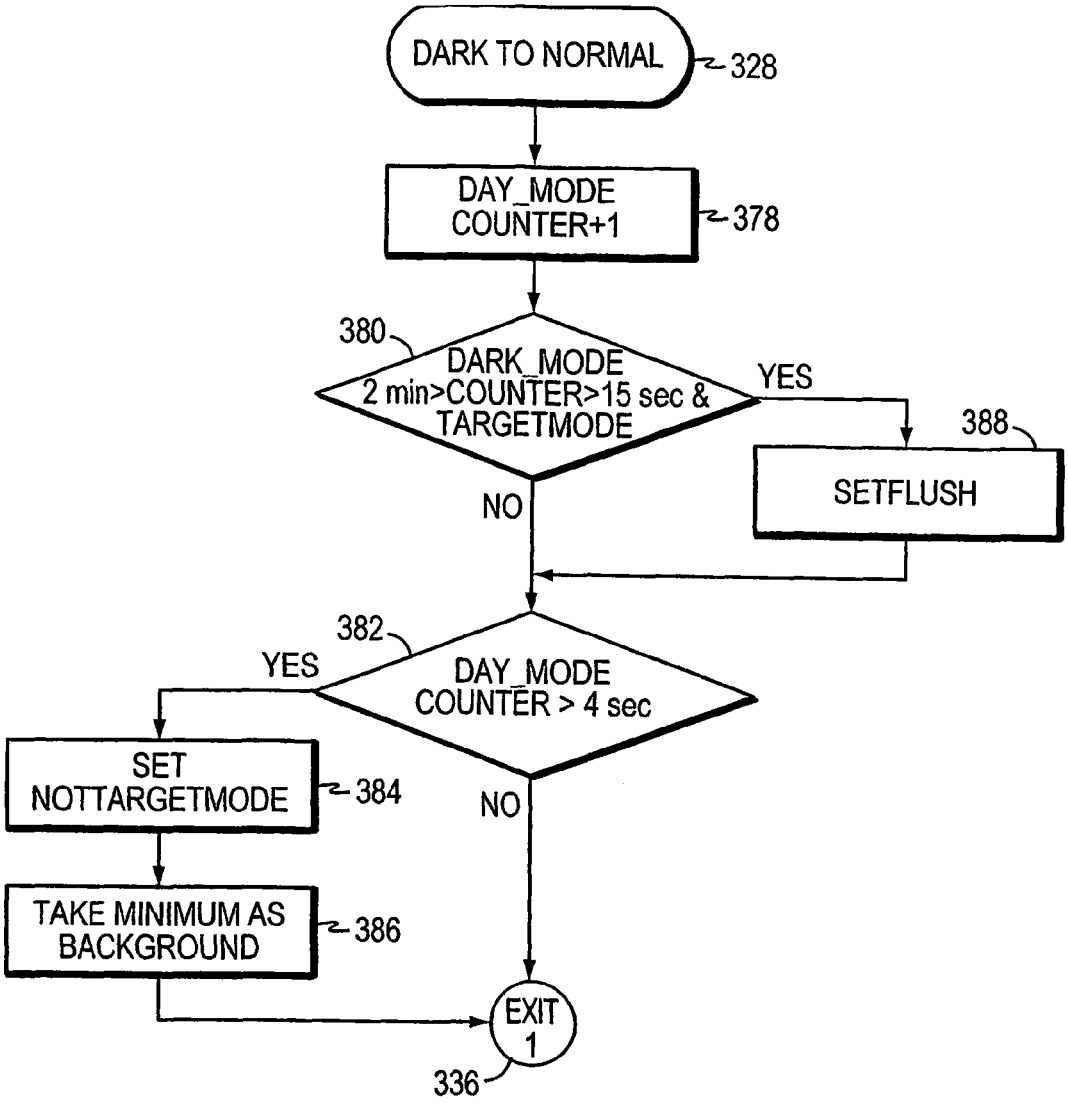
Figure 11G:
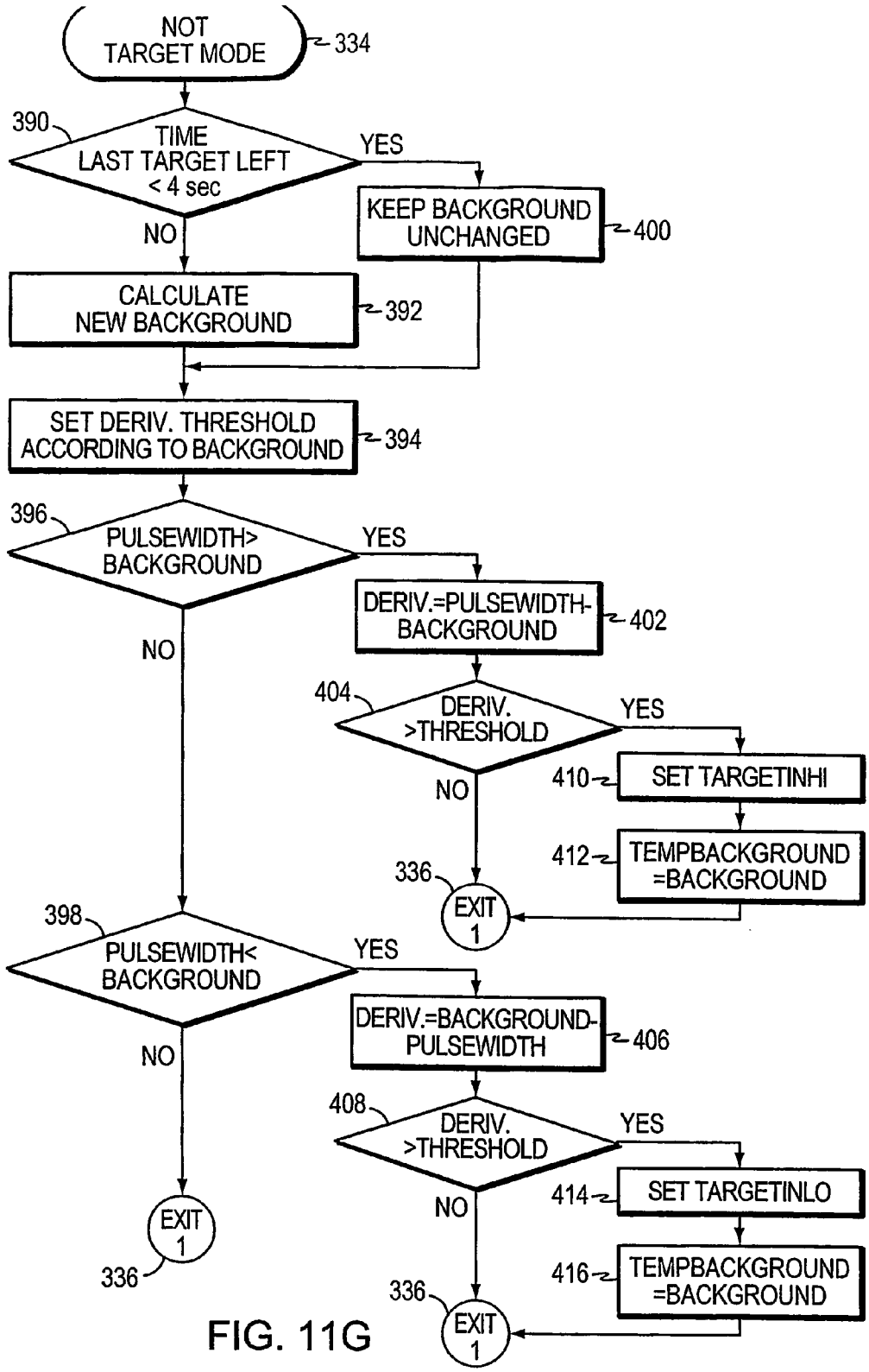
Figure 11H:
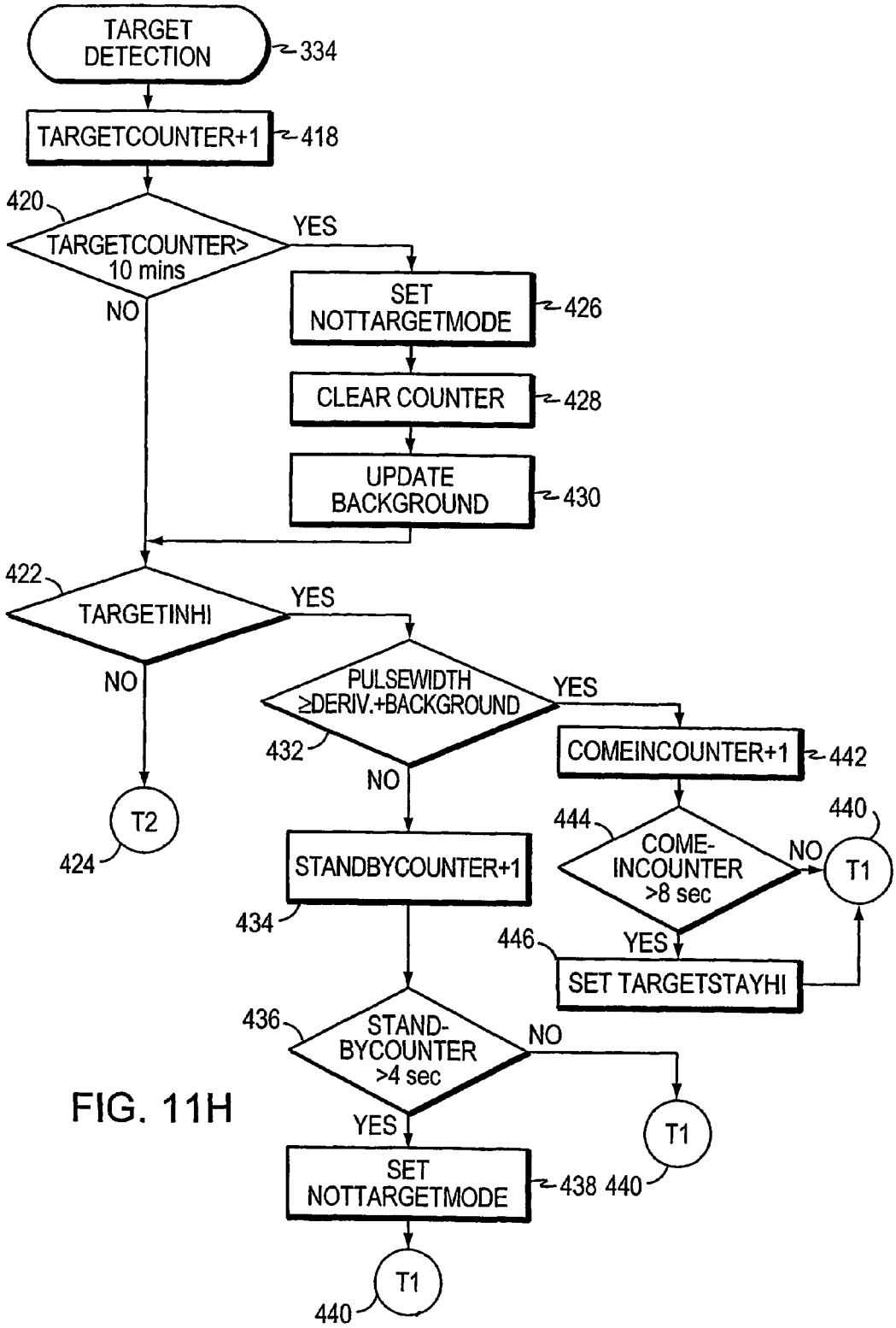
Figure 11I:
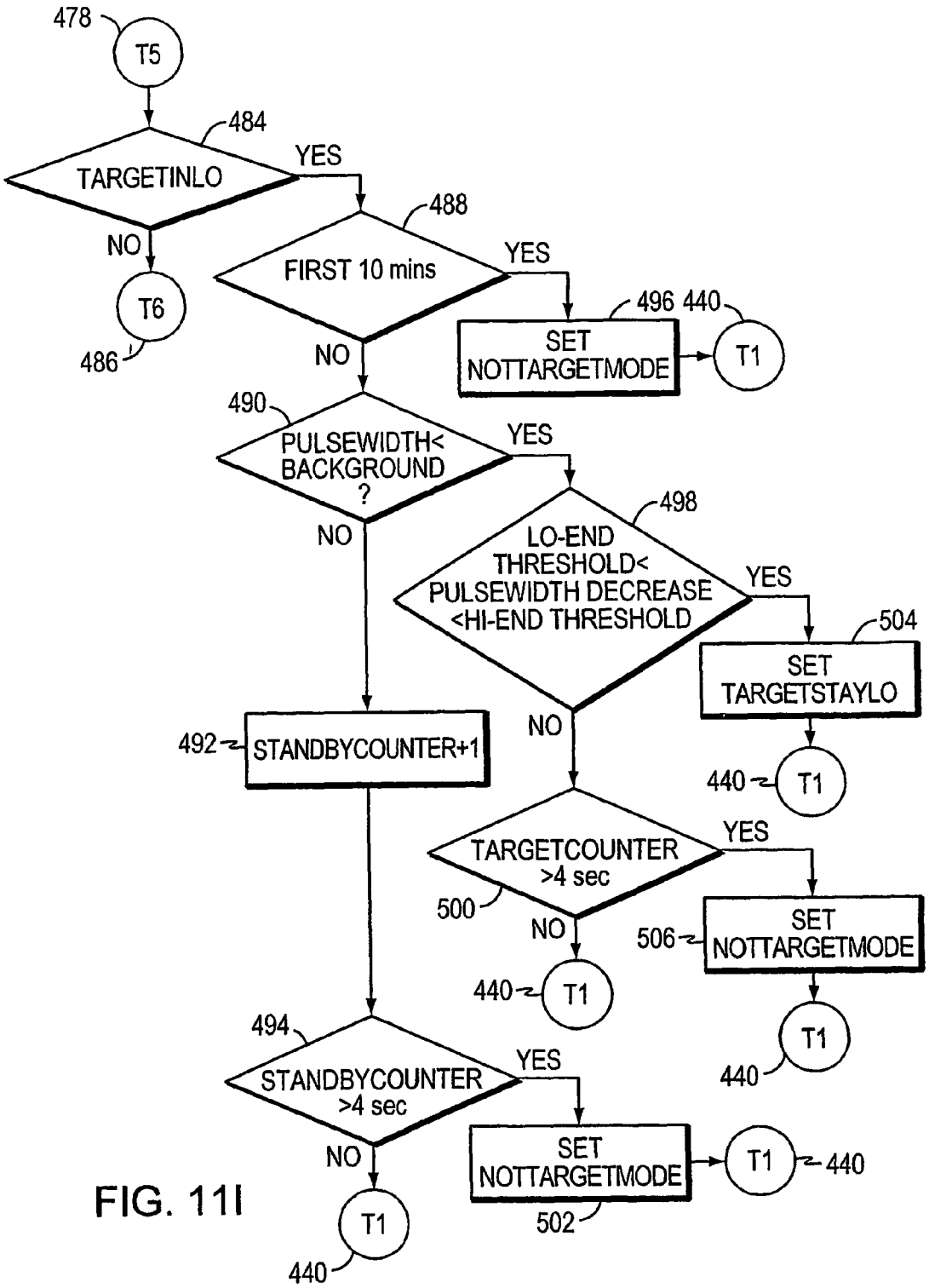

Algorithm 300 (shown in FIG. 11-FIG. 11I-III, works on the principles that a user in front of a facility changes light levels being detected by the photoreceiver from those levels when no user was present. A user passing by the facility will not trigger water flow, while the user remaining in front of the facility within a selected field of view will trigger water flow. The system looks for a change in light levels to signify the presence of a user. This change is called "a derivative threshold", and varies according to ambient light levels. Light conditions change as a user moves to or away from the facility, but remain substantially stable during use (while the movement of hands under a faucet will change the light level). Therefore, stability range in the detected light levels can determine whether or not a user is within the facility.

When a target moves closer, the target blocks the ambient light, especially if wearing dark, light-absorbent clothes, so that the passive sensor will detect less light while the target comes into the field of view. At this time, pulse width measurements will go up. More light will be detected as the target leaves the facility, so pulse width will go down. On the other hand, if the target wears a specific-kind of reflective clothes the passive sensor will detect more light while the target comes into the field of view. The microcontroller measures a smaller pulse width (i.e., more light) as the target enters the field of view, and a longer pulse width (less light) as the target moves away. Both possibilities are covered in the presented algorithms.

The algorithm has a preferred (working) light range for a photoresistor or a photodiode, where it best detects a target's presence. In the present embodiment, the photoresistor has a working light range from approximately 100 counts to 27,000 counts. Below this range, there is BrightMode, where background light is too bright to detect a target properly (i.e., the pulse width is below 100 counts). Above this range, there is DarkMode, where background light is too dark to detect a target (i.e., the pulse width is above 27,000 counts). Within the preferred light range, algorithm 300 has two options: NotTargetMode and TargetMode. In the NotTargetMode, no target has been detected, but the system checks for an approaching target. In the TargetMode, a target has already been detected, and the system looks for changes from one stage to another to determine if water flow should be initiated. These stages include: TargetIn, TargetStay, TargetOut, and TargetLeave.

In the TargetIn stage, light changes show the target is moving towards the sensor. In the TargetStay stage, stable light levels show the target is staying in front of the sensor for a particular period of time. In the TargetOut stage, the target is moving, and changes in light indicate that the light conditions are returning to those measured previously (or other background conditions). Finally, in the TargetLeave stage, light conditions are stable and have basically returned to those previous to the target being detected (or other background conditions).

The microcontroller constantly cycles through the algorithm, where it wakes up every 250 milliseconds (step 302, or another preset time), determines the mode it was last in (based on a previously set flag), and evaluates what mode it should go to based on the measured pulse width (p), similarly to algorithm 600 in FIG. 12, described below. The system determines how long a particular light level has been stable by counting the number of cycles between one action and another to determine the time.

Referring to FIG. 11, if the system is within its first 10 min. after installation (304), it sends a test electrical control pulse from the microprocessor (step 322, FIG. 11A) to check that the capacitor and the read out circuit are working properly. This occurs only the first time after installation. Then, it gets the pulse width (306), and goes on to calibrate the system (FIG. 11B), where if the calibration is required (342), it takes data and stores it (step 348) for the next 10 sec. (350). Once this is done, it sets the calibration as done (352), and whenever it goes through the beginning of the algorithm, it skips steps 346-352. At step 342, if calibration is not required, it keeps 1 sec. worth of data (344). The system then starts anew.

In regular use the microcontroller wakes up and scans the photoresistor at step 306. It checks the current light level, as well as its previous status, set based on light levels, to make a decision as to what action to take next. The system generally works best in usual ambient light, so it has been set up with predefined thresholds for its working light range. In algorithm 540, these are preferably approximately 44 lux for a high (Level_Hi), and 33,000 lux for a low level (Level_Lo). If the light range is between 44 to 33,000 lux, and had not been darker or brighter in the previous cycle, the system remains in one of two modes: TargetMode or NotTargetMode, with this last one being the default. Therefore, if within the working light range, the microcontroller will go directly through steps 308 and 310. In steps 312 and 314 it finds out whether it had previously been in darker (DarkMode) or brighter (BrightMode) conditions than those in its working range. If this is not the case, and no targets have been detected, it will go into NotTargetMode at steps 316 to 332 (FIG. 11G, discussed further below).

Changes in light that cause the microcontroller to be outside its working light range also play a role in this system. Referring to FIG. 11, if the pulse width is less than Level_Lo (308), the system goes into Normal to Bright Mode (324, FIG. 11C). That is, the system will go from the working light range to a bright light range. Similarly, if the reverse is true, and the pulse width is greater than Level_Hi, the system will go into a Normal to Dark Mode instead (326, FIG. 11D).

In Normal to Bright mode, FIG. 11C, the BrightModeCounter starts counting each cycle that the system is in BrightMode (356). Once it detects it has been in BrightMode for 1 sec. (358), it sets BrightMode at step 364. If it counts for 1 min. or longer (step 360), it sets the BrightModeCounter to one minute, since that is its maximum range (362). If it has not yet counted for 1 sec., and it goes through steps 358 and 360, the microcontroller exits to start a new cycle.

In Normal to Dark mode, FIG. 11D, if the system had previously been in TargetMode and the DarkModeCounter's time is 2 mins. or less (366), the DarkModeCounter adds one cycle to its count (370), and exits once more. However, if this is not the case in step 366, the system sets DarkMode (step 368), and exits.

If the light had been outside the working range in previous cycles but now is within it, however, the system moves through steps 308 and 310 in FIG. 11 to Dark Mode to Normal Mode (312) or Bright Mode to Normal Mode (314), to recover NotTargetMode, where it can look for a new target. If the unit had been previously set to DarkMode (312) it moves to DarkMode to NormalMode (step 328, FIG. 11F). The DayModeCounter adds one cycle to its count (378), and the microcontroller then checks whether the system had been in TargetMode previously, and whether the time it had been under DarkMode is between 2 mins. and 15 sec. (step 380). It does this because if the unit had detected a target, and it has been in the dark for less than 2 min., the change in light could have been due to a person standing before the unit, and therefore it sets a precautionary flush (388). If the DayModeCounter counts for more than 4 sec. (382), the microcontroller sets NotTargetMode once again (step 384), sets the minimum value of light detected in the past 4 sec. as the background (386), and exits to begin cycling anew. If the DayModeCounter did not count for longer than 4 sec., the microcontroller will simply exit-and begin anew.

If the unit had been in BrightMode and now is within the working light range (314 to 330 and FIG. 11E), it will add one count to the DayModeCounter in step 366, and then check whether the DayModeCounter has been counting for longer than 1 sec., and the BrightModeCounter (set in step 356 as the unit was in BrightMode) had been counting for less than 1 min. (step 367). If this is the case, it causes a precautionary flush (376), since the brightness detected could have been due to a user reflecting light for less than 1 min. (In general, these precautionary flushes are more suited for use with a urinal.)

If the conditions in step 368 are not the case, the microcontroller checks whether the DayModeCounter has been counting for longer than 4 sec. (369). If not, it exits to begin cycling anew. If it did count for over 4 sec., it will take the maximum value of light detected in the last 4 seconds as the background (step 372), set NotTargetMode in step 374, exit and start cycling anew.

If the unit had been in DarkMode and is now within the working light range (312 to 330 and FIG. 11F), it will add one count to the DayModeCounter in step 378, and then check whether the system had been in TargetMode previously, and whether the DarkModeCounter has been counting for longer than 15 sec. (step 380). If so, it will set a precautionary flush at step 388, and continue to step 382. If not, it will simply continue to step 382, where it will check if the DayModeCounter has been counting for longer than 4 sec. If so, it will set NotTargetMode, take the minimum value of light detected in the last 4 sec. as the background (step 384), and exit. If this is not the case, it will exit and start cycling again.

Referring to FIG. 11G, if the system had been in light range, it remains within working light range and there is no current target detection, it goes into NotTargetMode (step 334). If a target was detected in the last 15 cycles (given 250 msec. per cycle this is less than 4 sec.; step 390), the microcontroller will use its previously determined background light level (400); otherwise, it will reestablish it (392). The microcontroller will use the background to set a derivative threshold (394). The derivative threshold shows at what point a change of pulse width is likely to be large enough to signify a target coming close as opposed to a slight change in ambient light. In this system, different light levels within the working range have separate derivative thresholds. The working light range has been divided into eight intervals, each with a separate derivative threshold: From 100-2,000 counts, the threshold is 12.5%; from 2,000-4,000 counts, it is 12.5%; from 4,000-6,000 counts, it is 6.25%; from 6,000-8,000 counts, it is 6.25%; from 8,000-10,000 counts, it is 6.25%; for 10,000-15,000 counts, it is 6.25%; from 15,000-20,000 counts, it is 3.125%; and from 20,000-27,000 counts, it is 3.125%. For example, if the light level is in the range of 2,000-4,000 counts, if the change is greater than 12.5%, it is likely to be due to a target coming in. Otherwise, it may be simple background "noise."

Still referring to FIG. 11G, the microcontroller will then determine whether p for the current cycle has changed relative to that of the previous cycle, to determine whether there has been a change in light. If p increased, (meaning light decreased) it establishes the derivative (Deriv.) by determining the difference between p and background light levels (402) and in step 402 compares it to the threshold determined in step 394. If the change in light, or Deriv., is greater than the threshold, there is definitely less light being detected, likely due to a user coming in and blocking the light, so the microcontroller sets the mode as TargetMode at a stage of TargetInHi (410), saves the light level identified before it sensed a target as TempBackground (412), and exits to repeat the cycling.

However, a similar scenario can take place if a target, instead of blocking light when coming in, reflects it due to the clothes being worn. In that case, p would be less than the previous background (398), and the system would go through similar steps as described above (406 and 408) to determine that the Deriv. is greater than the threshold value. If that is the case, it is likely that the greater amount of light is due to a user coming in and reflecting light, so the microcontroller sets the mode as TargetMode at a stage of TargetInLo (414), saves TempBackground (416) and also exits. If no light change large enough to be a likely target is sensed in NotTargetMode, the system exits to continue cycling without changing the mode, and will continue scanning for a target as long as it remains within the working light range set.

Once the stage of TargetInHi or TargetInLo is set, and the microcontroller cycles once more, it will go to TargetMode (FIG. 11, steps 318 and 334), and enter step 334 as shown in FIG. 11H. The TargetCounter will add one count to determine how long the microcontroller has been in that stage (step 418). If the time the system has been in TargetMode has been less than 10 mins., it will continue through the cycle to step 422 (TargetInHi, FIG. 11H) or step 484 (TargetInLo, FIG. 11I). However, if it has been in that stage for longer than 10 mins. (or over 2,400 cycles), it will determine that the change in light is not due to a user coming towards the facility, but to some other circumstance. This change can be due to, for example, a light bulb from a room lamp suddenly burning out, so that light levels are now changed for an extended period. It will therefore set NotTargetMode (step 426), clear the TargetCounter (428), update the background light level (430), and go through the rest of the cycle until it reaches the end. Then it can start a new cycle and look for changes in light that signify a target.

Referring still to FIG. 11H, if the stage was set as TargetInHi for less than 10 min., and p for this cycle is greater or equal to Deriv. (set in step 402) and the background light, the microcontroller will add a one cycle count to its ComeInCounter (442), which determines how long ago a target may have come in. If all conditions remain the same, but it has not yet been 8 sec. that the target has been there (step 444), the microcontroller will exit and continue cycling until the ComeInCounter has counted above 8 sec., when it determines the target is staying and using the facility, due to the signal being stable. At this point, from step 444, it sets the stage as TargetStayHi in step 446. If p does not meet the conditions in step 432, the StandByCounter adds one cycle (434). If all conditions remain the same, and the StandByCounter counts more than 4 sec. (step 436), the change in light previously sensed may simply have been a temporary change due to, for example, someone standing or walking by the facility. Therefore, the microcontroller sets NotTargetMode (438) and exits.

If the potential target reflects light and was set as TargetInLo, the microcontroller will be at step 484 in FIG. 11I. If the system is within its first 10 min. after installation (step 488), it will set NotTargetMode (step 496), and restart cycling. After that period, if p is less than the background (step 490), or is still stable due to the presence of the user, and the change in p is higher than the Lo-end or lower than the Hi-end threshold (498), the microcontroller considers the change to be due to a target staying and using the facility, so it sets TargetStayLo (step 504) and exits the cycle. However, if the conditions of step 498 are not met, the microcontroller checks the TargetCounter set to count cycles at step 418 after TargetMode was set. If p is high for longer than 4 seconds without change (step 500), it is likely that the change detected previously was due to a temporary change in background light levels, and not to a user. Therefore, NotTargetMode is set (step 506), and the system exits.

If p is not lower than the background since first detecting the potential target (step 490), the StandByCounter begins to count here as well (492) to make sure that the change detected previously was not merely a change in light. If p is higher than the background for more than 4 sec. (step 494), the previously detected change was likely also a temporary change in background light, and the microcontroller sets NotTargetMode (step 502) and exits.

Referring to FIG. 11H-I, when the stage had been set as TargetStayHi (448), the microcontroller sets the background once more (step 452). It will now check for stability in the light change to verify that the target is truly leaving the facility, as small changes in p now could be simply due to the target moving around in the facility. If the target is leaving, the background level and TempBackground (see step 416) should be very close. The system first checks for decreases in p being greater than half of the difference between the current background and the TempBackground in step 454. This would mean that the target is moving out of the facility, and the microcontroller now sets TargetOutHi (step 458) and exits. However, if p increases, it checks whether this increase is greater than twice the difference between the current background and TempBackground (step 456). Increases in p could be due to changes in the background light, and have to be much greater than differences between the two background levels detected to be likely due to a target's movement. So, if this is the case, TargetInHi is set, because lower light levels mean the target is likely still moving in (step 460), and TempBackground is set as the current background once more (step 462) before exiting.

FIG. 11I-I shows the alternative, for when the target is reflecting light and is at TargetStayLo (508). If the TargetStayLo conditions have been the same, and the TargetCounter set at step 418 has counted for longer than 1 min. (step 512), the light conditions are not likely due to a target, but changes in the background light. Therefore, NotTargetMode is set (step 526) before exiting. If it is not yet one minute, however, the microcontroller checks whether the target is leaving and the light levels have changed. It does so by checking how close the current value of p is to the level of light before the target came into view: It first calculates what the change in the background has been due to the target coming into view (Delta, step 514): if the target is leaving, the light level should be close to TempBackground, and Delta should be small. Otherwise, the microcontroller does not consider the reflective target to be leaving. Therefore, the threshold (step 516), or difference between TempBackground and a quarter of Delta, should be close to the value of TempBackground. If p is above this new threshold of change, that is, it is darker once more, the target is likely to be leaving. So if p is now greater than that threshold (step 518), the target is leaving, and TargetOutLo is set (step 528) before exiting.

If p is not greater than the threshold set in 516 (step 518), the microcontroller sets threshold (step 520), calculates Delta in this case as the current background minus the current value of p (step 522), and checks whether this Delta is greater than the threshold (step 524). If this is the case, it sets TargetInLo (step 530), since it is likely that the changes being perceived are due to the target still coming in, and then it exits. If not (step 524), and none of the above conditions are met, it exits and begins anew.

Once the system has set the stage as TargetOutHi (464, FIG. 11H-II), it checks the difference between each pulse width for 6 cycles, or 1.5 sec. If p has not varied more than 40 counts in over 1.5 sec. (step 468), the target has left, so TargetLeaveHi is set (step 472), before exiting. However, if this is not the case, but as required in step 470, the Unstable Time is longer than 4 sec., or the decrease in p is now greater than three-quarters of the difference between the current background and TempBackground (i.e., p is very close to the original value before the target was detected), the user is likely to be in the process of leaving, but is taking a long time in doing so. If so, the microcontroller also sets TargetLeaveHi (step 474) and exits to begin the next cycle. If neither step 468's nor 470's conditions are met, the system exits to cycle once more.

For the parallel condition TargetOutLo (532, FIG. 11I-II), the microcontroller checks that p has not varied more than 40 counts in over 3 sec. (step 536), in which case, if the light conditions are now the same or +/−1.625% of the TempBackground (step 542), it sets TargetLeaveLo (step 546) and exits. If this is not the case, the system must consider an alternate option: changes detected earlier, where the light was increasing, could have been due to changes in ambient light only, and not to a target reflecting light. Therefore, the lower light levels detected now could be a new target blocking light while coming in, and for that reason the system sets TargetInHi as the state (step 544) before exiting.

Referring to FIG. 11H-III, once the system has determined that the target that had blocked light left (TargetLeaveHi stage, step 476) it sets up a flush (step 480), sets NotTargetMode once more (step 482) and exits, to be ready for the next target detected and be able to respond once more. For a reflective target that left (TargetLeaveLo, 548, FIG. 11I-III), the system also sets up a flush in step 552 and sets NotTargetMode (step 554) before exiting. If the system is not in the TargetLeaveLo stage, it also sets NotTargetMode (step 550) and exits to restart the next cycle and check for targets.

In each of the algorithms, there are three light conditions on which activity depends: bright, dark, and ambient light. As a general rule, the algorithms function best in ambient (or customary) light conditions, when changes in light due to users being nearby are most evident. Therefore, most activity occurs in ambient light conditions. In this case, when lower light levels are detected starting from ambient light, a user is likely blocking it, and is using the facility. When somewhat higher light levels are evident, a user is likely reflecting it, and is once again, likely using the facility.

As previously stated, the system functions using the principle that, not only will a user in front of the unit being used change the light level being detected, but that a user will have to remain stably in front of a unit in use. Therefore stability of the light conditions also plays a role in determining whether or not a user is nearby. Changes in light levels would be stable if a user is truly making use of the unit in question. Referring to FIGS. 12-12I, the microcontroller is programmed to execute a flushing algorithm 600 for flushing toilet 116 or urinal 120 at different light levels. Algorithm 600 detects different users in front of the flusher as they are approaching the unit, as they are using the toilet or urinal, and as they are moving away from the unit. Based on these activities, algorithm 600 uses different states. There are time periods between each state in order to automatically flush the toilet at appropriately spaced intervals. Algorithm 600 also controls flushes at particular periods to make sure that the toilet has not been used without detection. The passive optical detector for algorithm 600 is preferably a photoresistor coupled to a readout circuit shown in FIG. 9B.

Algorithm 600 has three light modes: a Bright Mode (Mode 1), a Dark Mode (Mode 3 ), and a Normal Mode (Mode 2 ). The Bright Mode (Mode 1 ) is set as the microcontroller mode when resistance is less than 2 kΩ (Pb), corresponding to large amounts of light detected (FIG. 12). The Dark Mode (Mode 3 ) is set when the resistance is greater than 2 MΩ (Pd), corresponding to very little light detected (FIG. 12). The Normal Mode (Mode 2) is defined for a resistance is between 2 kΩ and 2 MΩ, corresponding to ambient, customary amounts of light. The resistance values are measured in terms of a pulse width (corresponding to the resistance of the photoresistor in FIG. 9B). The above resistance threshold values differ for different photoresistors and are here for illustration only.

The microcontroller is constantly cycling through algorithm 600, where it will wake up (for example) every 1 second, determine which mode it was last in (due to the amount of light it detected in the prior cycle). From the current mode, the microcontroller will evaluate what mode it should go to based on the current pulse width (p) measurement, which corresponds to the resistance value of the photoresistor.

The microcontroller goes through 6 states in Mode 2. The following are the states required to initiate the flush: An Idle status in which no background changes in light occur, presumably because there are no users present, and in which the microcontroller calibrates the ambient light; a TargetIn status, in which a target moves into the field of the sensor; an In8Seconds status, during which the target is in the field of the sensor, and the pulse width measured is stable for 8 seconds (if the target leaves after 8 seconds, there is no flush); an After8Seconds status, in which the target is in the sensor's field, and the pulse width is stable for more than 8 seconds, meaning the target has remained in front of the sensor for that time (and after which, if the target leaves, there is a cautionary flush); a TargetOut status, in which the target is moving away, out of the field of the sensor; an In2Seconds status, in which the background is stable after the target leaves. After this last status, the microcontroller flushes, and goes back to the Idle status.

As previously stated, the system functions using the principle that, not only will a user in front of the unit being used change the light levels being detected, but that a user will have to remain in front of a unit to use it. Therefore stability of the light conditions also plays a role in determining whether or not a user is nearby. Changes in light levels would be stable if a user is truly making use of the unit in question. The flusher, for example, uses that principle in the following manner (FIGS. 12-12I): once there is a nonstationary, unstable but increasing change in light as compared to the background levels, it is likely there is a user moving in or around the unit ("TargetIn"). This change can be a progressive increase (Down) or decrease (Up) in light. If the change continues and is stable for a specific period of time, there is someone likely stationary in front of the unit, using it ("In8Sec").

If then there is a progressive change (that is, unstable light levels) towards background light levels once more, the person is now once again moving in front of the unit, and is likely moving away from it ("TargetOut"). Once that light level, now closer to background is stable, the user is likely to have left once more ("In2Sec"), and the unit prepares to flush in a specific period of time.

When the target moves closer to the sensor, the target can block the light, particularly when wearing dark, light-absorbent clothes. Thus, the sensor will detect less light during the TargetIn status, so that resistance will go up (causing what will later be termed a TargetInUp status), while the microcontroller will detect more light during the TargetOut status, so that resistance will go down (later termed a TargetOutUp status). However, if the target wears light, reflective clothes, the microcontroller will detect more light as the target gets closer to it, in the TargetIn status (causing what will later be described as a TargetInDown status), and less during the TargetOut status (later termed a TargetOutDown status). Two seconds after the target leaves the toilet, the microcontroller will cause the toilet to flush, and the microcontroller will return to the Idle status.

To test whether there is a target present, the microcontroller checks the Stability of the pulse width, or how variable the p values have been in a specific period, and whether the pulse width is more variable than a constant, selected background level, or a provided threshold value of the pulse width variance (Unstable). The system uses two other constant, preselected values in algorithm 600, when checking the Stability of the p values to set the states in Mode 2. One of these two pre-selected values is Stable 1, which is a constant threshold value of the pulse width variance. A value below means that there is no activity in front of unit, due to the p values not changing in that period being measured. The second preselected value used to determine Stability of the p values is Stable 2, another constant threshold value of the pulse width variance. In this case a value below means that a user has been motionless in front of the microcontroller in the period being measured.

The microcontroller also calculates a Target value, or average pulse width in the After8Sec status, and then checks whether the Target value is above (in the case of TargetInUp) or below (in the case of TargetInDown) a particular level above the background light intensity: BACKGROUND×(1+PERCENTAGEIN) for TargetInUp, and BACKGROUND×(1−PERCENTAGEIN) for TargetInDown. To check for TargetOutUp and TargetOutDown, the microcontroller uses a second set of values: BACKGROUND×(1+PERCENTAGEOUT) and BACKGROUND×(1−PERCENTAGEOUT).

Figure 12:
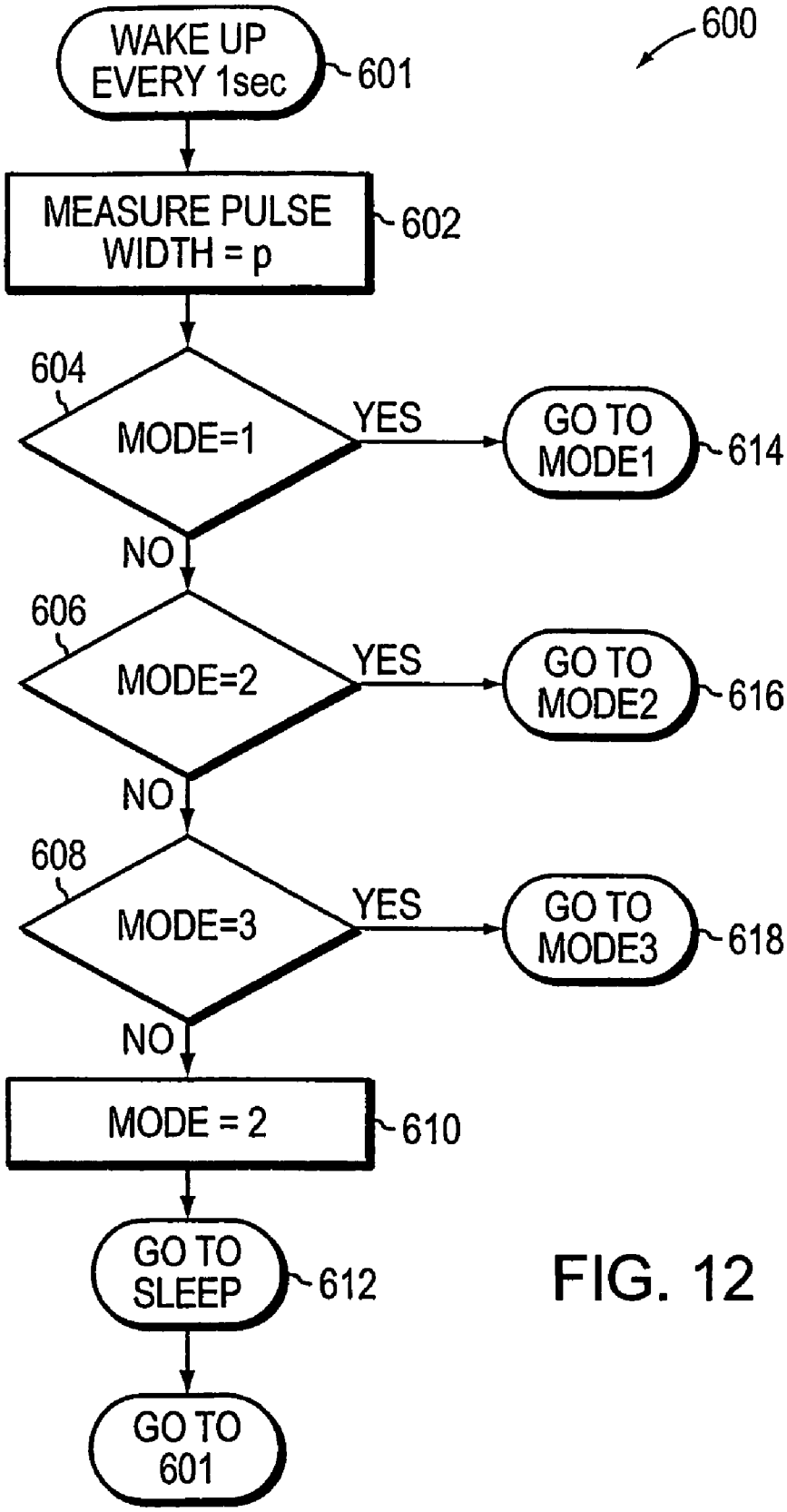
FIGS. 12, 12A, 12B, 12C, 12D, 12E, 12F, 12G, 12H and 12I show a flow diagram of a second algorithm for processing optical data detected by a passive sensor operating an automatic flusher system.

Referring to FIG. 12, every 1 second (601), the microcontroller will wake up and measure the pulse width, p (602). The microcontroller will then determine which mode it was previously in: If it was previously in Mode 1 (604), it will enter Mode 1 (614) now. It will similarly enter Mode 2 (616) if it had been in Mode 2 in the previous cycle (606), or Mode 3 (618) if it had been in Mode 3 in the previous cycle (608). The microcontroller will enter Mode 2 as default mode (610), if it cannot determine which mode it entered in the previous cycle. Once the Mode subroutine is finished, the microcontroller will go into sleep mode (612) until the next cycle 600 starts with step 601.

Figure 12A:
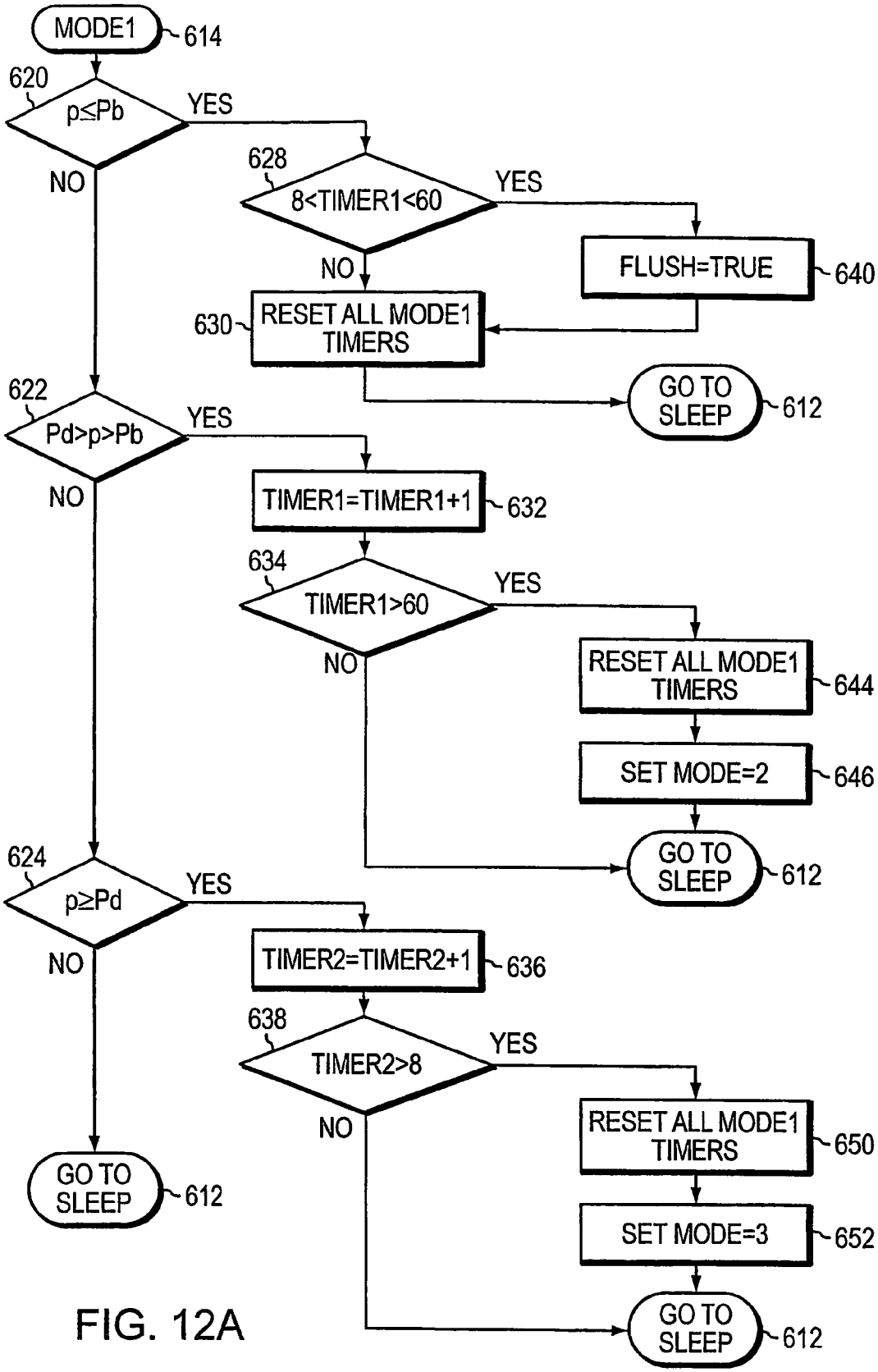

Referring to FIG. 12A (MODE 1—bright mode), if the microcontroller was previously in Mode 1 based on the p value being less than or equal to 2 kΩ, and the value of p now remains as greater than or equal to 2 KΩ (620) for a time period measured by timer 1 as greater than 8 seconds, but less than 60 seconds (628), the microcontroller will cause a flush (640), all Mode 1 timers (timers 1 and 2) will be reset (630), and the microcontroller will go to sleep (612) until the next cycle 600 starts at step 601. However, if p changes while timer 1 counts for more than 8 seconds, or less than 60 (628), there will be no flush (640). Simply, all Mode 1 timers will be reset (630), the microcontroller will go to sleep (612), and Mode 1 will continue to be set as the microcontroller mode until the next cycle 600 starts.

If the microcontroller was previously in Mode 1, but the value of p is now greater than 2 kΩ but less than 2 MΩ (622), for greater than 60 seconds (634) based on the timer 1 count (632), all Mode 1 timers will be reset (644), the microcontroller will set Mode 2 (646) as the system mode, so that the microcontroller will start in Mode 2 in the next cycle 600, and the microcontroller will go to sleep (612). However, if p changes while timer 1 counts for 60 seconds (134 to 148), Mode 1 will remain the microcontroller mode and the microcontroller will go to sleep (612) until the next cycle 600 starts.

If the microcontroller was previously in Mode 1, and p is now greater than or equal to 2 MΩ (624) while timer 2 counts (636) for greater than 8 seconds (638), all Mode 1 timers will be reset (650), the microcontroller will set Mode 3 (652) as the new system mode, and the microcontroller will go to sleep (612) until the next cycle 600 starts. However, if p changes while timer 2 counts for 8 seconds, the microcontroller will go to sleep (steps 638 to 612), and Mode 1 will continue to be set as the microcontroller mode until the start of the next cycle 600.

Figure 12B:
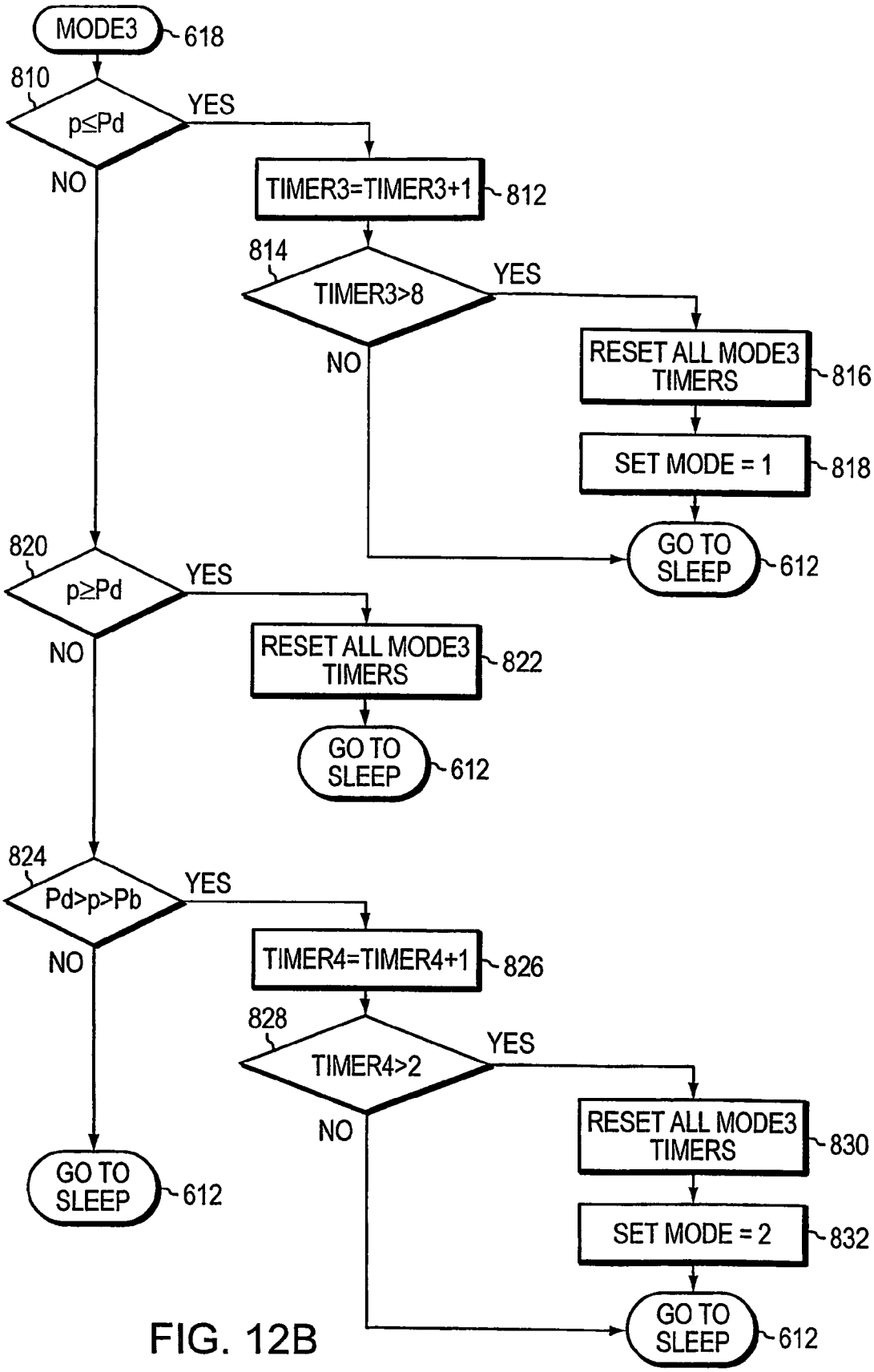

Referring to FIG. 12B (MODE 3—dark mode), if the microcontroller was previously in Mode 3 based on the value of p having been greater than or equal to 2 MΩ, but the value of p is now less than or equal to 2 kΩ (810) for a period measured by timer 3 (812) as greater than 8 seconds (814), the microcontroller will reset timers 3 and 4, or all Mode 3 timers (816), the microcontroller will set Mode 1 as the state (818) until the start of the next cycle 600, and the microcontroller will go to sleep (612). However, if the value of p changes while timer 3 counts for 8 seconds, the microcontroller will go from step 814 to 612, so that the microcontroller will go to sleep, and Mode 3 will continue to be set as the microcontroller mode until the next cycle 600 starts.

If the microcontroller was previously in Mode 3 based on the value of p having been greater than or equal to 2 MΩ, and the value of p is still greater than or equal to 2 MΩ (820), the microcontroller will reset timers 3 and 4 (822), the microcontroller will go to sleep (612), and Mode 3 will continue to be set as the microcontroller mode until the start of the next cycle 600.

If the microcontroller was previously in Mode 3, but p is now between 2 kΩ and 2 MΩ (824), for a period measured by timer 4 (826) as longer than 2 seconds (828), timers 3 and 4 will be reset (830), Mode 2 will be set as the mode (832) until the next cycle 600 starts, and the microcontroller will go to sleep (612). However, if p changes while timer 4 counts for longer than 2 seconds, Mode 3 will remain the microcontroller mode, and the microcontroller will go from step 828 to step 612, going to sleep until the next cycle 600 starts. If an abnormal value of p occurs, the microcontroller will go to sleep (612) until a new cycle starts.

Figure 12C:
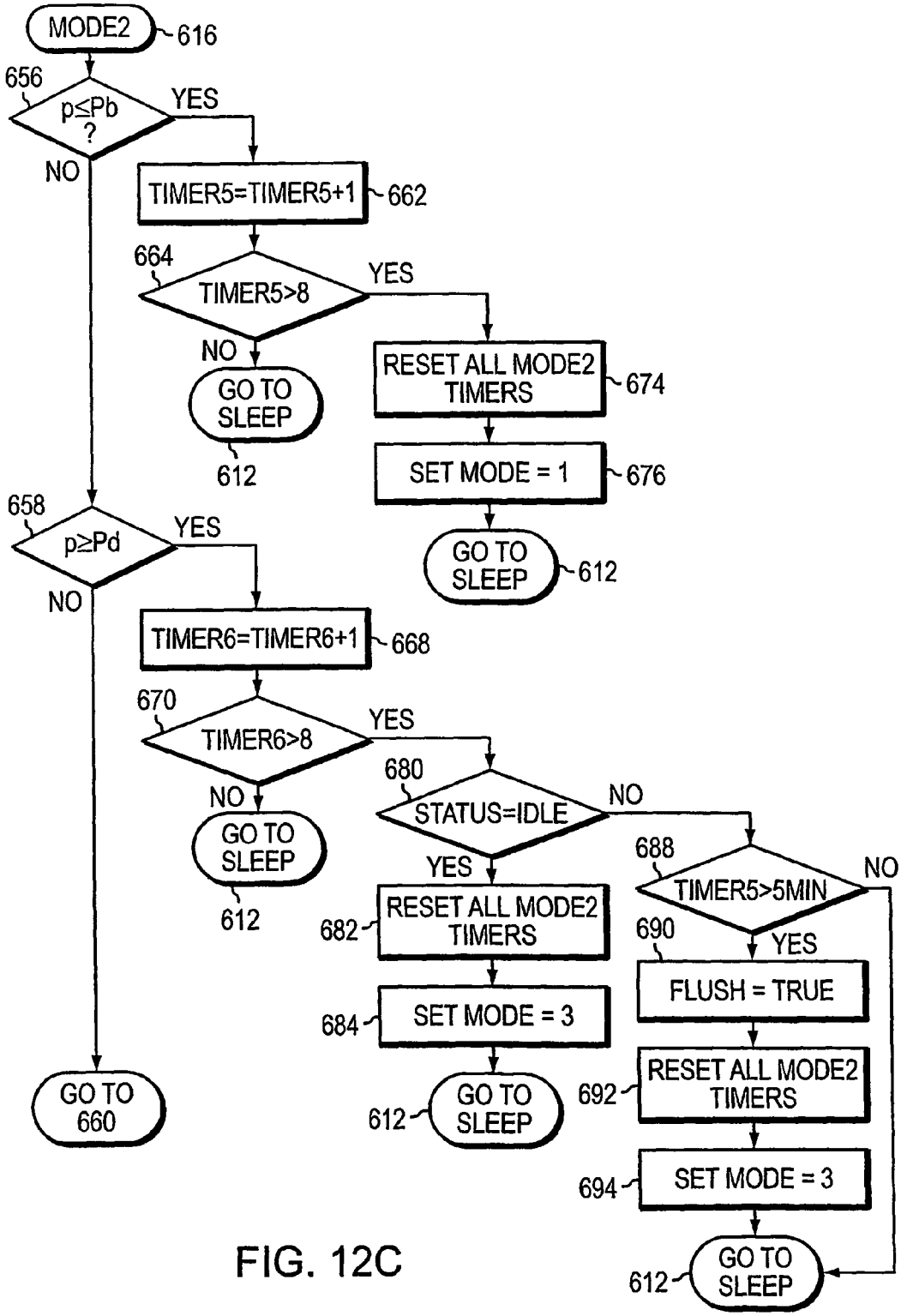

Referring to FIG. 12C (MODE 2—normal mode), if the microcontroller mode was previously set as Mode 2, and now p is less than or equal to 2 kΩ (656), for a period measured by timer 5 (662) as more than 8 seconds (664), all Mode 2 timers will be reset (674), Mode 1 (Bright Mode) will be set as the microcontroller mode (676), and the microcontroller will go to sleep (612). However, if p changes while timer 5 counts for longer than 8 seconds, the microcontroller will go to sleep (steps 664 to 612), and Mode 2 will remain the microcontroller mode until the next cycle 600 starts.

However, if now p is greater than or equal to 2 MΩ (658) for a period measured by timer 6 (668) as longer than 8 seconds (670), the toilet is not in Idle status (i.e., there are background changes, 680), and p remains greater than or equal to 2 MΩ while timer 6 counts for over 5 minutes (688), the system will flush (690). After flushing, timers 5 and 6 will be reset (692), Mode 3 will be set as the microcontroller mode (694), and the microcontroller will go to sleep (612). Otherwise, if p changes while timer 6 counts for longer than 5 minutes, the system will go from step 688 to 612, and go to sleep.

If the microcontroller mode was previously set as Mode 2, now p is greater than or equal to 2 MΩ (658) for a period measured by timer 6 (668) as more than 8 seconds (670), but the toilet is in Idle status (680), timers 5 and 6 will be reset (682), Mode 3 will be set as microcontroller mode (684), and the microcontroller will go to sleep at step 612.

If p is greater or equal to 2 MΩ, but changes while timer 6 counts (668) to greater than 8 seconds (670), the microcontroller will go to sleep (612), and Mode 2 will remain as the microcontroller mode. If p is within a different value, the microcontroller will go to step 660 (shown in FIG. 12D).

Figure 12D:
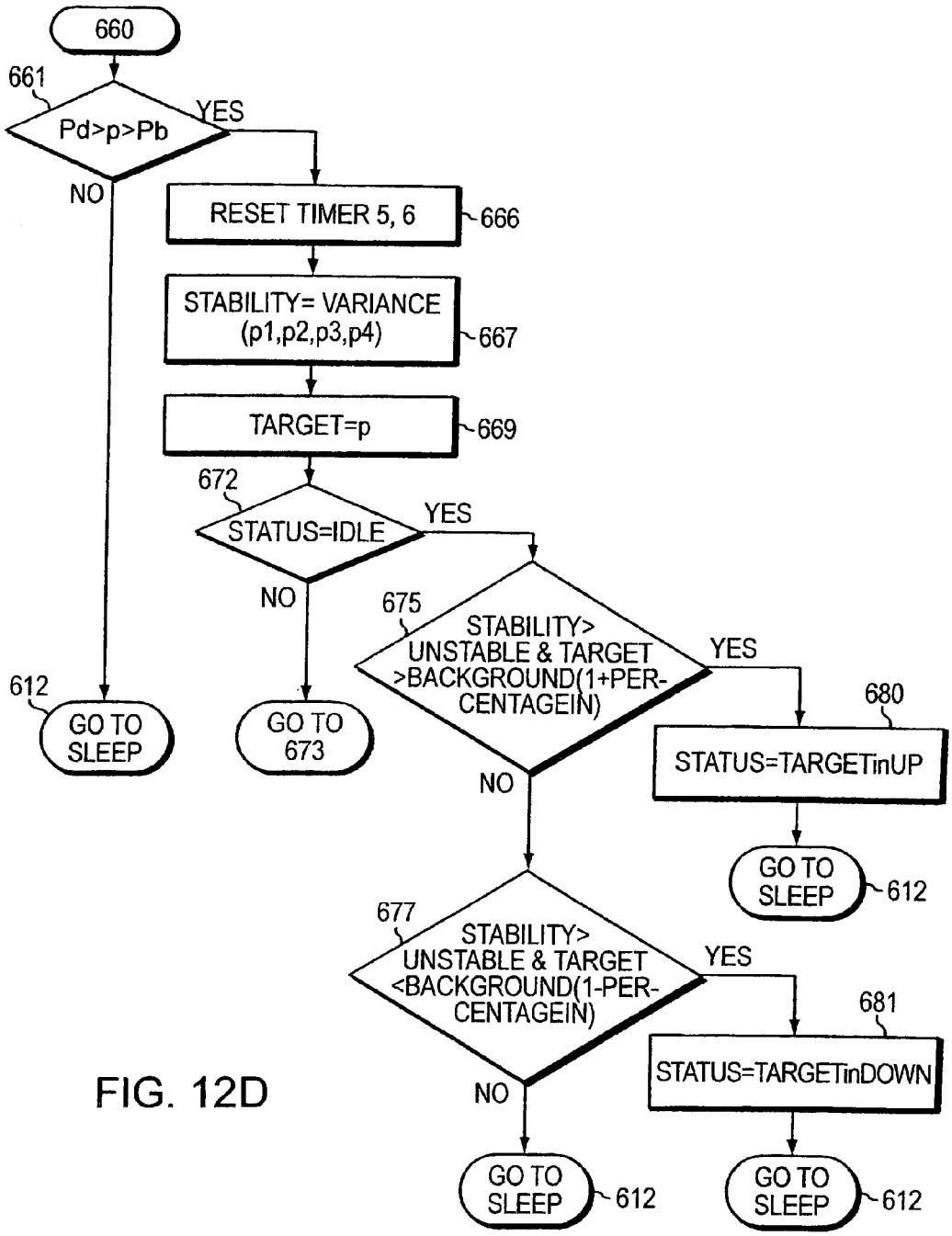

Referring to FIG. 12D, alternatively, if the microcontroller mode was previously set as Mode 2, and p is greater than 2 kΩ and less than 2 MΩ (661), timers 5 and 6 will be reset (666), pulse width Stability will be checked by assessing the variance of the last four pulse width values (667), and the Target value is found by determining the pulse width average value (step 669).

At this point, when the status of the microcontroller is found to be Idle (672), the microcontroller goes on to step 675. In step 675, if the Stability is found to be greater than the constant Unstable value, meaning that there is a user present in front of the unit, and the Target value is larger than the Background×(1+PercentageIn) value, meaning that the light detected by the microcontroller has decreased, this leads to step 680 and a TargetInUp status (i.e., since a user came in, towards the unit, resistance increased because light was blocked or absorbed), and the microcontroller will go to sleep (612), with Mode 2 TargetInUp as the microcontroller mode and status.

When the conditions set in step 675 are not true, the microcontroller will check if those in 677 are. In step 677, if the Stability is found to be greater than the constant Unstable value, due to a user in front of the unit, but the Target value is less than the Background×(1−PercentageIn) value, due to the light detected increasing, this leads to a "TargetInDown" status in step 681, (i.e., since a user came in, resistance decreased because light off of his clothes is reflected), and the microcontroller will go to sleep (612), with Mode 2 TargetInDown as the microcontroller mode and status. However, if the microcontroller status is not Idle (672), the microcontroller will go to step 673 (shown in FIG. 12E).

Figure 12E:
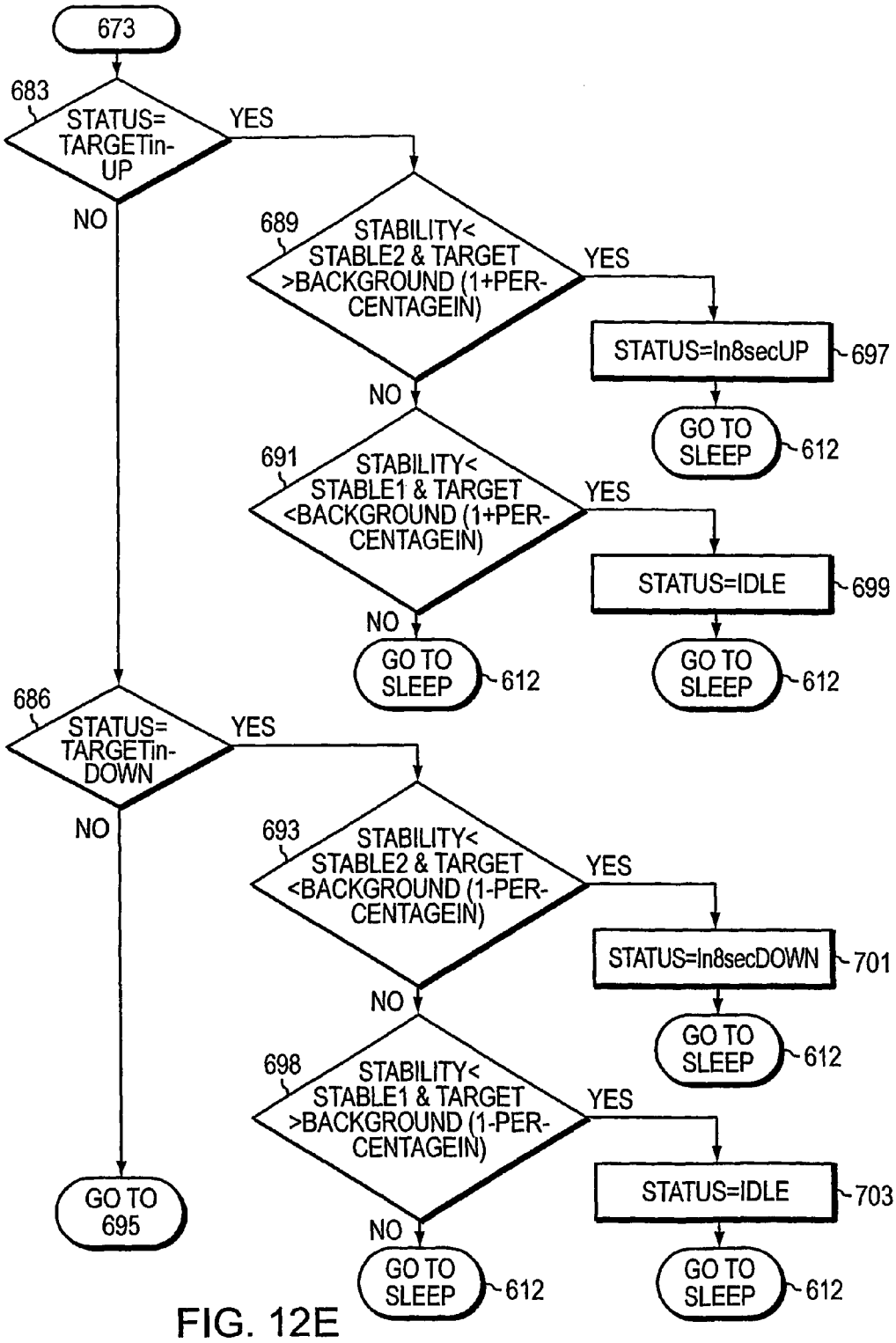

Referring to FIG. 12E, if the system starts in the TargetInUp status (683), at step 689 the system will check whether the Stability value is less than the constant Stable 2, and whether the Target value is greater than Background×(1+PercentageIn) (689). If both of these conditions are simultaneously met, which would mean that a user is motionless in front of the unit, blocking light, the microcontroller will now advance to In8SecUp status (697), and go to sleep (612). If the two conditions in step 689 are not met, the system will check whether Stability is less than Stable 1 and Target is less than Background×(1+PercentageIn) at the same time (691), meaning that there is no user in front of the unit, and there is a large amount of light being detected by the unit. If this is the case, the system status will now be set as Mode 2 Idle (699), and the microcontroller will go to sleep (612). If neither of the sets of conditions in steps 689 and 691 is met, the system will go to sleep (612).

If the TargetInDown status (686) had been set in the previous cycle, the system will check whether Stability is less than Stable 2 and Target is less than Background×(1−PercentageIn) at the same time in step 693. If this is so, which would mean that there is a user motionless in front of the unit, with more light being detected, the microcontroller will advance status to In8SecDown (701), and will then go to sleep (612).

If the two requirements in step 693 are not met, the microcontroller will check if Stability is less than Stable 1 while at the same time Target is greater than Background×(1−PercentageIn) in step 698. If both are true, the status will be set as Mode 2 Idle (703), due to these conditions signaling that there is no activity in front of the unit, and that there is a large amount of light being detected by the unit, and it will go to sleep (612). If Stability and Target do not meet either set of requirements from steps 693 or 698, the microcontroller will go to sleep (612), and Mode 2 will continue to be the microcontroller status. If status is not Idle, TargetInUp or TargetInDown, the microcontroller will continue as in step 695 (shown in FIG. 12F)

Figure 12F:
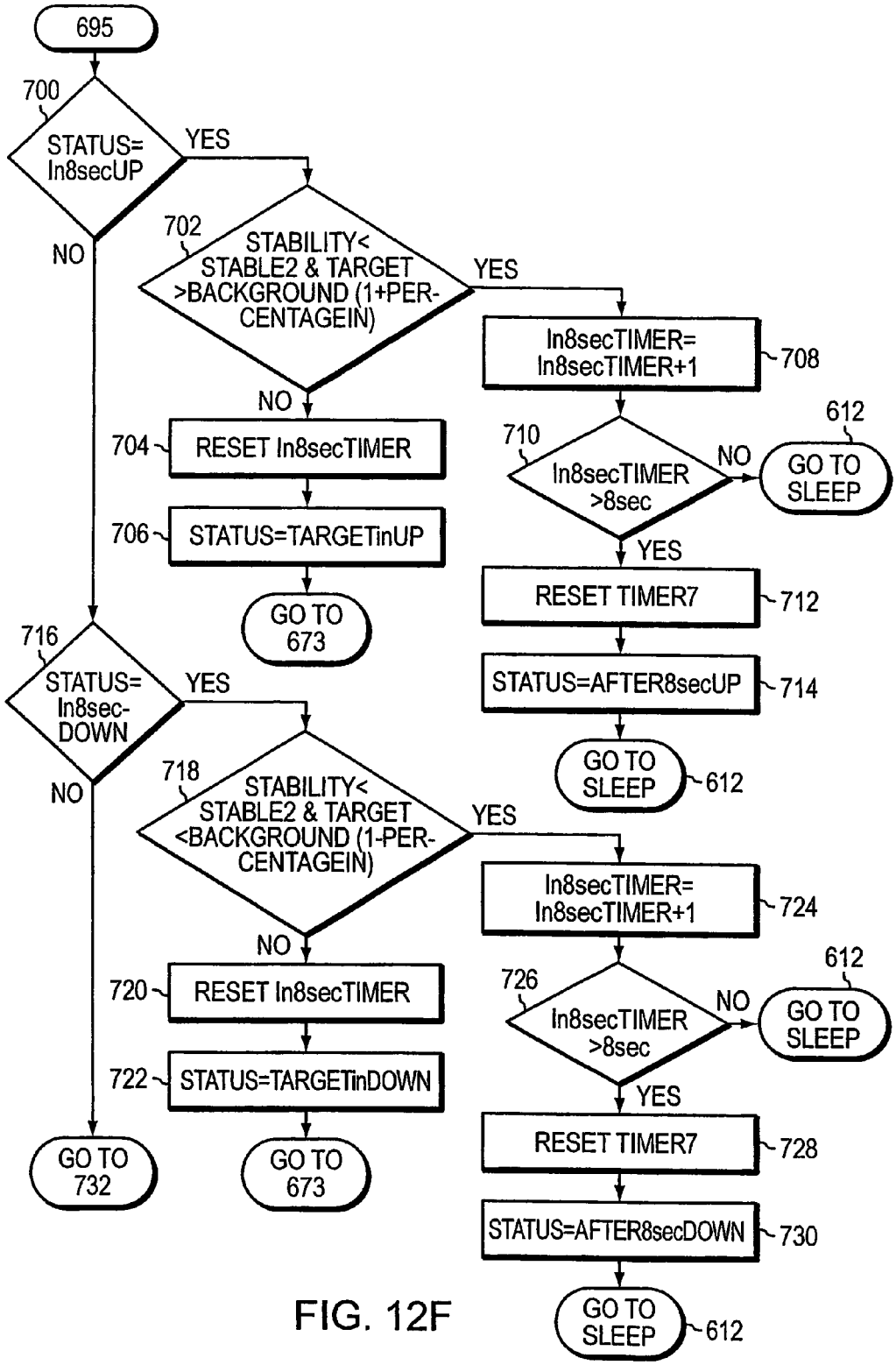

Referring to FIG. 12F, if In8SecUp had been set as the status (700), the unit will check whether Stability is less than Stable 2, and at the same time Target is greater than Background×(1+PercentageIn) in step 702. If these conditions are met, meaning that there is a motionless user before the unit, and that there is still less light being detected, the timer for the In8Sec status will start counting (708). If the two conditions continue to be the same while the timer counts for longer than 8 seconds, timer 7 is reset (712), the microcontroller advances to After8SecUp status (714), and finally goes to sleep (612). If the two conditions change while the timer counts to above 8 seconds (710), the microcontroller will go to sleep (612). If in step 702 the requirements are not met by the values of Stability and Target, the In8Sec timer is reset (704), in step 706 the microcontroller status is set as TargetInUp, and the microcontroller will proceed to step 673 (FIG. 12E).

Referring to FIG. 12F, if the microcontroller status was set as In8SecDown (716), the microcontroller checks whether Stability is less than Stable 2, and at the same time Target is less than Background×(1−PercentageIn) in step 718, to check whether the user is motionless before the unit, and whether it continues to detect a large amount of light. If the two values meet the simultaneous requirement, the In8Sec status timer will start counting (724). If it counts for longer than 8 seconds while the two conditions are met (726), timer 7 will be reset (728), the status will be advanced to After8SecDown (730), and the microcontroller will go to sleep (612).

If the timer does not count for longer than 8 seconds while Stability and Target remain at those ranges, the microcontroller will not advance the status, and will go to sleep (612). If the requirements of step 718 are not met by the Stability and Target values, the In8SecTimer will be reset (720), and the microcontroller status will be set to TargetInDown (722), where the microcontroller will continue to step 673 (FIG. 12E). If the Mode 2 state is none of those covered in FIGS. 12C-F, the system continues through step 732 (shown in FIG. 12G)

Figure 12G:
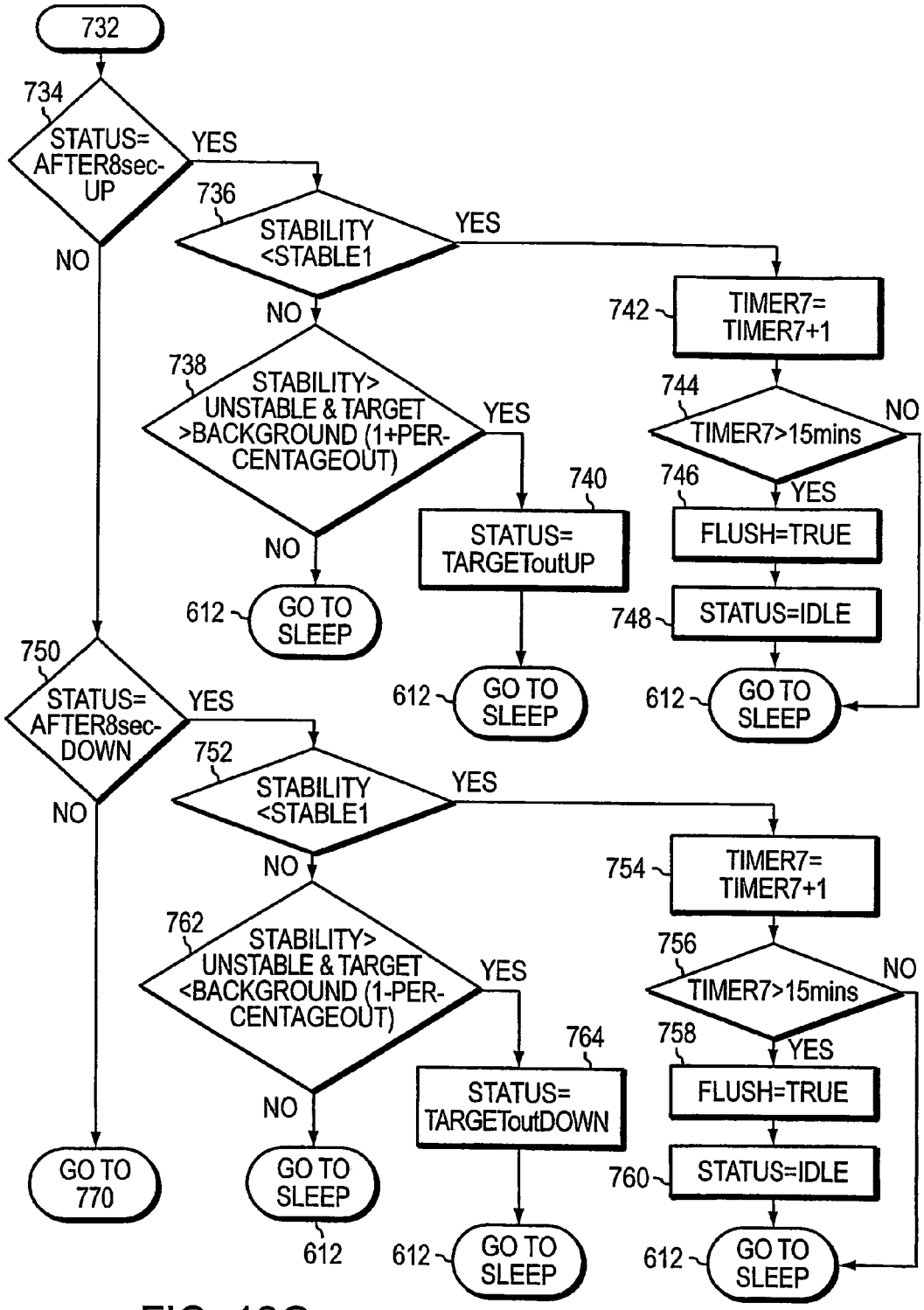

Referring to FIG. 12G, in step 734, if the system was in the After8SecUp status (734), it will check whether Stability is less than Stable 1, that is, whether there is no activity before the unit. If so, timer 7 will start counting (742), and if Stability remains less than Stable 1 until timer 7 counts for longer than 15 minutes (744), the microcontroller will flush (746), the Idle status will be set (748), and the microcontroller will go to sleep (612). If Stability does not remain less than the Stable 1 value until timer 7 counts for longer than 15 minutes, the microcontroller will go to sleep (612) until the next cycle.

If Stability was not less than Stable 1, the microcontroller checks whether it is greater than Unstable, and whether Target is greater than Background×(1+PercentageOut) (738). If both simultaneously meet these criteria, meaning that there is a user moving in front of the unit, but there is more light being detected because they are moving away, the microcontroller advances to Mode 2 TargetOutUp as the microcontroller status (740), and the microcontroller goes to sleep (612). If Stability and Target do not meet the two criteria in step 738, the microcontroller goes to sleep (612).

If the microcontroller was in After8SecDown (750), it will check whether the Stability is less than Stable 1 at step 752. If so, timer 7 will begin to count (754), and if it counts for greater than 15 minutes (756), the microcontroller will flush (758), Idle status will be set (760), and the microcontroller will go to sleep (612). If Stability does not remain less than Stable 1 until timer 7 counts to greater than 15 minutes, the microcontroller will go to sleep (612) until the next cycle.

If the Stability is not found to be less than Stable 1 at step 752, the microcontroller will check whether Stability is greater than Unstable, while at the same time Target is less than Background×(1−PercentageOut) at step 762. If so, this means that there is a user in front of the unit, and that it detects less light because they are moving away, so that it will advance the status to TargetOutDown at step 764, and will go to sleep (612). Otherwise, if both conditions in step 762 are not met, the microcontroller will go to sleep (612). If the Mode 2 state is none of those covered in FIGS. 12C-G, system continues through step 770 (shown in FIG. 12H).

Figure 12H:
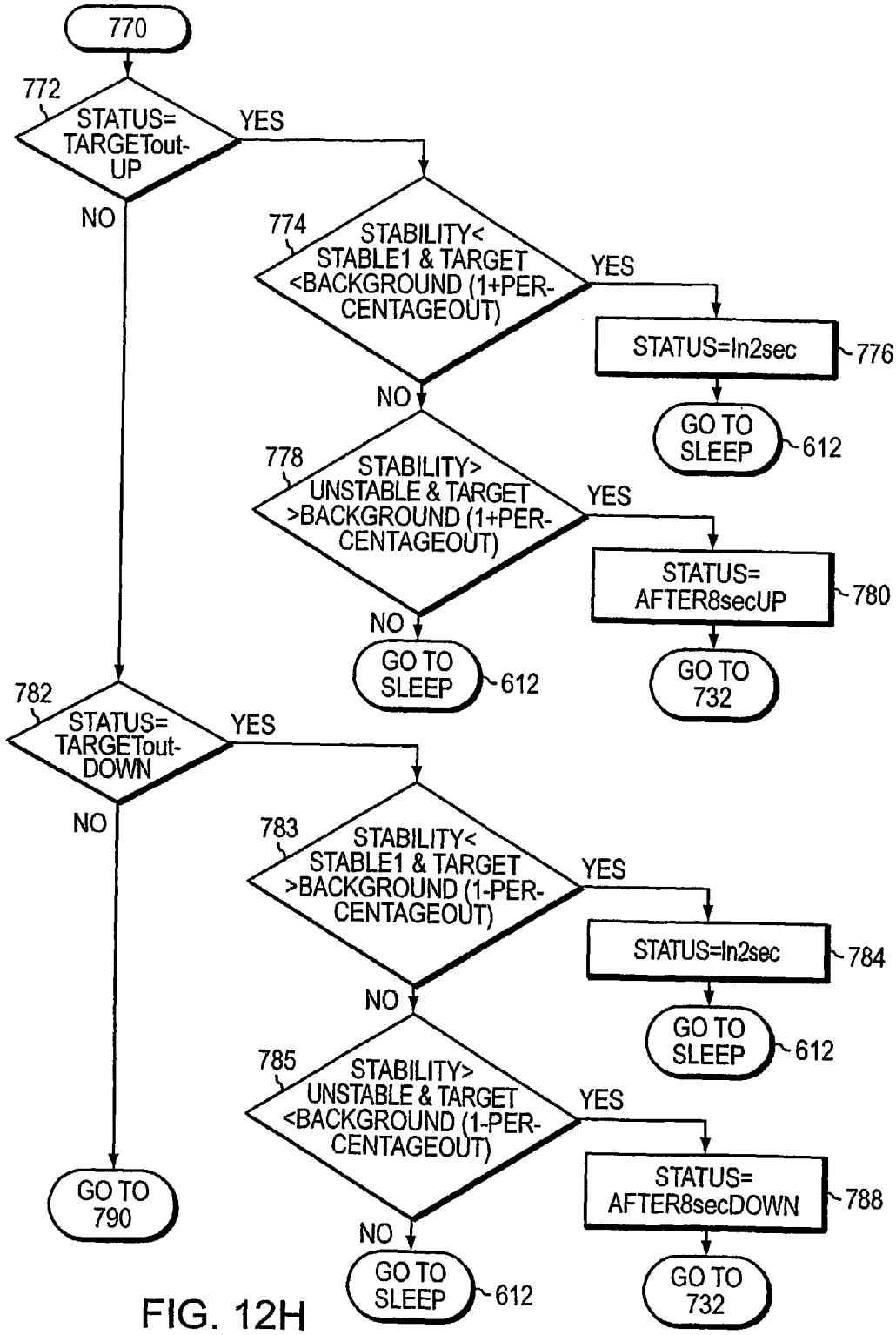
Figure 12I:
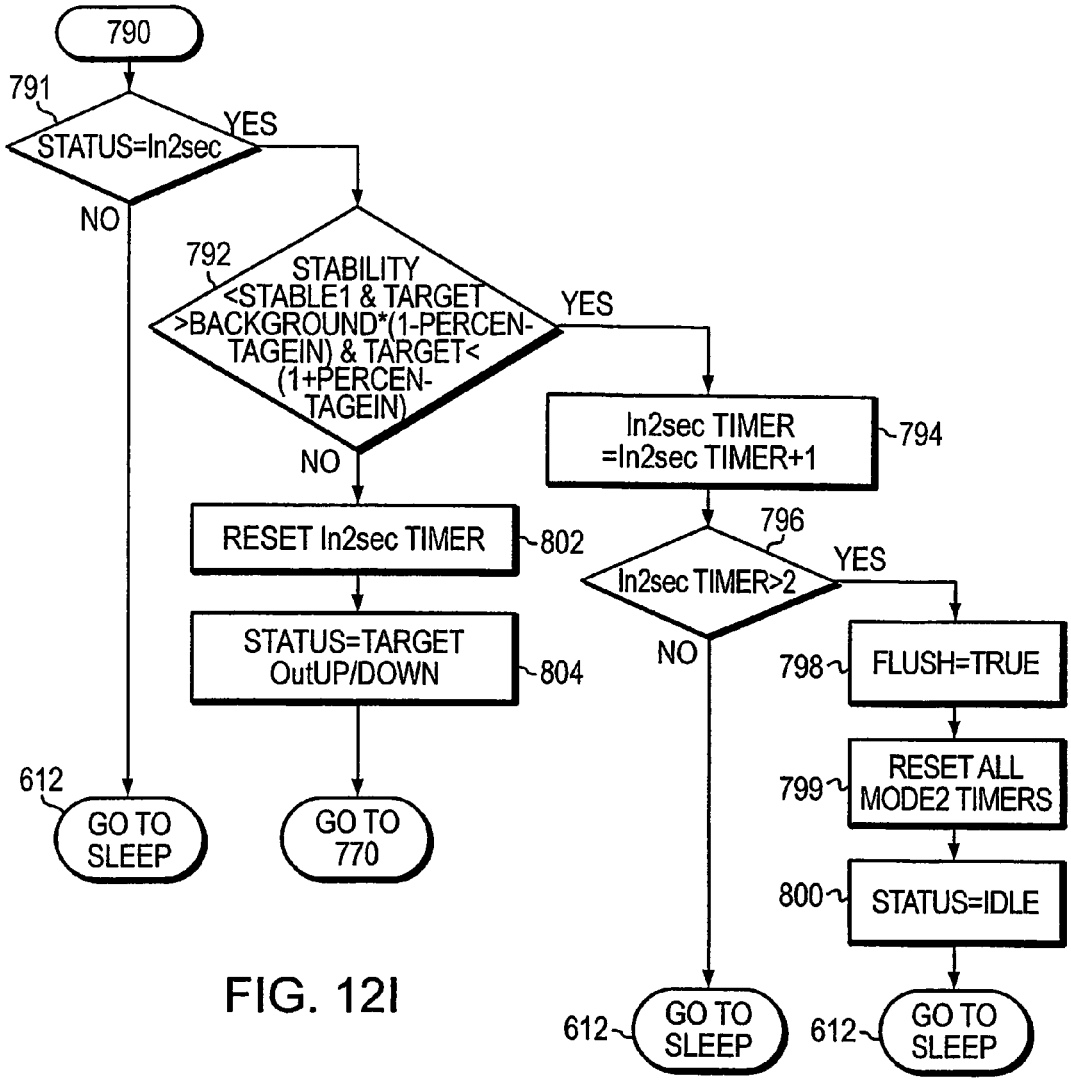

Referring to FIG. 12H, if TargetOutUp had been set as the status (772), the microcontroller will check whether Stability is less than Stable 1 while Target is less than Background×(1+PercentageOut), in step 774. If so, it will set the status as In2Sec (776), and the microcontroller will go to sleep (612). However, if Stability and Target do not simultaneously meet the criteria in step 774, the microcontroller will check if Stability is greater than Unstable and at the same time Target is greater than Background×(1+PercentageOut) in step 778. If so, it will set the status as After8SecUp (780), and it will go to 732 where it will continue (See FIG. 12). If Stability and Target do not meet the criteria of either step 774 or 778, the microcontroller will go to sleep (612).

If the microcontroller is in TargetOutDown status (782), it will check whether Stability is less than Stable 1, and Target greater than Background×(1−PercentageOut) simultaneously (783). If so, it would mean that there is no activity in front of the unit, and that there is less light reaching the unit, so that it will advance status to In2Sec (784), and go to sleep (612). However, if Stability and Target do not meet both criteria of step 783, the microcontroller will check whether Stability is greater than Unstable, and Target is less than Background×(1−PercentageOut) simultaneously in step 785. If so, the microcontroller will set status as After8SecDown (788), and go to step 732 where it will continue (See FIG. 12G). If Stability and Target meet neither set of criteria from steps 783 or 785, the microcontroller will go to sleep (612).

Referring to FIG. 121, if the microcontroller set In2Sec status in the previous cycle (791), it will check whether Stability is less than Stable 1 (792), which is the critical condition: since the user has left, there are no fluctuations in the light detected via resistance. It will also check whether the Target value is either greater than Background×(1−PercentageIn), or less than Background×(1+PercentageIn), in step 792. If this is the case, there is no activity in front of the unit, and the light detected is neither of the two levels required to signify a user blocking or reflecting light, which would indicate that there is no user in front of the unit. The system would then start the In2Sec status timer in step 794, and if it counts for longer than 2 seconds (796) with these conditions still at hand, the microcontroller will flush (798), all Mode 2 timers will be reset in step 799, the status will be set back to Idle in step 800, and the microcontroller will go to sleep (612). If the Stability and Target values change while the In2Sec timer counts to greater than 2 seconds (796), the microcontroller will go to sleep (612) until the start of the next 600 cycle.

If Stability and Target values do not meet the two criteria set in step 792, the In2Sec timer is reset (802), the status is changed back to either TargetOutUp or TargetOutDown in step 804, and the microcontroller goes to step 770 (FIG. 12H). If the microcontroller is not in In2Sec status either, the microcontroller will go to sleep (612), and start algorithm 600 again.

FIGS. 13, 13A, and 13B illustrate a control algorithm for faucets 10, 10A and 10B. Algorithm 900 includes two modes: Mode 1 is used when the passive sensor is located outside the water stream (faucet 10B), and Mode 2 is used when the passive sensor's field of view is inside the water stream (faucets 10 and 10A). In Mode 1 (algorithm 920) the sensor located outside the water stream detects the blocking of the light by a nearby user's hands, and checks for how long the low light remains steady, interpreting it as the user at the sink, but also excluding a darkening of the room the unit is placed in as a similar signal. This sensor then will directly turn off the water once the user has left the faucet, or once it no longer detects unstable, low levels of light.

In Mode 2 (algorithm 1000), the photoresistor inside the water stream also uses the above variables, but takes an additional factor into consideration: running water can also reflect light, so that the sensor may not be able to completely verify the user having left the faucet. In this case, the algorithm also uses a timer to turn the water off, while then actively checking whether the user is still there. Modes 1 or 2 may be selectable, for example, by a dipswitch.

Referring to FIG. 13, algorithm 900 commences after the power goes on (901), and the unit initializes the module in step 902. The microcontroller then checks the battery status (904), resets all timers and counters (906), and closes the valve (shown in FIGS. 1, 2, 4 and 4A) in step 908. All electronics are calibrated (910), and the microcontroller establishes a background light threshold level, (BLTH), in step 912. The microcontroller will then determine which mode to use in step 914: In Mode 1, the microcontroller executes algorithm 920 (to 922, FIG. 13A) and in Mode 2, the microcontroller executes algorithm 1000 (to 1002, FIG. 13B).

Referring to FIG. 13A, if the microcontroller uses Mode 1, the passive sensor scans for a target every ⅛ of a second (924). The scan and sleep time may be different for different light sensors (photodiode, photoresistor, etc. and their readout circuits). For example, the scan frequency can be every ¼ second or every ¾ second. Also, just as in the algorithm shown in FIG. 12, the microcontroller will go through the algorithm and then go to sleep in between the executed cycles. After scanning, the microcontroller measures the sensor level (SL), or value corresponding to the resistance of the photoresistor, at step 925. It will then compare the sensor level to the background light threshold level (BLTH): if the SL is greater than or equal to 25% of the BLTH (926), the microcontroller will further determine whether it is greater than or equal to 85% of the BLTH (927). These comparisons determine the level of ambient light: if the SL is higher than or equal to 85% of the BLTH calculated in step 912, it would mean that it is now suddenly very dark in the room (947), so that the microcontroller will go into Idle Mode, and scan every 5 seconds (948) until it detects the SL being less than 80% of the BLTH, meaning there is now more ambient light (949). Once this is detected, the microcontroller will establish a new BLTH for the room (950), and cycle back to step 924, at which it will continue to scan for a target every ⅛ of a second with the new BLTH.

If SL is smaller than 25% of the previously established BLTH, this would mean that the light in the room has suddenly dramatically increased (direct sunlight, for example). The scan counter starts counting to see if this change is stable (928) as the microcontroller cycles through steps 924, 925, 926, 928 and 929, until it reaches five cycles (929). Once it does reach the five cycles under the same conditions, it will establish a new BLTH in step 930 for the now brightly lit room, and begin a cycle anew at step 922 using this new BLTH.

If, however, the SL is between 25% greater than or equal to, but no greater than 85% of the BLTH (at steps 926 and 927), light is not at an extreme range, but regular ambient light, and the microcontroller will set the scan counter to zero at step 932, measure SL once more to check for a user (934), and assess whether the SL is between greater than 20% BLTH or less than 25% BLTH (20% BLTH<SL<25% BLTH) at step 936. If not, this would mean that there is a user in front of the unit sensor, as the light is lower than regular ambient light, causing the microcontroller to move on to step 944, where it will turn the water on for the user. Once the water is on, the microcontroller will set the scan counter to zero (946), scan for the target every ⅛ of a second (948), and continue to check for a high SL, that is, for low light, in step 950 by checking whether the SL is less than 20% of the BLTH. When SL decreases to less than 20% of BLTH (950), meaning that the light detected increased, the microcontroller will move on to step 952, turning on a scan counter. The scan counter will cause the microcontroller to continue scanning every ⅛ of a second and checking that SL is still less than 20% of BLTH until over 5 cycles through 948, 950, 952 and 954 have passed (954), which would mean that there now has been an increase in light which has lasted for more than 5 of these cycles, and that the user is no longer present. At this point the microcontroller will turn the water off (956). Once the water is turned off, the whole cycle is repeated from the beginning.

Referring to FIG. 13B (algorithm 1000 for faucet 10), the microcontroller scans for a target every ⅛ of a second (1004), although, again, the time it takes between any of the scans could be changed to another period, for example, every ¼ of a second. Once more, the microcontroller will go through the algorithm and then go to sleep in between cycles just as in the algorithm shown in FIG. 12. After scanning, the microcontroller will measure the sensor level (1006), and compare the SL against the BLTH. Once again, if the SL is greater than or equal to 25% of the BLTH, the microcontroller will check whether it is greater than or equal to 85% of the BLTH. If it is, it will take it to mean that the room must have been suddenly darkened (1040). The microcontroller will then go into Idle Mode at step 1042, and scan every 5 seconds until it detects the SL being less than 80% of the BLTH, meaning it now detects more light (1044). Once it does, the microcontroller will establish a new BLTH for the newly lit room (1046), and it will cycle back to step 1004, starting the cycle anew with the new BLTH for the room.

If the SL is between greater than or equal to 25% or less than 85% of the BLTH, the microcontroller will continue through step 1015, and setting the scan counter to zero. It will measure the SL at step 1016, and assess if it is greater than 20% BLTH, but smaller than 25% BLTH (20% BLTH<SL<25% BLTH), at step 1017. If it is not, meaning there is something blocking light to the sensor, the microcontroller will turn water on (1024); this also turns on a Water Off timer, or WOFF (1026). Then, the microcontroller will continue to scan for a target every ⅛ of a second (1028). The new SL is checked against the BLTH, and if the value of SL is not between less than 25% BLTH, but greater than 20% BLTH (20% BLTH<SL<25% BLTH), the microcontroller will loop back to step 1028 and continue to scan for the target while the water runs. If the SL is within this range (1030), the WOFF timer now starts to count (1032), looping back to the cycle at step 1028. The timer's function is simply to allow some time to pass between when the user is no longer detected and when the water is turned off, since, for example, the user could be moving the hands, or getting soap, and not be in the field of the sensor for some time. The time given (2 seconds) could be set differently depending upon the use of the unit. Once 2 seconds have gone by, the microcontroller will turn the water off at step 1036, and it will cycle back to 1002, where it will repeat the entire cycle.

However, if at step 1017 SL is greater than 20% BLTH, but smaller than 25% BLTH (20% BLTH<SL<25% BLTH), the scan counter will begin to count the number of times the microcontroller cycles through steps 1016, 1017, 1018 and 1020, until more than five cycles are reached. Then, it will go to step 1022, where a new BLTH will be established for the light in the room, and the microcontroller will cycle back to step 1002, where a new cycle through algorithm 1000 will occur, using the new BLTH value.

Figure 14:
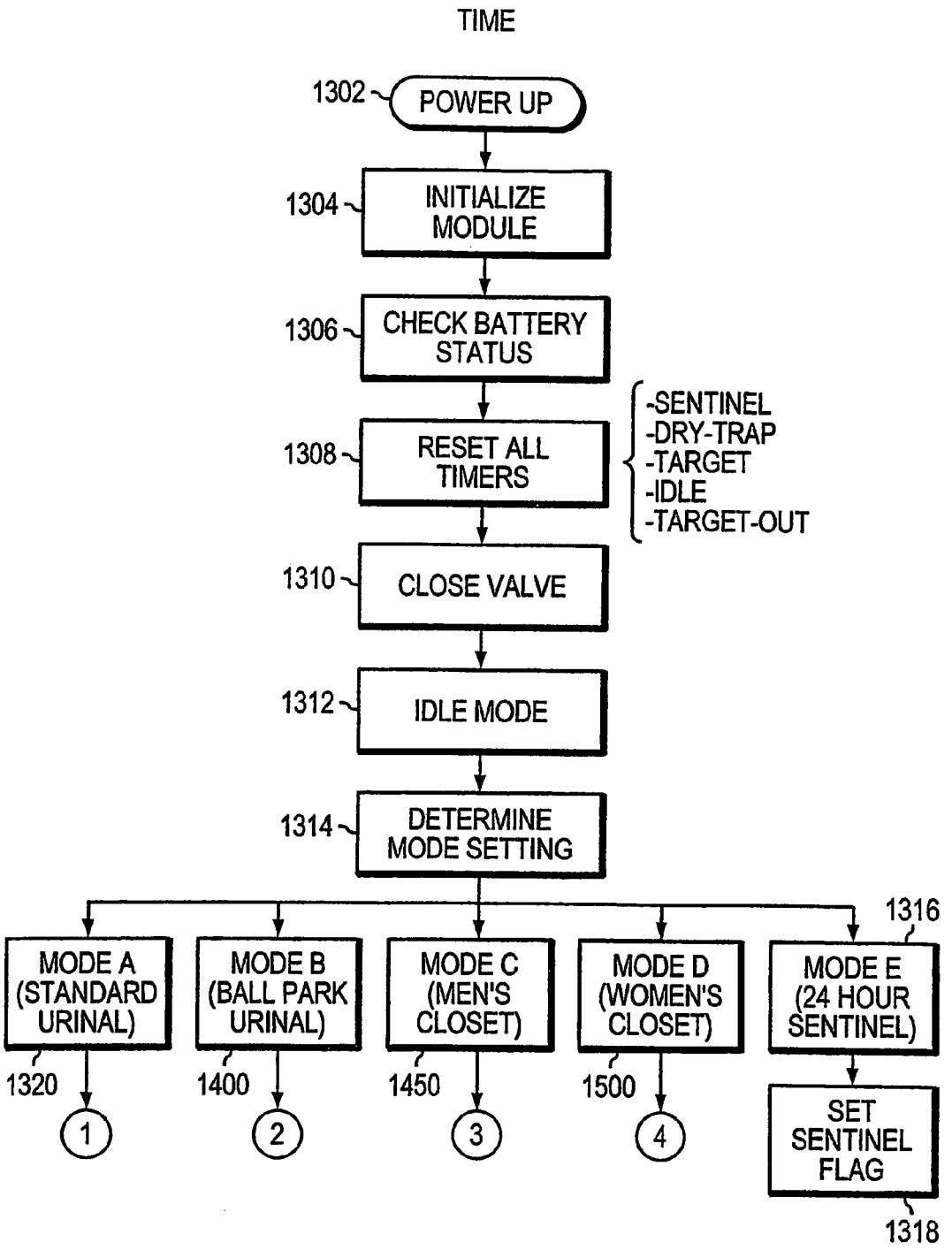

FIG. 14 illustrates flush algorithm 1300 for delivering selected water amounts depending on the use. Algorithm 1300 can be executed for optical data detected by a passive optical sensor. Algorithm 1300 is used in various toilet and urinal flushers and includes different modes of operation for different uses and different amounts of flush water used. Depending on the use, the various modes may be selected initially at the time of installation (via appropriate dip switches mounted on the flusher, or a user interface) or they may be selected subsequently by an operator. Upon providing power, the entire system powers up (1302) and the electronic module is initialized (1304). The microcontroller receives battery check status data (1306), and the unit resets all timers used in the algorithm described below (1308). The solenoid valve is initially closed (1310), and the unit enters the idle mode (1312). Depending on the mode setting, the algorithm enters mode A, B, C, D, or E, as described below.

FIGS. 14A-I and 14A-II illustrate a standard urinal mode (1320). The algorithm starts the idle timer at step 1322. In step 1324, if the sentinel flag is set (1318), the algorithm starts the sentinel timer (1342). After starting the sentinel timer at step 1342, if the timer counts for longer than 24 hours before the urinal is flushed or used (1344), it is reset at step 1346, and the microcontroller activates a flush after one second (1365). In step 1344, if the timer counts for less than 24 hours before the facility is flushed, the flusher will simply scan for a target (1330). The scan for target routine (1330) is also executed when the sentinel flag is not set at step 1324, a dry-trap timer is started (1326), and it does not count for longer than 12 hours (1328). The dry trap timer's purpose is to make sure that if the facility has not been used, a periodic flush occurs nonetheless.

At step 1332, if a target is found, the algorithm starts a target timer (1334). If the target timer counts for less than 8 seconds, the algorithm returns to step 1330, and continues scanning for a target. If the target's timer counts for longer than 8 seconds, the algorithm performs another scan for a target in step 1338. In step 1340, if the target is lost, the algorithm checks for the value of the time counted by the idle timer minus the target timer (1356). If the difference between the times counted by the two timers is less than 15 seconds, the algorithm activates the valve on every third target detected, providing a water amount equivalent to a half flush (1348). After providing a half flush (1348), the algorithm resets the idle timer (1370), resets the target timer (1372), and starts the idle timer once more to begin the cycle anew at step 1322.

If the difference between the times counted by the idle timer and the target timer is greater than 15 but less than 30 seconds (1358), the flusher executes a half-flush after one second at step 1360. It will then restart the algorithm, resetting the idle and target timers (1370 and 1372), and starting the idle timer (1322).

If the difference in times counted by the idle timer and the target timer is also greater than 30 seconds (1358), then the algorithm executes a full flush after one second (1365). After flushing the toilet or urinal, the idle timer and target timers are reset (1370 and 1372), and the system restarts the idle timer in step 1322. At this time, the entire Mode A is repeated.

If a target is not found at step 1332, the algorithm executes a detect blackout routine (1350), where light in the bathroom is measured. If there is light in the bathroom, i.e., there is no "blackout," the algorithm continues scanning for a target at step 1330. If there is a blackout (1352), the algorithm enters the blackout mode (1354), in which the flusher enters a "sleep mode" to save battery power. This subroutine detects no use, for example, at night or on weekends.

Figure 14B:
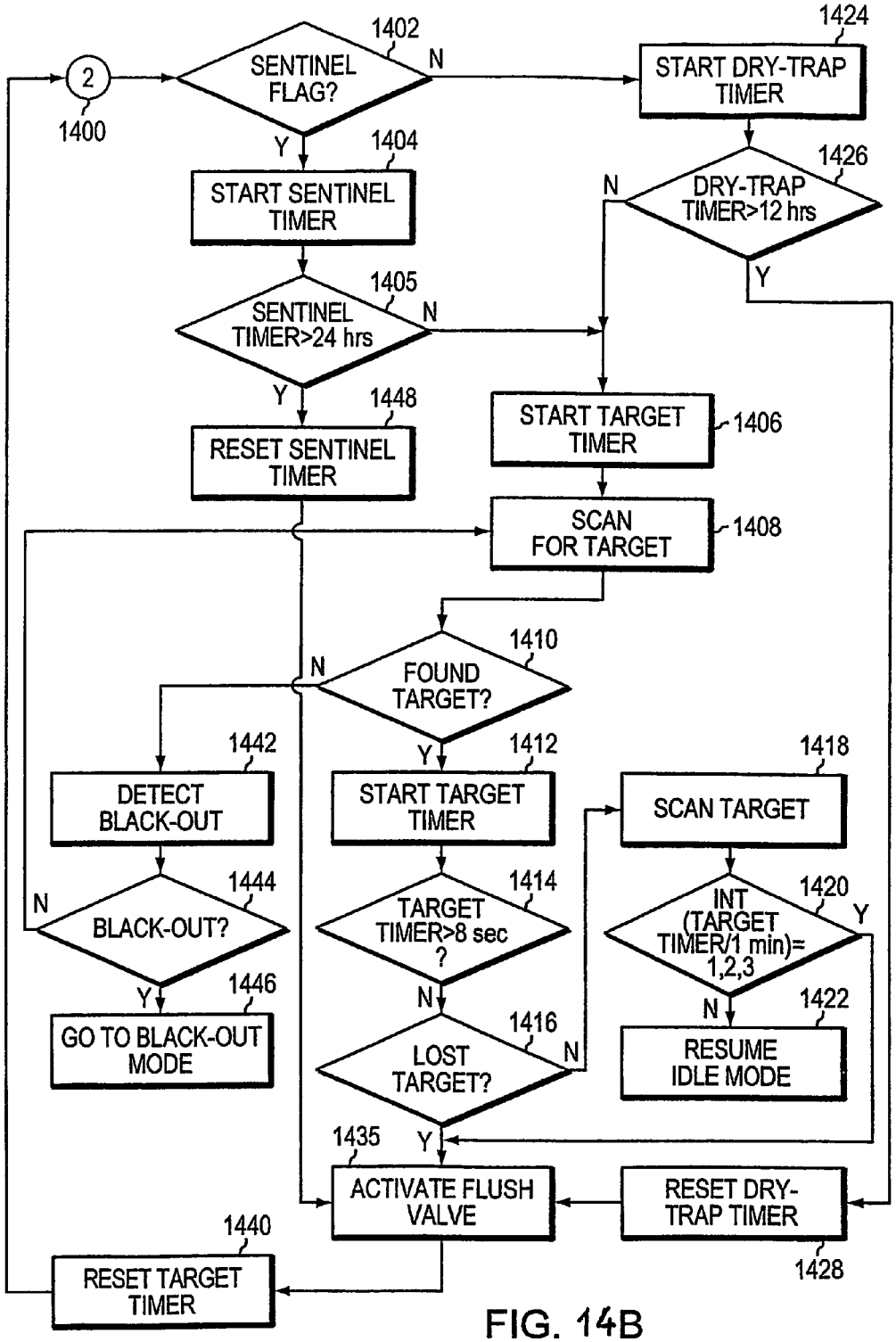

FIG. 14B illustrates a "Ball Park Urinal Mode" for a urinal used very often (1400). If the sentinel flag is set at step 1402, the algorithm starts the sentinel timer (1404). Once the sentinel timer counts for longer than 24 hours before the urinal is flushed, the timer is reset (1448), the flush valve is activated (1435), and the target timer is reset (1440), so the whole cycle begins anew.

If the sentinel timer counts for less than 24 hours before the toilet is flushed, a target timer is started (1406) and the system scans for a target at step 1408. If a target is found, the target timer is started (1412). When the target timer does not count for longer than 8 seconds at step 1414, if the target is lost (1416), the flush valve will be activated at step 1435, and the target timer will be reset (1440), so the algorithm can begin anew. If the target is not lost at step 1416, a new target scan will take place at step 1418.

If a sentinel flag is not set at step 1402, a dry-trap timer is started at step 1424. If at step 1426 this timer has counted for less than 12 hours before the urinal is flushed, the algorithm will next resume at step 1406, where the target timer will begin to count. However, if the dry-trap timer has counted for longer than 12 hours without the urinal being flushed, the timer is reset (1428), the flush valve is activated (1435), and the target timer-is reset (1440), so the algorithm can begin once more.

If a target is not found at step 1410, the algorithm executes a detect blackout routine (1442). If there is no blackout, the algorithm continues to step 1408, to scan for a target. If a blackout is detected, the algorithm enters the blackout mode (1446).

The last two modes, the men's and women's closet modes, illustrated in FIGS. 14C1-14DII, have patterns that also use both stability and light changes to detect whether a user has been in the facility. Both modes have an intermittent target detection feature and a target out timer, with which a lost target is checked for instability in detection before being discarded as invalid. In this case, the stability and length of time of the light change also determine the type of flush that follows use.

FIGS. 14C-I and 14C-II illustrate a "men's closet mode" (1450). If the sentinel flag is set at step 1452, a sentinel timer is started (1454), and if it has counted for less than 24 hours (1456) before the toilet is flushed, the target timer is started (1464). The flusher scans for the target at step 1465, and if the target's signal begins to be unstable and it loses the target (1466), the target-out timer is started (1468). Otherwise, the algorithm resumes at step 1470. If the target timer set at step 1464 counts for less than three seconds (1469), the microcontroller starts intermittent target detection at step 1484. The three-second objective has been added to ascertain that any unstable target signal found is not simply a passerby. If a target is found (1483), the target-out timer is reset at step 1482, and the algorithm goes back to step 1466 to check whether the target is lost once more.

However, if after intermittent target detection the target is still not found at step 1483, the microcontroller checks whether the target-out timer has counted for greater than 5 seconds. It will check for a target (i.e., cycle from step 1486 through 1483) until the target-out timer counts for longer than 5 seconds. At this point the algorithm begins anew, because if a target was detected for less than three seconds, and then lost for over 5, it is highly likely that what was detected was not a user.

If the target timer counted for over three seconds in step 1469, the microcontroller checks whether the target timer has counted for longer than 8 seconds (1470) while the target was lost. If so, it will check whether the period of time counted by the target timer was less than 90 seconds: that is, how long the user was in the facility. If use was for longer than 90 seconds, it will cause a full flush to occur (1490). If the timer counted for less than 90 seconds, it will activate the flush valve and cause a half flush (1474). Once either flush has occurred, the target timer will be reset at step 1475, and the algorithm will begin once more.

If the sentinel timer counts for longer than 24 hours before flushing occurs (1456), it is reset at step 1458, and a full flush is initiated at step 1490. The target timer is reset at step 1475, and the cycle begins once more.

If the sentinel flag is not set at step 1452, the dry-trap timer will start (1459), and if it counts for a short period of time before detecting use, it will begin to scan for a target at step 1462. However, once the timer counts for over one month (1460), it will be reset at step 1488, the flush valve will be activated, causing a full flush (1490), and the target timer will be reset at step 1475. At that point the algorithm will start once more.

If no target is found at step 1463, the microcontroller will check for a blackout (1476 and 1478). If none is detected at step 1478 it will go back to scanning for a target (1462). However, if one is detected, the algorithm will go to blackout mode (1480).

FIGS. 14D-I and 14D-II) illustrate a "women's closet mode" (1500). If the sentinel flag is set (1502), the sentinel timer starts (1504). If the sentinel timer counts for less than 24 hours before the toilet is flushed (1506), target scanning will begin at step 1512. If a target is found (1514), the target timer will start (1516), and another target scan will occur (1518). If the target's signal begins to be unstable and it loses the target (1520), the target-out timer will be started at step 1525. If in the meantime the target timer has counted for less than three seconds at step 1530, the algorithm will determine that it is sensing intermittent target detection (1564), and it will check for a found target once more at step 1562. If a target is not found at step 1562, and the target-out timer has counted for less than 5 seconds (1555), the unit will scan for a target once more (1560), and cycle through step 1562 to 1560. Once a target is found at step 1562, the algorithm will go on to step 1570, reset the target-out timer, and go back to step 1518, where it will begin anew to scan for a target, as in the "men's closet mode." If the target is not found at step 1555, and more than 5 seconds go by, the whole algorithm starts over. If the target is not lost at step 1520, the algorithm will go directly to step 1532.

If the target timer has counted for longer than three seconds at step 1530, it will move on to step 1532, where it will determine if it has counted for greater than 8 seconds. If it has yet to count for more than 8 seconds, the algorithm will go back to step 1518 and scan. However, once the target timer has counted for longer than 8 seconds, the microcontroller will go to step 1534, to determine if any time has passed since it activated the target-out timer at step 1525. If the target-out timer has counted at all, the flush preparation timer will start (1536). The algorithm will cause the preparation timer to count for over 30 seconds (1538 and 1540), at which point the microcontroller will determine whether the target timer has counted for less than 120 seconds (i.e., a user has been in the unit for less than two minutes). If so, the flush valve will be activated, and a half flush will occur (1546), after which the target timer and preparation timers will be reset (1548 and 1550), and the algorithm will begin once more.

However, if the target timer has counted for longer than 120 seconds (i.e., a user has been detected for longer than 2 minutes) while the preparation timer was counting, the flush valve will be activated, and a full flush will occur at step 1544, after which the target and preparation timers will be reset in steps 1548 and 1550, and the algorithm will begin anew.

If the sentinel flag is not set at step 1502, the dry-trap timer will start (1503). If the dry-trap timer counts for a short period of time (1510), if will begin to scan for a target at step 1512. However, once the timer counts for over one month (1510), it will be reset at step 1507 or 1508; the flush valve will be activated, causing a full flush (step 1544); and the target and preparation timers will be reset at steps 1548 and 1550, so that the algorithm can start once more.

If no target is found at step 1514, the microcontroller will check for a blackout (1572 and 1574). If none is detected at step 1574 it will go back to scanning for a target (1512). However, if a blackout is detected, the algorithm will go to blackout mode (1576).

Having described various embodiments and implementations of the present invention, it should be apparent to those skilled in the relevant art that the foregoing is illustrative only and not limiting, having been presented by way of example only. There are other embodiments or elements suitable for the above-described embodiments, described in the above-listed publications, all of which are incorporated by reference as if fully reproduced herein. The functions of any one element may be carried out in various ways in alternative embodiments. Also, the functions of several elements may, in alternative embodiments, be carried out by fewer, or a single, element.

The invention claimed is:

1. A system for controlling a valve of an electronic faucet or bathroom flusher, comprising:

a first optical element located at a first optical input port constructed and arranged to define a first field of view having a selected size and orientation that eliminate invalid targets;

a first light detector optically coupled to said first input port and constructed to detect ambient light arriving to said first detector from said first field of view;

a second optical element located at a second optical input port constructed and arranged to define a second field of view having a selected size and orientation that eliminate invalid targets;

a second light detector optically coupled to said second input port and constructed to detect ambient light arriving to said second detector from said second field of view; and a control circuit for controlling opening and closing of a flow valve, said control circuit being constructed to receive first data from said first light detector corresponding to the detected ambient light from said first field of view, and to receive second data from said second light detector corresponding to the detected ambient light from said second field of view, said control circuit being constructed to determine each said opening and closing of said flow valve based on a background level of said ambient light and a light level caused by a user, said control circuit being further constructed to control said opening and closing by executing a detection algorithm employing detection of increase and decrease of said ambient light due to the presence of the user within at least one of said fields of view, wherein said detection algorithm processes detection of said increase of ambient light in one of said fields of view and detection of said decrease of ambient light in the other of said fields of view due to the presence of the user.

2. The system of claim 1 wherein said control circuit is further constructed to control said opening and closing by executing said detection algorithm employing a rate of change in said first or second data.

3. The system of claim 2 wherein said detection algorithm processes detection of said increase of ambient light in said fields of view due to the presence of the user.

4. The system of claim 2 wherein said detection algorithm processes detection of said decrease of ambient light in said fields of view due to the presence of the user.

5. The system of claim 1 wherein said detection algorithm includes determining a transition from background data to target data by differentiating said first or second data.

6. The system of claim 1 wherein said first and second fields of view intersect.

7. The system of claim 1 wherein said first field of view is independent of said second field of view.

8. The system of claim 1 wherein said optical element includes an optical fiber.

9. The system of claim 1 wherein said optical element includes a lens.

10. The system of claim 1 wherein said optical element includes a pinhole.

11. The system of claim 1 wherein said optical element includes a slit.

12. The system of claim 1 wherein said optical element includes a mirror.

13. The system of claim 1 wherein said light detector is constructed to detect light in the range of 400 to 1000 nanometers.

14. The system of claim 1 wherein said control circuit is constructed to sample periodically said detector based on the amount of previously detected light.

15. The system of claim 1 wherein said control circuit is constructed to open and close said flow valve based on first detecting arrival of a user and then detecting departure of said user.

16. The system of claim 1 wherein said control circuit is constructed to open and close said flow valve based on detecting presence of a user.

17. The system of claim 1 wherein said flow valve is included in an electronic faucet system.

18. The system of claim 1 wherein said flow valve is included in a bathroom flusher system.

19. The system of claim 1 wherein said light detector includes a photodiode.

20. The system of claim 1 wherein said light detector includes a photoresistor.

21. The system of claim 6 wherein said optical element and said optical input port are constructed so that said light detector receives light in the range of 1 lux to 1000 lux.

22. The system of claim 1 wherein said valve is constructed to control operation of said faucet, and wherein said first field of view is directed toward a sink in a direction of a discharged water stream and said second field of view is in a direction of the user.

23. The system of claim 1 wherein said valve is constructed to control operation of said flusher, and wherein said first field of view is directed and angled below a horizontal direction and said second field of view is directed and angled above a horizontal direction.

24. A system for controlling an electronic faucet or bathroom flusher, comprising:

a body including a water conduit having at least one inlet for receiving water and at least one outlet for providing water;

a flow valve controlled by an actuator constructed to receive control signals for switching between an open state of said valve and a closed state of said valve; said open state permitting water flow from said inlet to said outlet, and said closed state of said valve preventing water flow from said inlet to said outlet;

a first optical element located at a first optical input port constructed and arranged to define a first field of view having a selected size and orientation that eliminate invalid targets;

a first light detector optically coupled to said first input port and constructed to detect ambient light arriving to said first detector from said first field of view;

a second optical element located at a second optical input port constructed and arranged to define a second field of view having a selected size and orientation that eliminate invalid targets;

a second light detector optically coupled to said second input port and constructed to detect ambient light arriving to said second detector from said second field of view; and a control circuit for controlling opening and closing of said flow valve, said control circuit being constructed to receive first data from said first light detector corresponding to the detected ambient light from said first field of view, and to receive second data from said second light detector corresponding to the detected ambient light from said second field of view, said control circuit being constructed to determine each said opening and closing of said flow valve based on a background level of said ambient light and a light level caused by a user, said control circuit executing a detection algorithm that processes detection of said increase of ambient light in one of said fields of view and detection of said decrease of ambient light in the other of said fields of view due to the presence of the user to determine each said opening and closing.

25. The system of claim 24 wherein said valve is constructed to control operation of said faucet, and wherein said first field of view is directed toward a sink in a direction of a discharged water stream and said second field of view is in a direction of the user.

26. The system of claim 24 wherein said valve is constructed to control operation of said flusher, wherein said first field of view is directed and angled below a horizontal direction and said second field of view is directed and angled above a horizontal direction.

27. The system of claim 24 wherein said control circuit is further constructed to control said opening and closing by executing said detection algorithm employing a rate of change in said first or second data.

28. The system of claim 27 wherein said detection algorithm includes determining a transition from background data to target data.

29. The system of claim 28 wherein said determination is performed by differentiating said first or second data from said light detector.

30. The system of claim 28 wherein said determination is performed using a stochastic algorithm on optical data from said light detector.

31. The system of claim 28 wherein said determination is performed using a predictive algorithm on optical data from said light detector.

32. The system of claim 29 wherein said detection algorithm initiates each said opening and closing of said flow valve based on a rate of change in said first or second data.

* * * * *